US008646549B2

(12) United States Patent
Ledbetter et al.

(10) Patent No.: US 8,646,549 B2
(45) Date of Patent: Feb. 11, 2014

(54) DRILLING MACHINE POWER PACK WHICH INCLUDES A CLUTCH

(75) Inventors: Timothy W. Ledbetter, Sachse, TX (US); Iain A. Peebles, Murphy, TX (US)

(73) Assignee: Atlas Copco Drilling Solutions LLC, Garland, TX (US)

( * ) Notice: Subject to any disclaimer, the term of this patent is extended or adjusted under 35 U.S.C. 154(b) by 67 days.

(21) Appl. No.: 12/576,103

(22) Filed: Oct. 8, 2009

(65) Prior Publication Data

US 2011/0083903 A1 Apr. 14, 2011

(51) Int. Cl.
*E21B 21/08* (2006.01)

(52) U.S. Cl.
USPC ..... 175/205; 175/106; 175/107; 192/209

(58) Field of Classification Search
USPC ..... 175/205, 106, 107, 162, 170, 202, 203; 173/2, 4, 11, 152, 218; 192/55.3, 55.6, 192/209
See application file for complete search history.

(56) References Cited

U.S. PATENT DOCUMENTS

| | | | | |
|---|---|---|---|---|
| 2,048,072 | A | 7/1936 | Johansen | |
| 2,539,584 | A | 1/1951 | Maier | |
| 2,916,122 | A | 12/1959 | Hindmarch | |
| 2,966,221 | A * | 12/1960 | Kinney | 175/5 |
| 2,979,176 | A | 4/1961 | Voth | |
| 3,106,999 | A | 10/1963 | Snoy | |
| 3,245,180 | A | 4/1966 | Bules et al. | |
| 3,265,175 | A | 8/1966 | Croswhite | |
| 3,334,704 | A * | 8/1967 | Gehrke et al. | 180/68.4 |
| 3,366,210 | A * | 1/1968 | Webster | 192/113.34 |
| 3,472,350 | A | 10/1969 | Overson | |
| 3,670,831 | A | 6/1972 | Winter, Jr. et al. | |
| 3,692,123 | A | 9/1972 | Gyongyosi | |
| 3,708,024 | A | 1/1973 | Back | |
| 3,778,940 | A | 12/1973 | Blecken | |
| 3,815,690 | A | 6/1974 | Cooper | |
| 3,823,902 | A | 7/1974 | Bumueller | |
| 3,833,072 | A | 9/1974 | Back | |
| 3,905,168 | A | 9/1975 | Nelmark et al. | |
| 3,961,440 | A | 6/1976 | Saito | |
| 3,968,845 | A | 7/1976 | Chaffin | |
| 3,992,831 | A | 11/1976 | Bukovitz et al. | |
| 4,020,909 | A | 5/1977 | Airaudo | |
| 4,022,410 | A | 5/1977 | Ewart et al. | |
| 4,052,135 | A | 10/1977 | Shoop et al. | |
| 4,070,926 | A | 1/1978 | Schneider et al. | |
| 4,088,427 | A | 5/1978 | Emanuelsson et al. | |
| 4,171,188 | A | 10/1979 | Anderson et al. | |
| 4,185,513 | A | 1/1980 | Ewart et al. | |
| 4,186,829 | A | 2/1980 | Schneider et al. | |

(Continued)

FOREIGN PATENT DOCUMENTS

| | | | |
|---|---|---|---|
| RO | 83239 | A2 | 2/1984 |
| WO | 2009077656 | A1 | 6/2009 |

*Primary Examiner* — Giovanna Wright
*Assistant Examiner* — Richard Alker
(74) *Attorney, Agent, or Firm* — Schmeiser, Olsen & Watts LLP

(57) ABSTRACT

A drilling machine includes a compressor coupled to a prime mover through a hydraulic clutch, wherein the hydraulic clutch is repeatably moveable between engaged and disengaged conditions. The compressor is allowed to provide air and is restricted from providing air in response to the hydraulic clutch being in the engaged and disengaged conditions, respectively. The hydraulic clutch is moveable between the engaged and disengaged conditions during operation of the prime mover.

41 Claims, 42 Drawing Sheets

(56) References Cited

U.S. PATENT DOCUMENTS

Figure 1A:
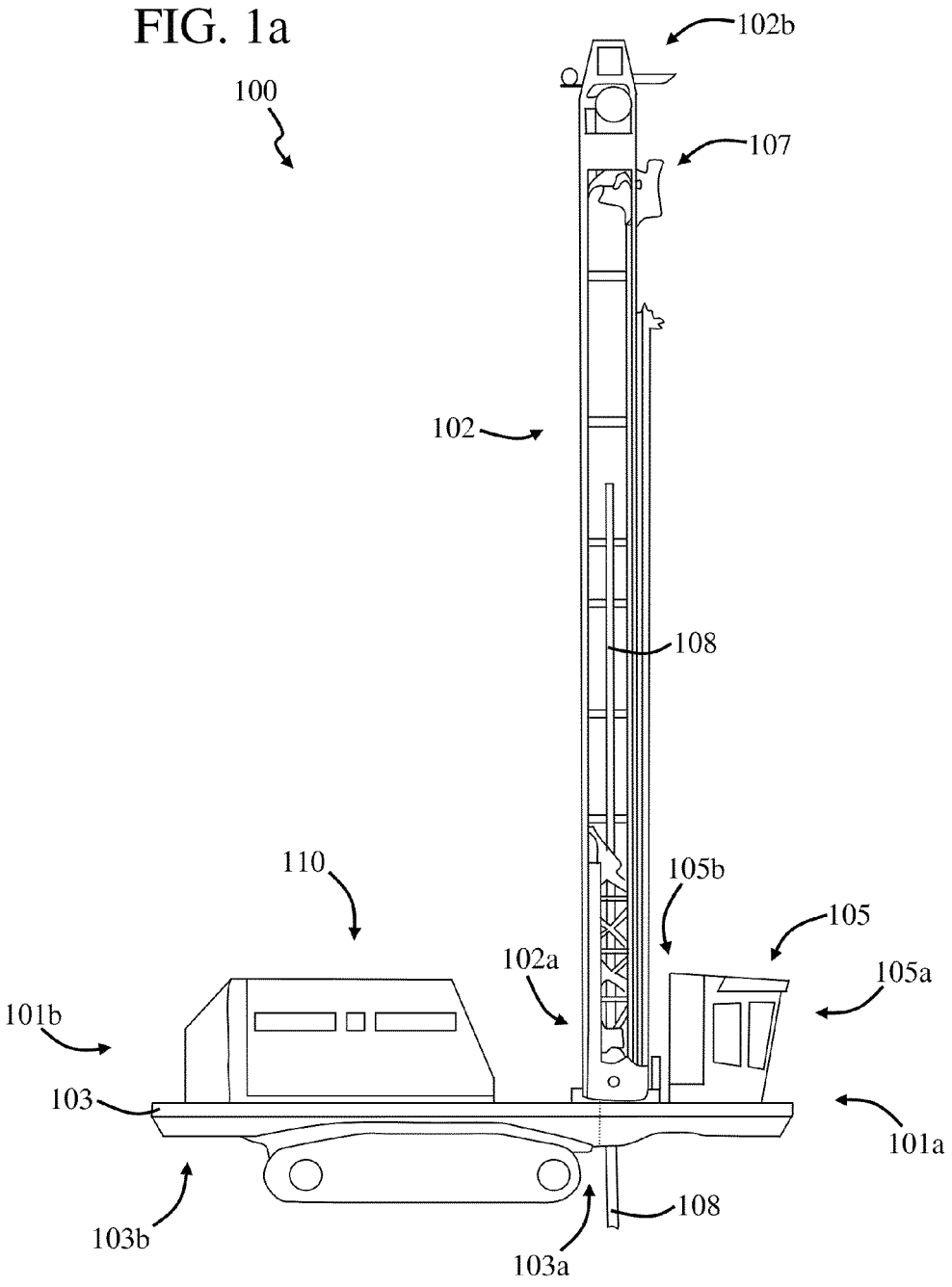

| | | | | | |
|---|---|---|---|---|---|
| 4,295,758 | A | | 10/1981 | Yashima | |
| 4,321,990 | A | * | 3/1982 | Koch, Jr. | 192/13 R |
| 4,361,217 | A | | 11/1982 | Bieber et al. | |
| 4,371,041 | A | | 2/1983 | Becker et al. | |
| 4,549,443 | A | | 10/1985 | White | |
| 4,595,065 | A | | 6/1986 | Wada et al. | |
| 4,683,994 | A | | 8/1987 | Weisenfelder | |
| 4,781,654 | A | * | 11/1988 | Walter et al. | 464/89 |
| 4,803,969 | A | | 2/1989 | Hiereth et al. | |
| 4,848,555 | A | | 7/1989 | Riese et al. | |
| 4,862,769 | A | | 9/1989 | Koga et al. | |
| 5,333,712 | A | | 8/1994 | Sabee et al. | |
| 5,400,862 | A | | 3/1995 | Behlke et al. | |
| 5,429,220 | A | | 7/1995 | Sabee et al. | |
| 5,456,345 | A | | 10/1995 | Bissett | |
| 5,474,499 | A | * | 12/1995 | Olson | 464/83 |
| 5,533,603 | A | | 7/1996 | Terranova et al. | |
| 5,697,763 | A | | 12/1997 | Kitchener | |
| 5,885,160 | A | * | 3/1999 | Tauvron | 464/68.7 |
| 5,988,299 | A | | 11/1999 | Hansen et al. | |
| 6,293,382 | B1 | | 9/2001 | Nishide et al. | |
| 6,305,515 | B1 | * | 10/2001 | Heidenreich et al. | 192/18 A |
| 6,450,309 | B1 | | 9/2002 | Hirai et al. | |
| 6,478,560 | B1 | | 11/2002 | Bowman | |
| 6,488,488 | B2 | | 12/2002 | Achtelik et al. | |
| 6,672,410 | B2 | | 1/2004 | Smith | |
| 6,675,915 | B2 | | 1/2004 | Smith | |
| 6,860,730 | B2 | | 3/2005 | Leppanen | |
| 6,981,855 | B2 | | 1/2006 | Leppanen | |
| 7,119,454 | B1 | | 10/2006 | Chiao | |
| 7,325,634 | B2 | | 2/2008 | Law et al. | |
| 7,347,285 | B2 | | 3/2008 | Hamner | |
| 7,350,593 | B1 | | 4/2008 | Brookover | |
| 7,391,129 | B2 | | 6/2008 | Chiao et al. | |
| 7,411,312 | B2 | | 8/2008 | Chiao | |
| 7,413,036 | B2 | | 8/2008 | Law et al. | |
| 7,428,944 | B2 | | 9/2008 | Gerum | |
| 2004/0173379 | A1 | | 9/2004 | Leppanen | |
| 2006/0027547 | A1 | | 2/2006 | Silvestro | |
| 2007/0246262 | A1 | | 10/2007 | Brookover | |
| 2008/0017465 | A1 | | 1/2008 | Pittius et al. | |

* cited by examiner

DRILLING MACHINE POWER PACK WHICH INCLUDES A CLUTCH

BACKGROUND OF THE INVENTION

1. Field of the Invention

This invention relates generally to drilling machines that provide compressed air to an drill bit.

2. Description of the Related Art

There are many different types of drilling machines for drilling through a formation. Some of these drilling machines are mobile and others are stationary. Some examples of mobile and stationary drilling machines are disclosed in U.S. Pat. Nos. 3,245,180, 3,692,123, 3,708,024, 3,778,940, 3,815,690, 3,833,072, 3,905,168, 3,968,845, 3,992,831, 4,020,909, 4,595,065, 5,988,299, 6,672,410, 6,675,915, 7,325,634, 7,347,285 and 7,413,036. Some drilling machines, such as the one disclosed in U.S. Pat. No. 4,295,758, are designed to float and are useful for ocean drilling. The contents of all of these cited U.S. Patents are incorporated by reference as though fully set forth herein.

A typical mobile drilling machine includes a vehicle and tower, wherein the tower carries a rotary head and drill string. In operation, the drill string is driven into the formation by the rotary head. In this way, the drilling machine drills through the formation. More information about drilling machines, and how they operate, can be found in the above-identified references.

The drilling machine typically includes a power pack, which includes a compressor operatively coupled to a prime mover. The prime mover can be of many different types, such as a diesel engine, gas engine, compressed natural gas (CNG) engine or electric motor. The prime mover provides power to the compressor, and the compressor operates in response. During operation, the compressor provides compressed air to the drill bit through the rotary head and drill string. The compressed air is used to flush cuttings from the borehole.

There are several problems, however, when powering the compressor with the prime mover. For example, the prime mover consumes a significant amount of energy in response to providing power to the compressor. For example, a prime mover which includes a diesel engine consumes a significant amount of diesel fuel in response to providing power to the compressor. A prime mover which includes a gas engine consumes a significant amount of gas in response to providing power to the compressor. A prime mover which includes a CNG engine consumes a significant amount of natural gas in response to providing power to the compressor. Further, a prime mover which includes an electric motor consumes a significant amount of electrical power in response to providing power to the compressor. The energy consumed by the prime mover is wasted if the prime mover provides power to the compressor, but the compressor does not provide compressed air to the drill bit. The compressor is often said to be in standby-mode when it is receiving power from the prime mover and not providing compressed air to the drill bit. It is desirable to reduce the amount of energy consumed by the prime mover in response to the compressor being in standby-mode.

In some situations, the compressor consumes about 25% to about 50% of its maximum rated power in standby-mode. Some compressors included with drilling machines have maximum rated power of between about 200 horsepower to about 600 horsepower. Hence, in standby-mode, the compressor can be consuming about 50 horsepower (25% of 200 horsepower) to about 300 horsepower (50% of 600 horsepower) when compressed air is not being provided to the drill bit. In a typical drilling operation, the compressor is in standby-mode for about 50% of the time. Hence, a significant amount of fuel is consumed by the prime mover and wasted by the drilling machine when the compressor is in standby-mode.

BRIEF SUMMARY OF THE INVENTION

The present invention is directed to a drilling machine having a power pack which includes a clutch, as well as a method of installing and using the clutch. The novel features of the invention are set forth with particularity in the appended claims. The invention will be best understood from the following description when read in conjunction with the accompanying drawings.

Figure 1B:
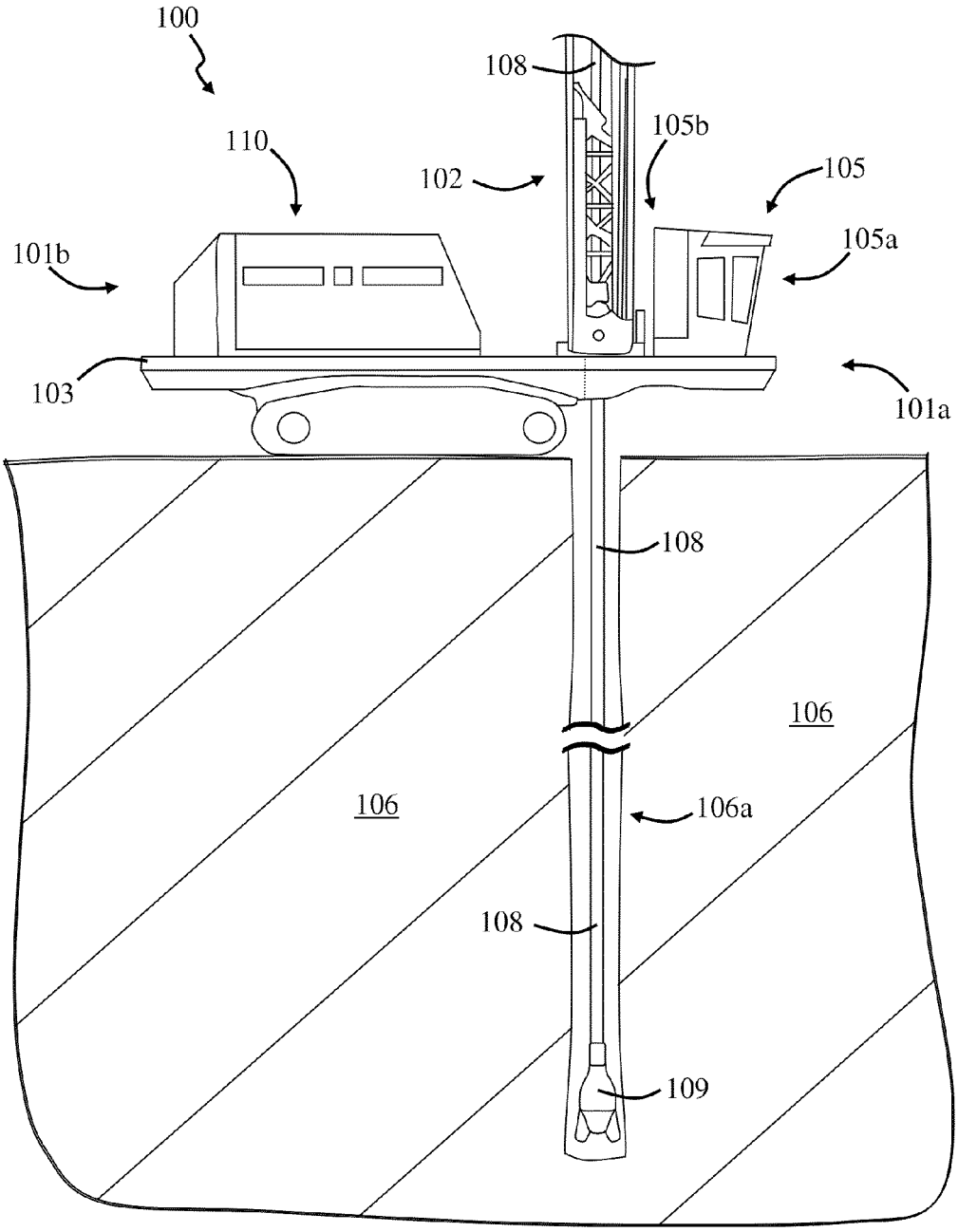

FIGS. 1*a* and 1*b* are side views of a drilling machine.

Figure 1C:
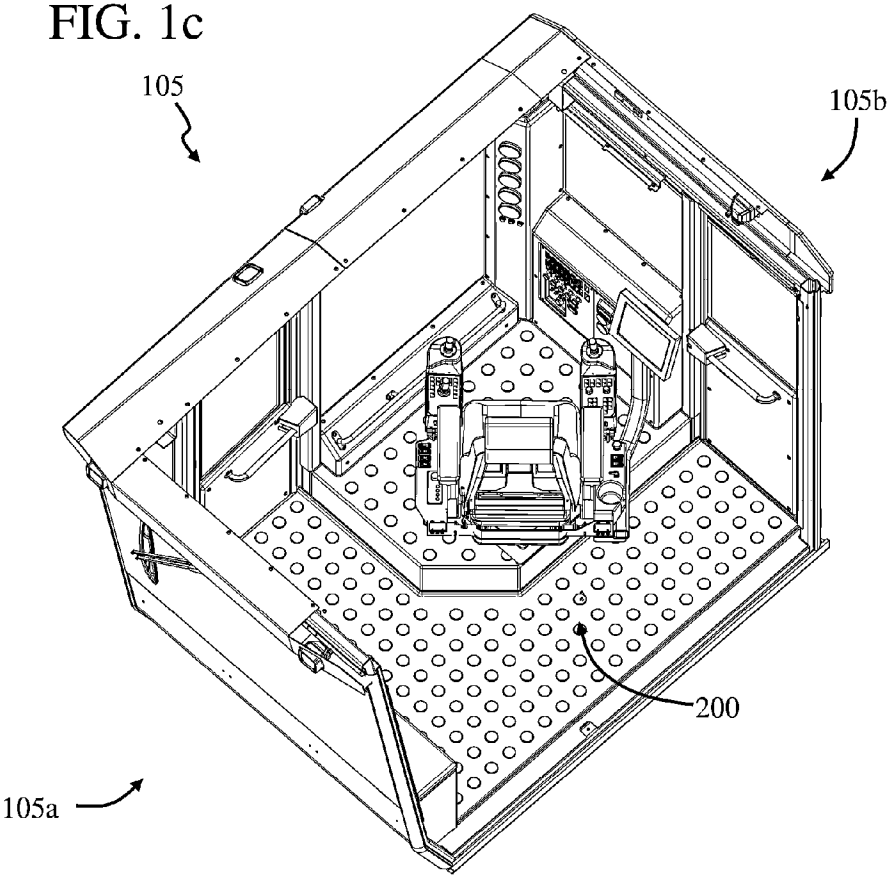

FIG. 1*c* is a perspective view of an operator's cab of the drilling machine of FIG. 1*a*, wherein the operator's cab includes a chair assembly.

Figure 1E:
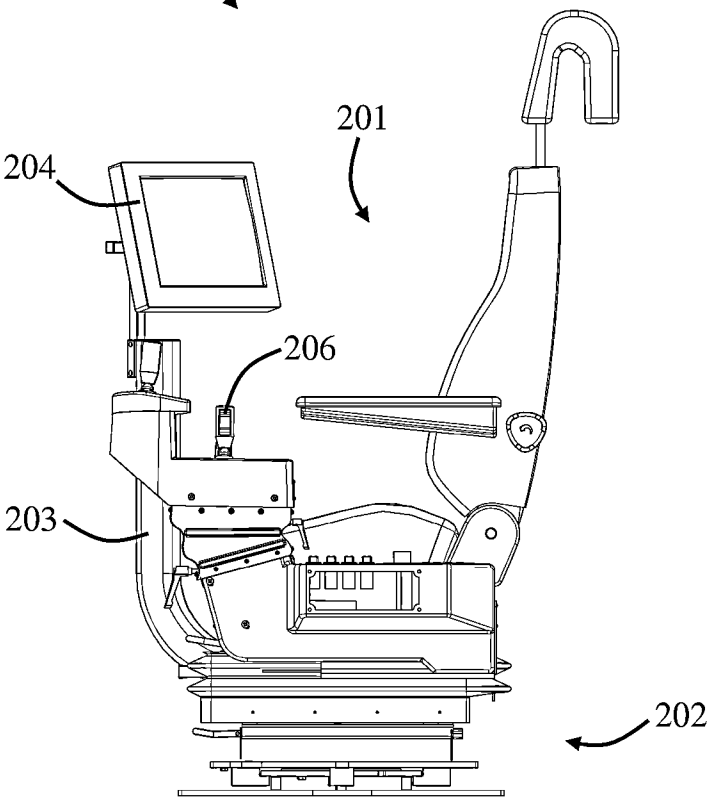
Figure 1D:
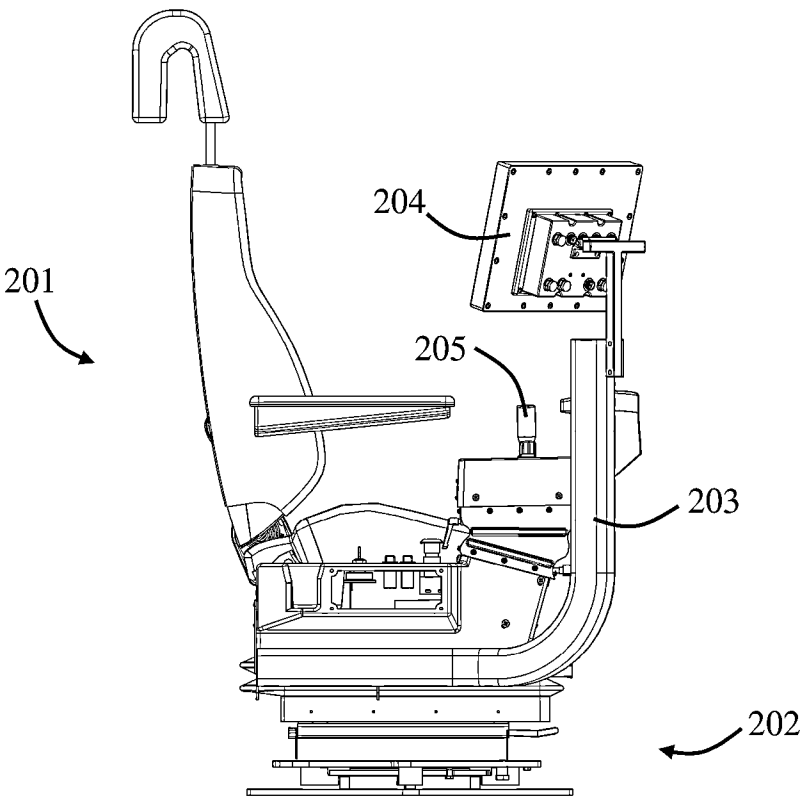

FIGS. 1*d* and 1*e* are side views of opposed sides of the chair assembly of FIG. 1*c*.

Figure 1G:
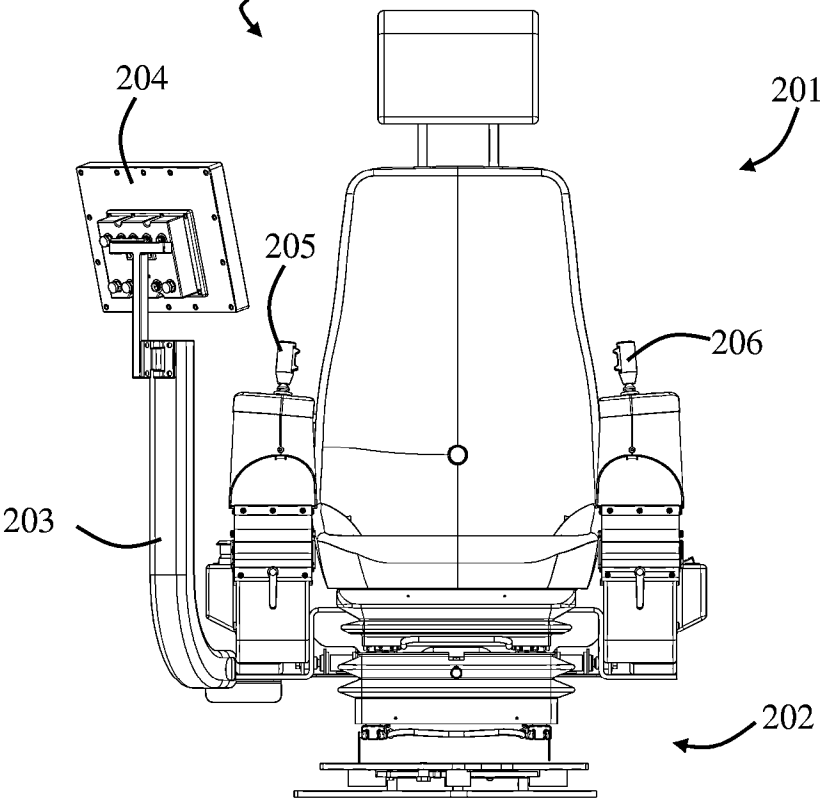
Figure 1F:
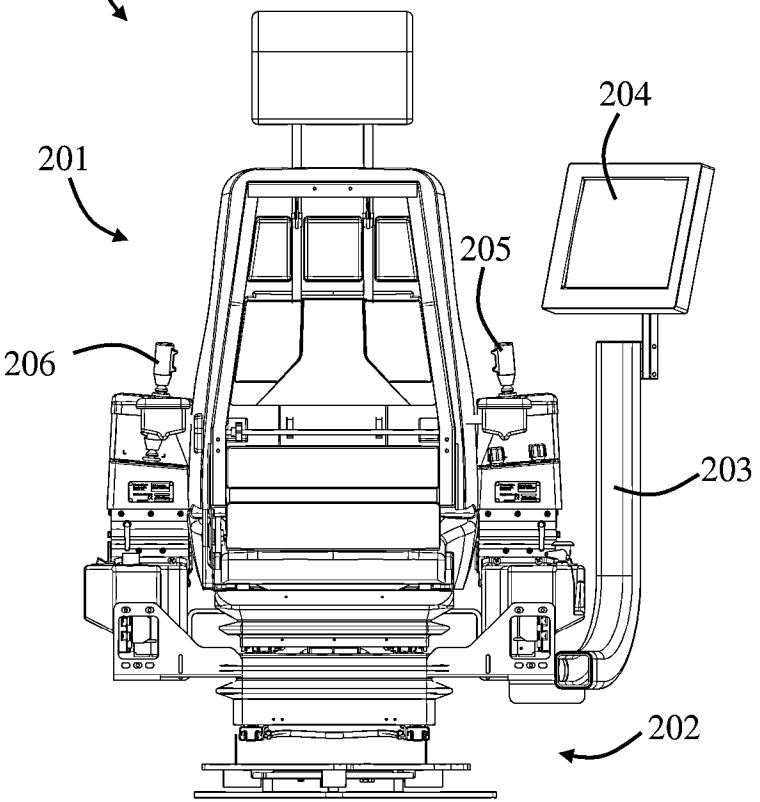

FIG. 1*f* is a side view of a chair of the chair assembly of FIG. 1*c* facing a display.

FIG. 1*g* is a side view of the chair of the chair assembly of FIG. 1*c* facing away from the display.

Figure 1H:
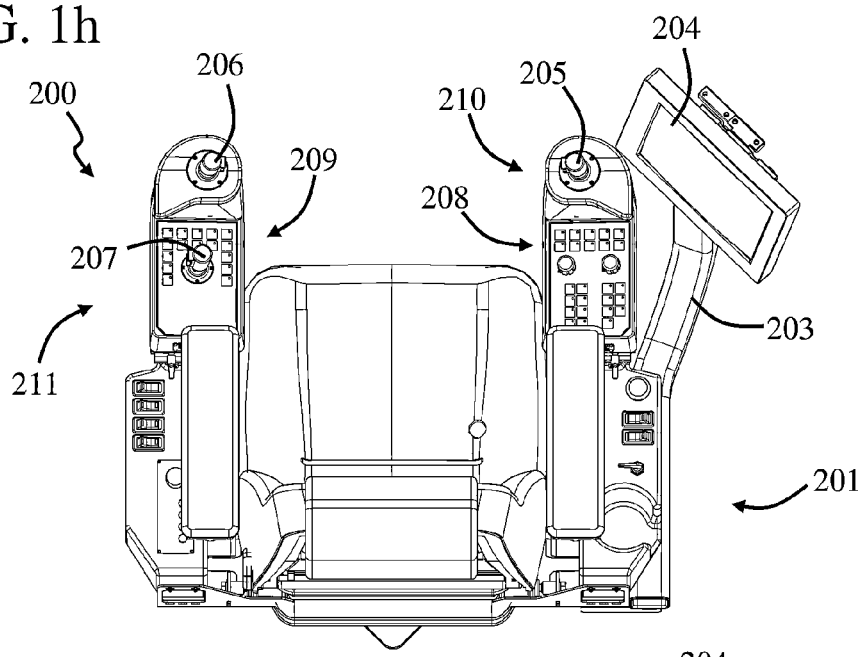
Figure 1I:
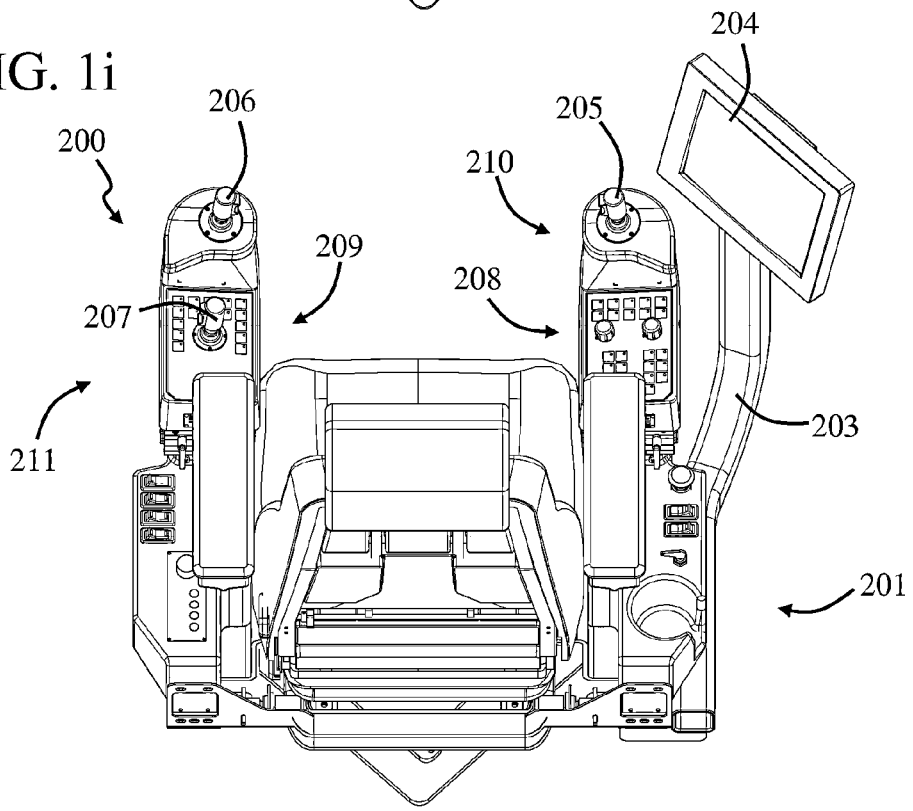

FIGS. 1*h* and 1*i* are top views of the chair assembly of FIG. 1*c*.

Figure 2A:
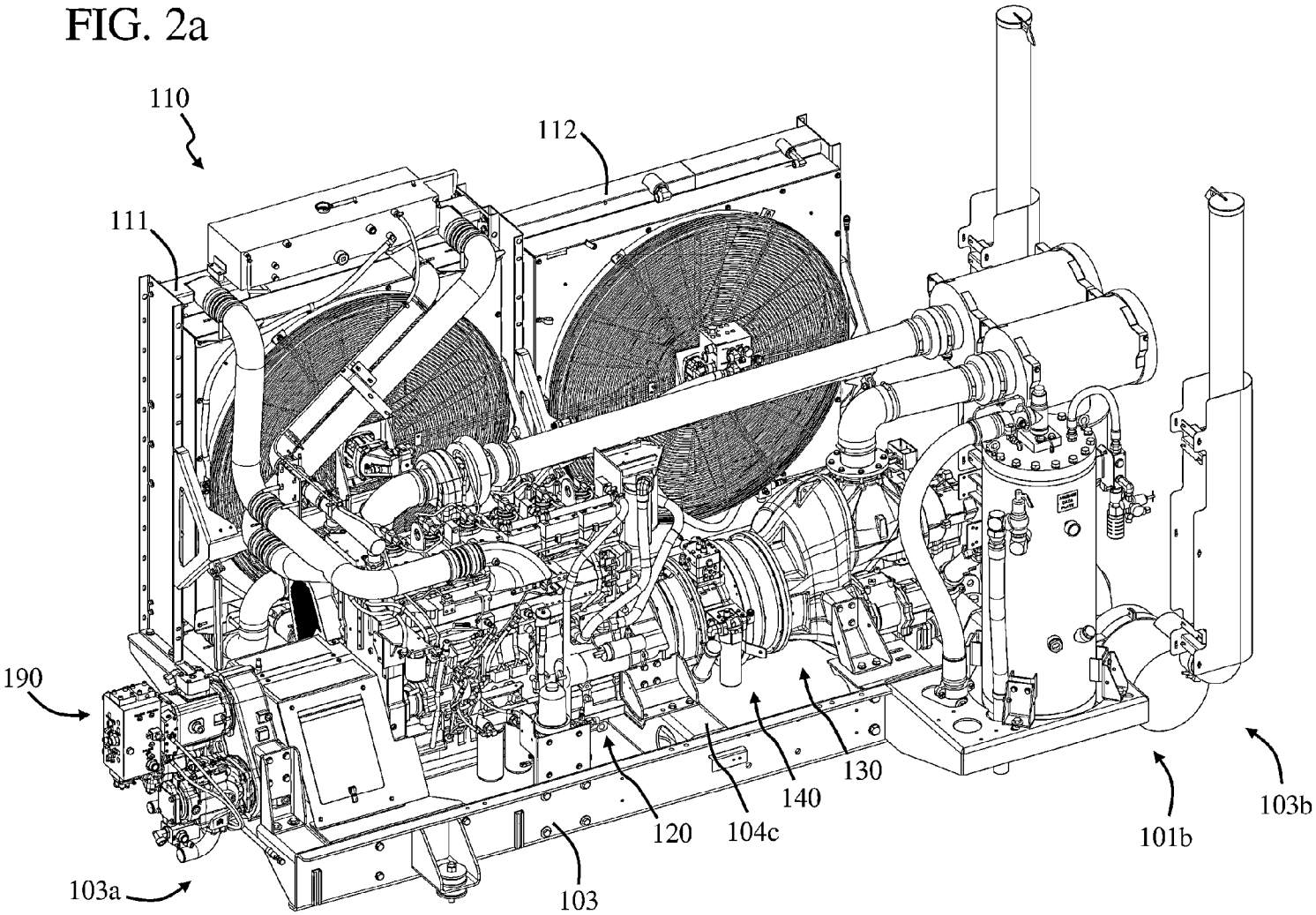

FIG. 2*a* is a perspective view of a power pack carried by a platform of the drilling machine of FIGS. 1*a* and 1*b*, wherein the power pack includes a compressor and hydraulic pump drive system operatively coupled to a prime mover through a clutch assembly and pump system shaft assembly, respectively.

Figure 2B:
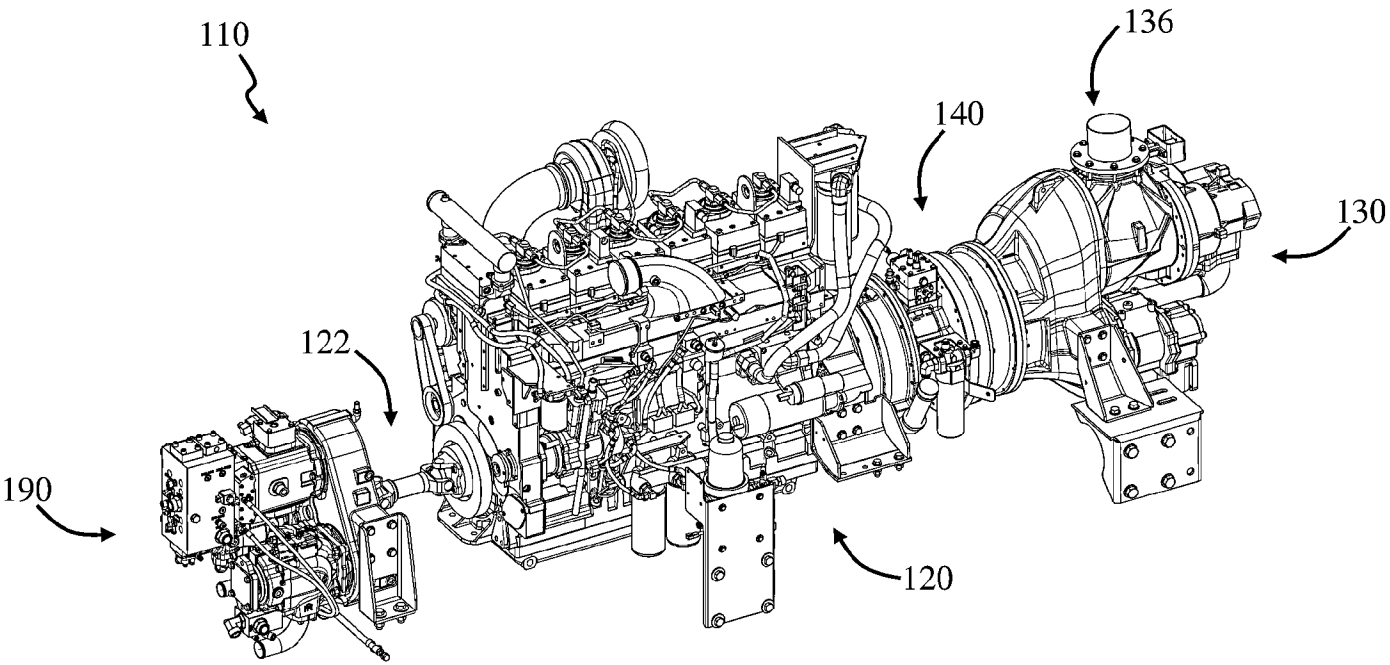

FIG. 2*b* is a perspective view of a portion of the power pack of FIG. 2*a*, wherein the compressor and pump system are operatively coupled to the prime mover through the clutch assembly and pump system shaft assembly, respectively.

Figure 3A:
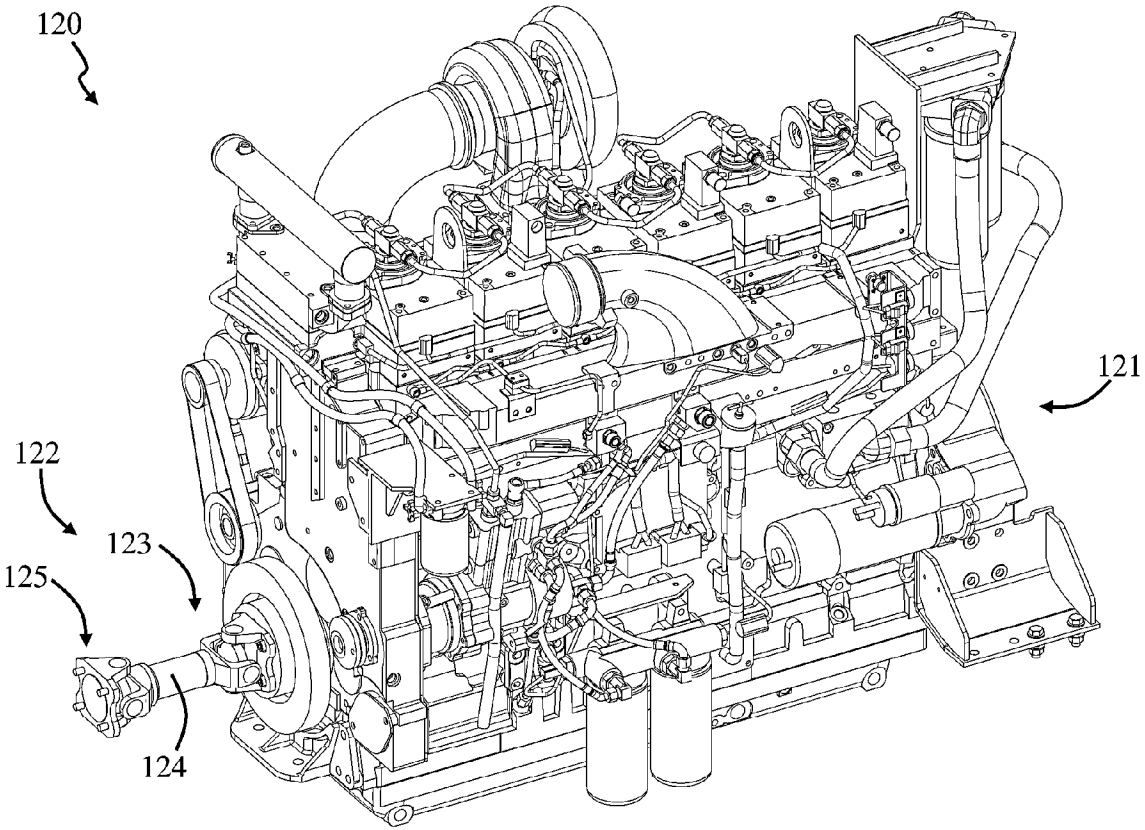

FIG. 3*a* is a perspective view of the prime mover of the power pack of FIG. 2*a*, wherein the pump system shaft assembly is coupled to the prime mover.

Figure 3B:
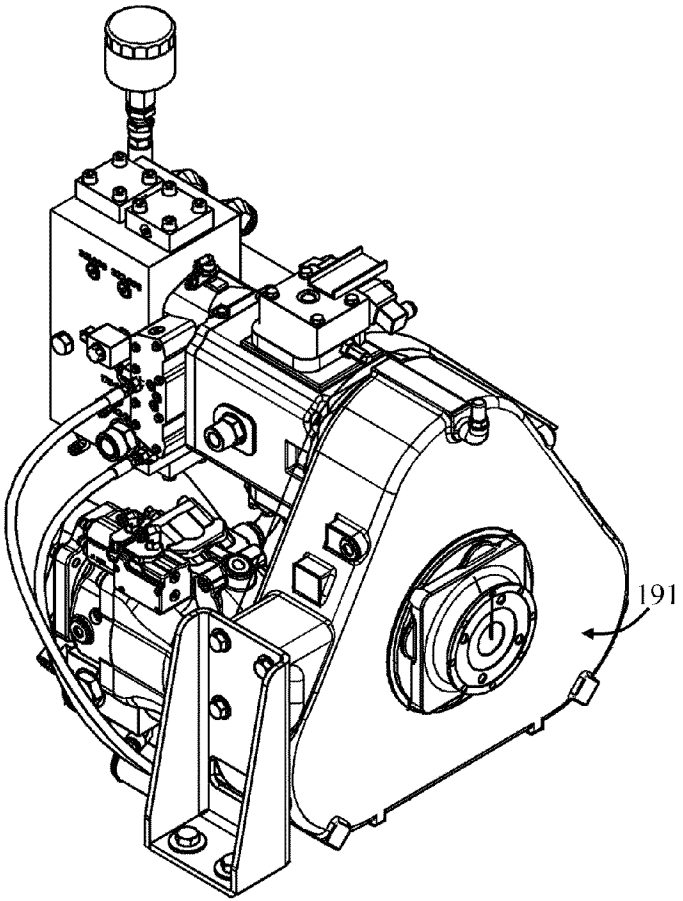
Figure 3C:
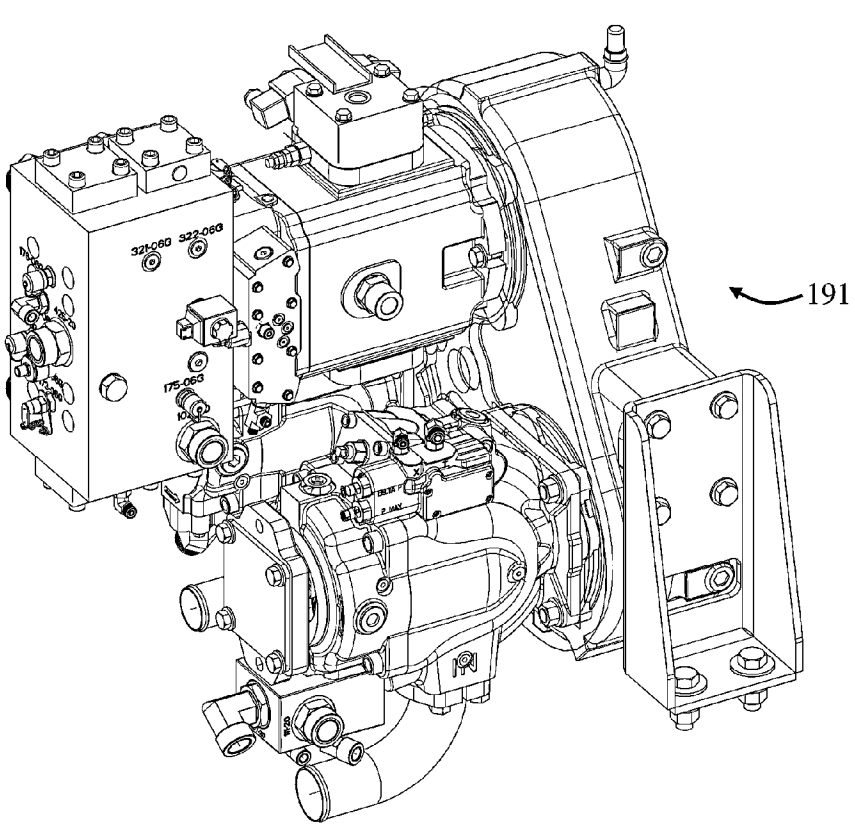

FIGS. 3*b* and 3*c* are front and back perspective views, respectively, of the pump system of the power pack of FIG. 2*a*.

Figure 4A:
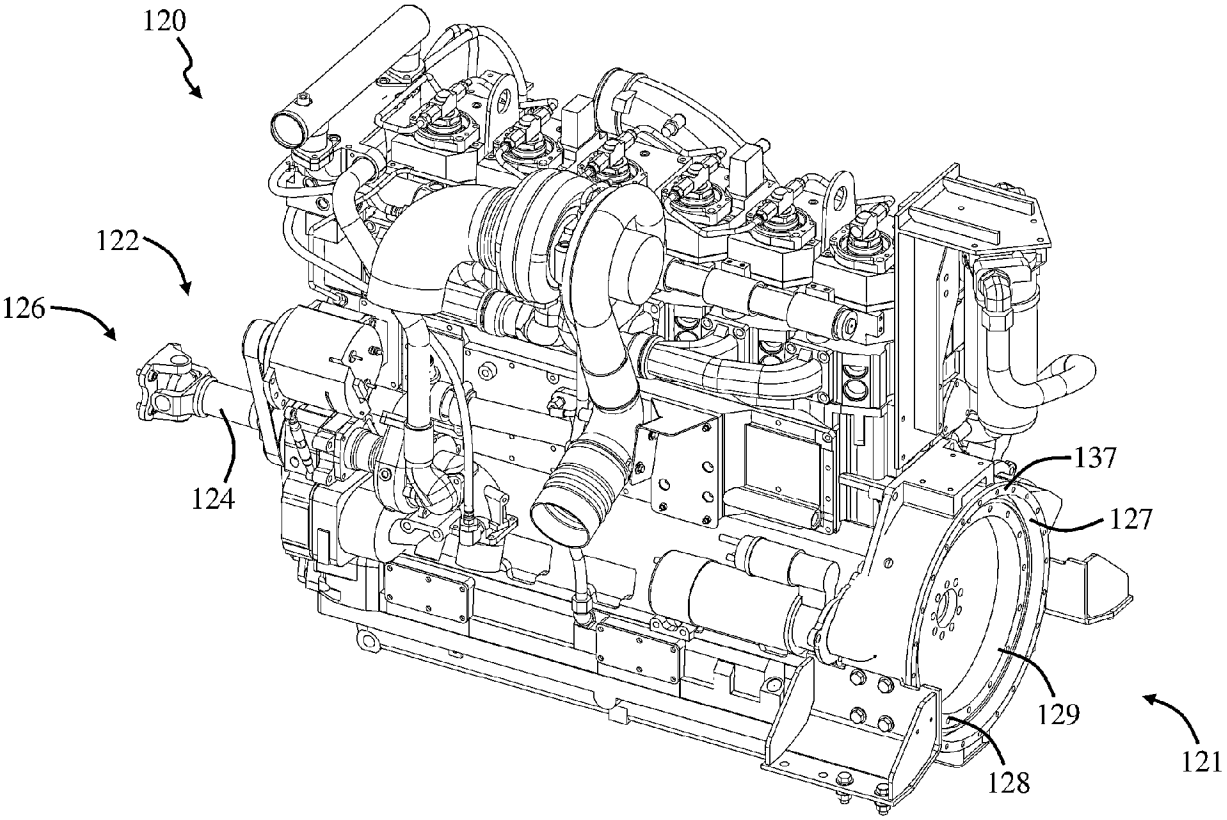

FIG. 4*a* is a perspective view of the prime mover of the power pack of FIG. 2*a*, wherein the prime mover includes a compressor coupler.

Figure 4B:
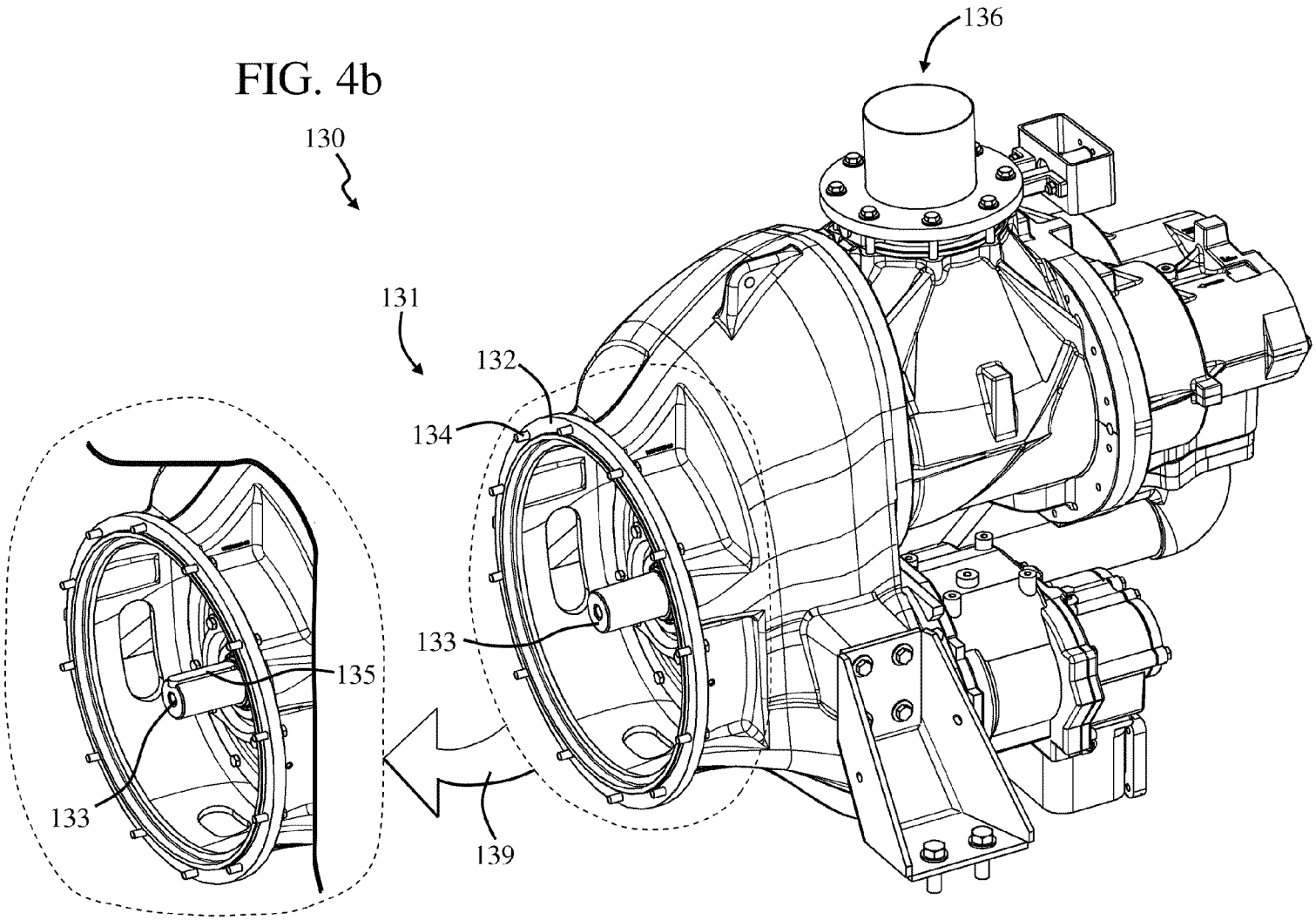
Figure 4C:
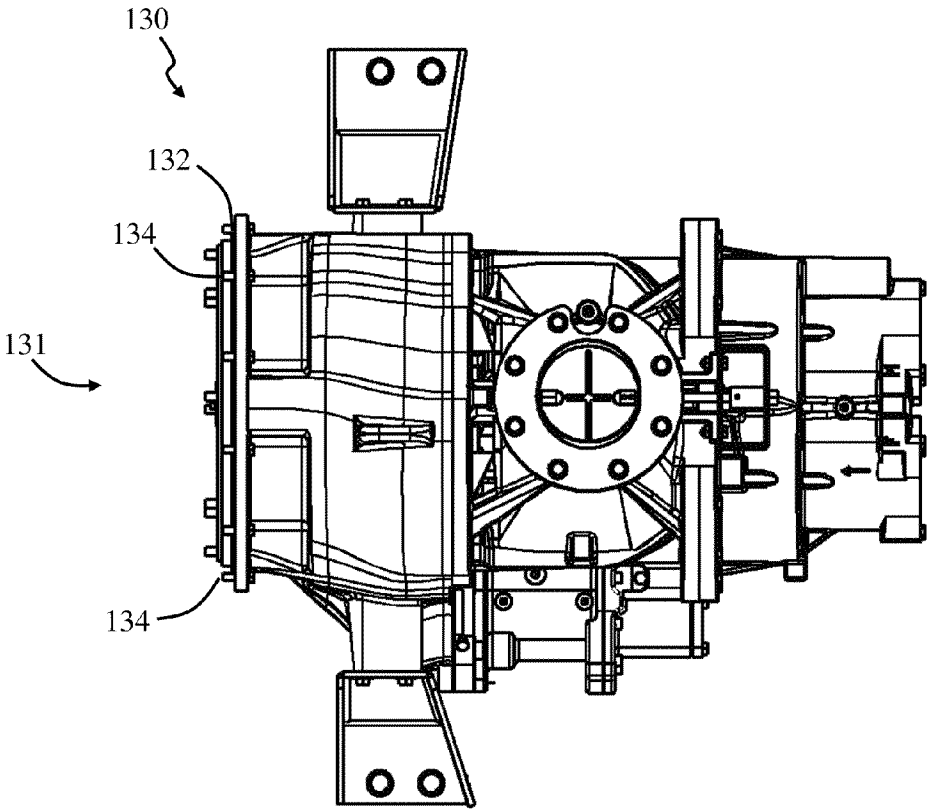

FIGS. 4*b* and 4*c* are front perspective and top views, respectively, of the compressor of the power pack of FIG. 2*a*.

Figure 5A:
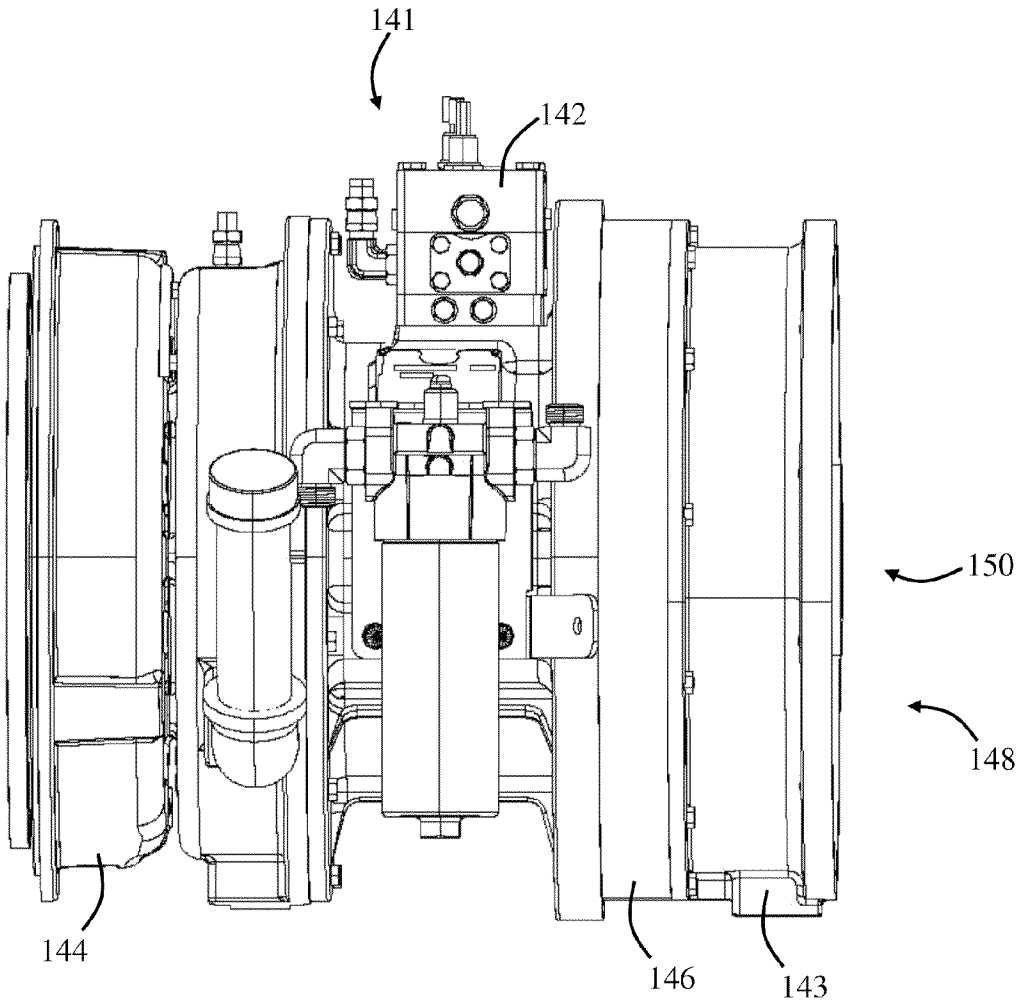

FIG. 5*a* is a side view of one embodiment of the clutch assembly of the power pack of FIG. 2*a*.

Figure 5B:
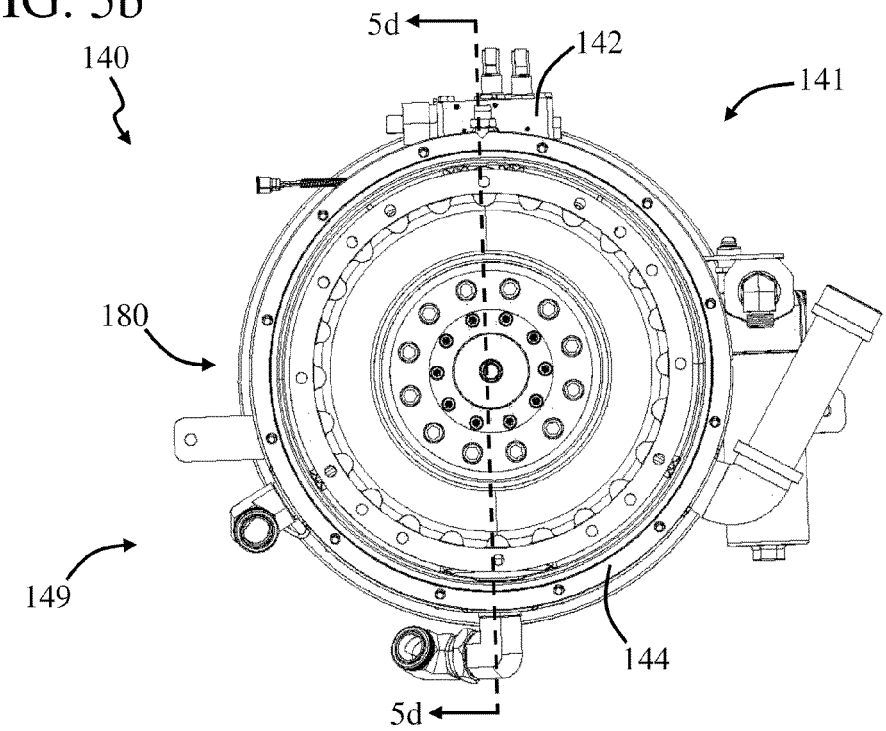

FIG. 5*b* is a prime mover end view of the clutch assembly of FIG. 5*a*.

Figure 5C:
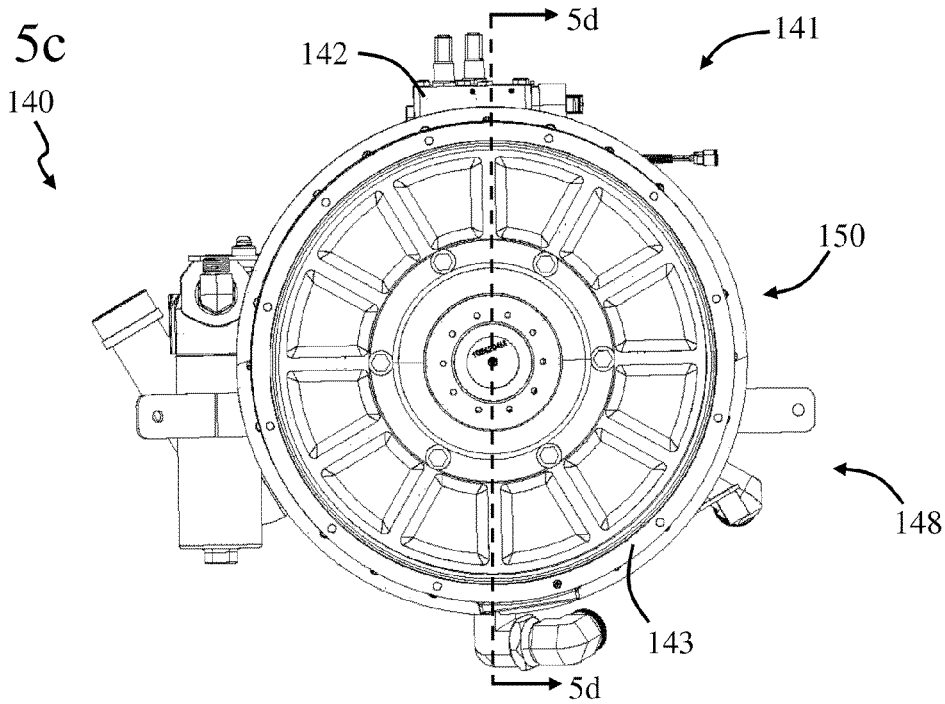

FIG. 5*c* is a compressor end view of the clutch assembly of FIG. 5*a*.

Figure 5D:
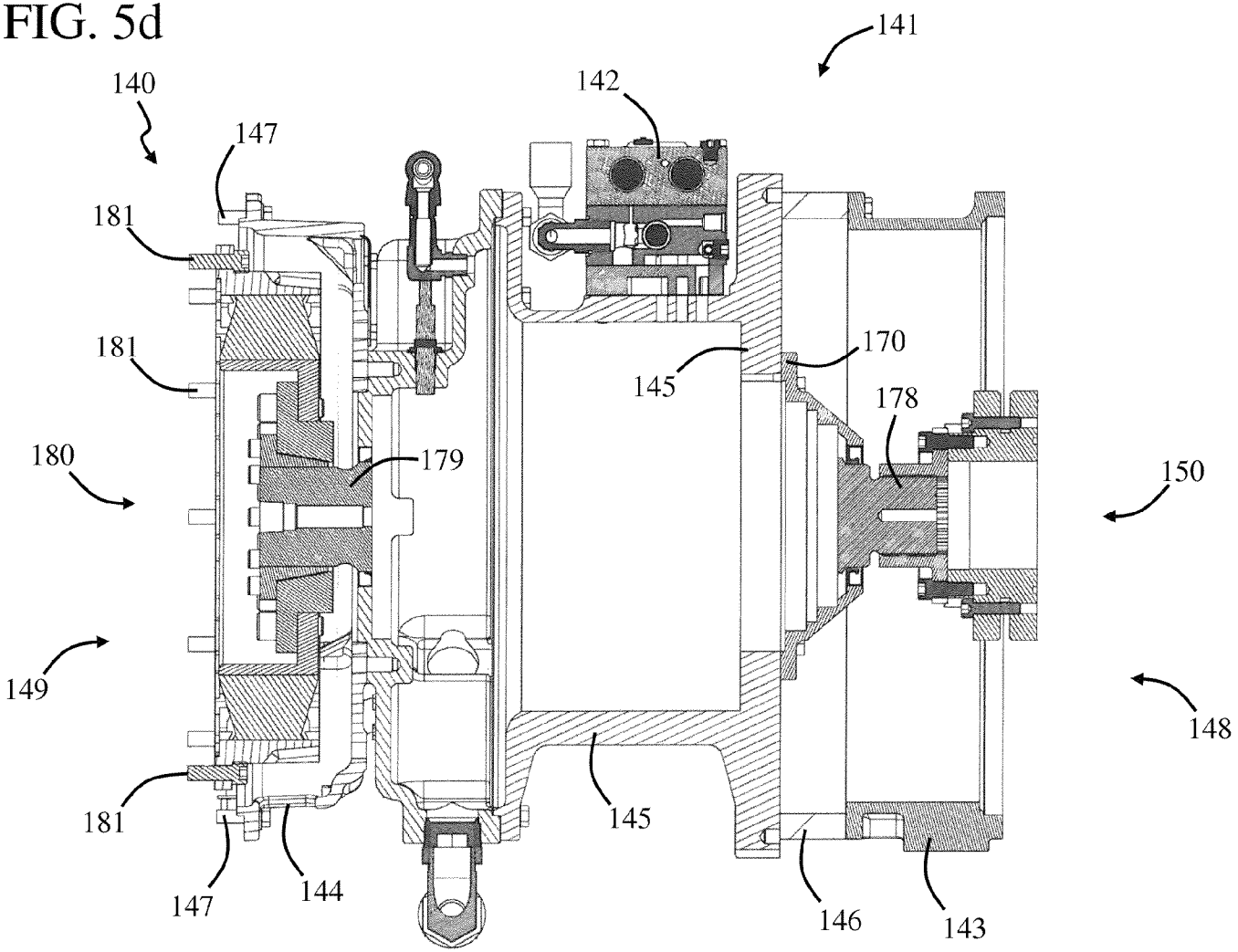

FIG. 5*d* is a cut-away side view of the clutch assembly of FIG. 5*a* taken along a cut-line 5*d*-5*d* of FIGS. 5*b* and 5*c*.

Figure 6A:
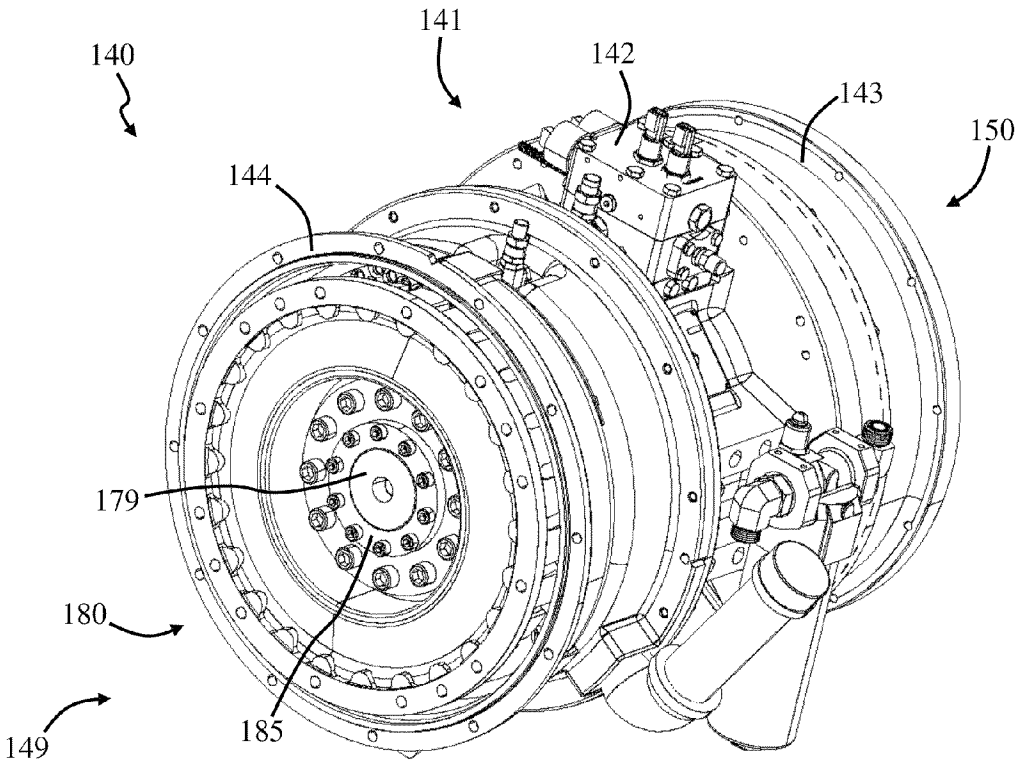

FIG. 6*a* is a perspective view of a prime mover end of the clutch assembly of FIG. 5*a*, wherein the clutch assembly includes a clutch-to-prime mover coupling coupled to a clutch.

Figure 6B:
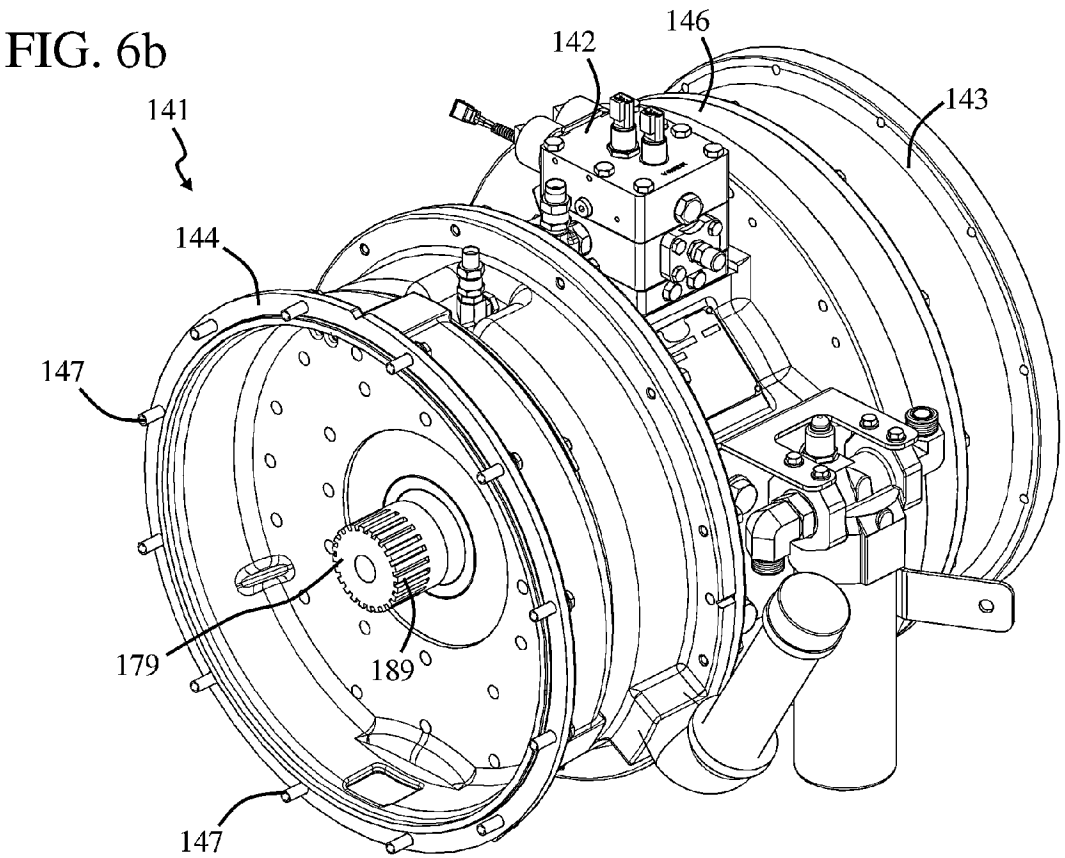

FIG. 6*b* is a perspective view of prime mover end of the clutch of FIG. 6*a*.

Figure 7A:
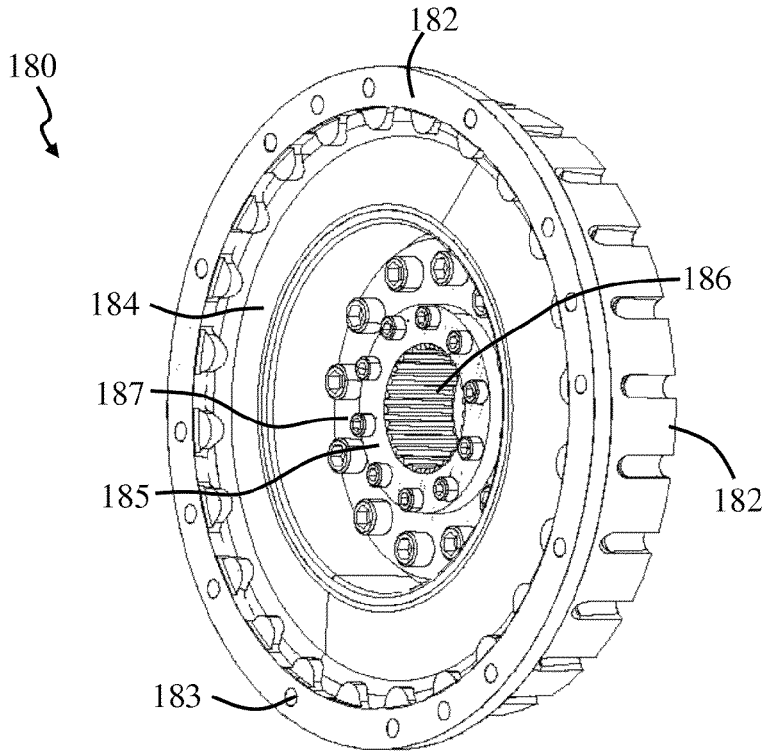
Figure 7B:
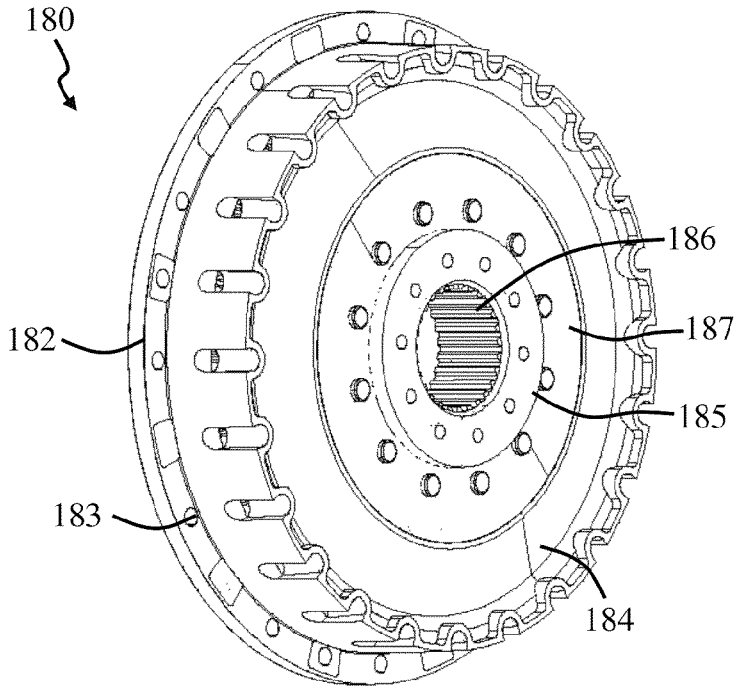

FIGS. 7*a* and 7*b* are perspective front and back views, respectively, of the clutch-to-prime mover coupling of FIG. 6*a*, which includes a resilient ring.

Figure 7C:
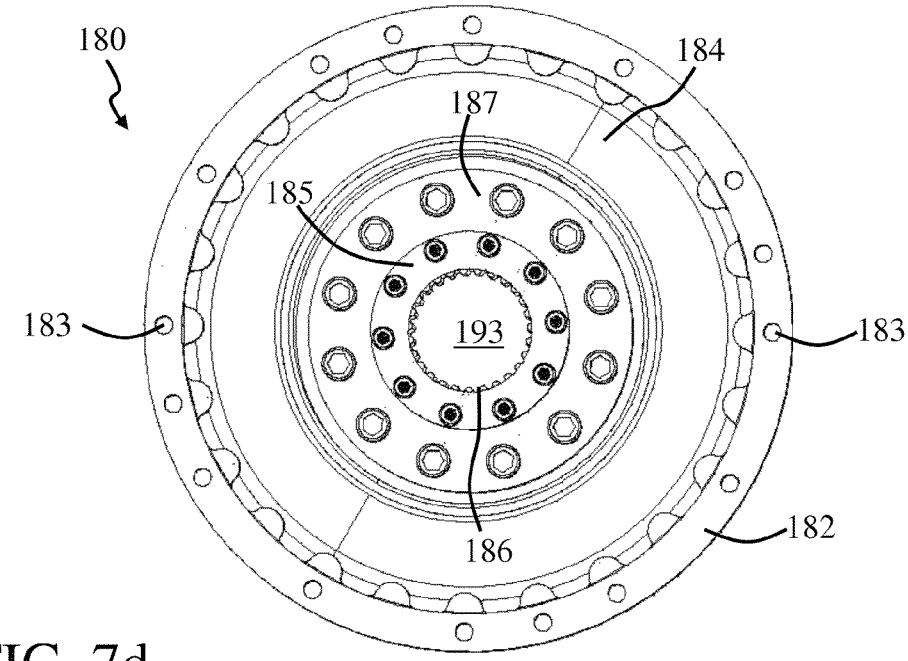
Figure 7D:
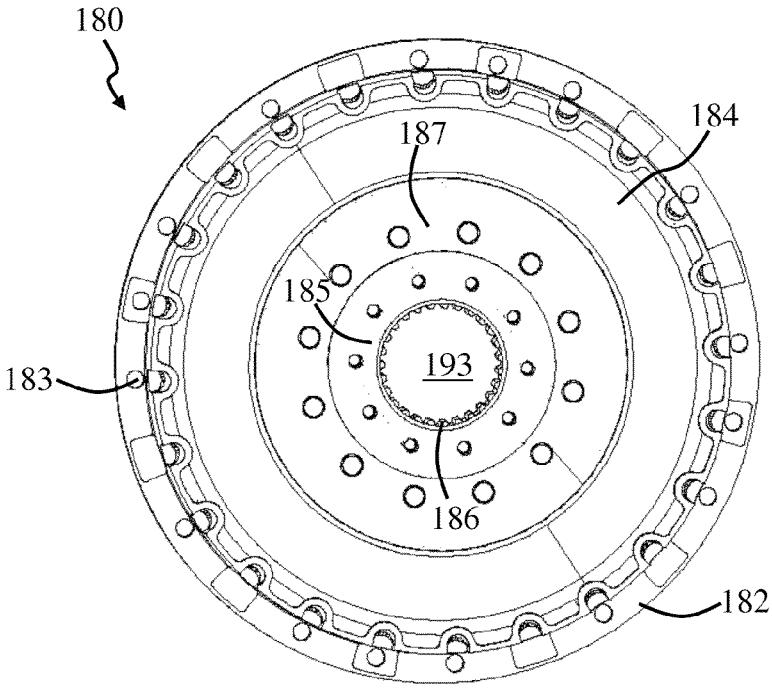

FIGS. 7*c* and 7*d* are front and back views, respectively, of the clutch-to-prime mover coupling of FIG. 6*a*.

Figure 7E:
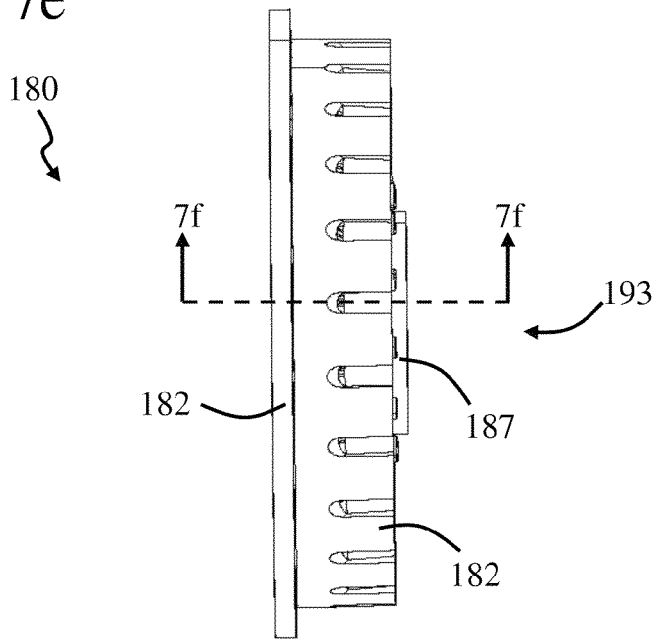

FIG. 7*e* is a side view of the clutch-to-prime mover coupling of FIG. 6*a*.

Figure 7F:
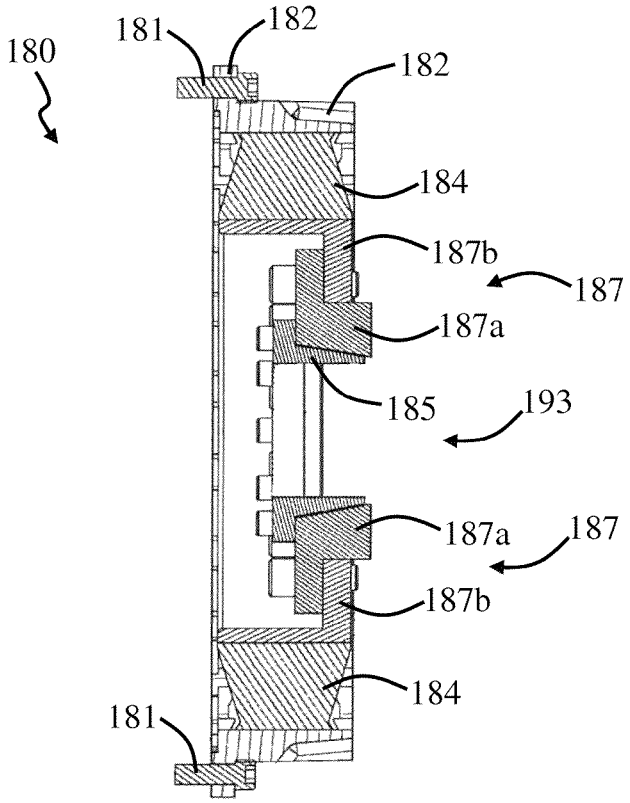

FIG. 7*f* is a cut-away side view of the clutch-to-prime mover coupling of FIG. 6*a* taken along a cut-line 7*f*-7*f* of FIG. 7*e*.

Figure 7G:
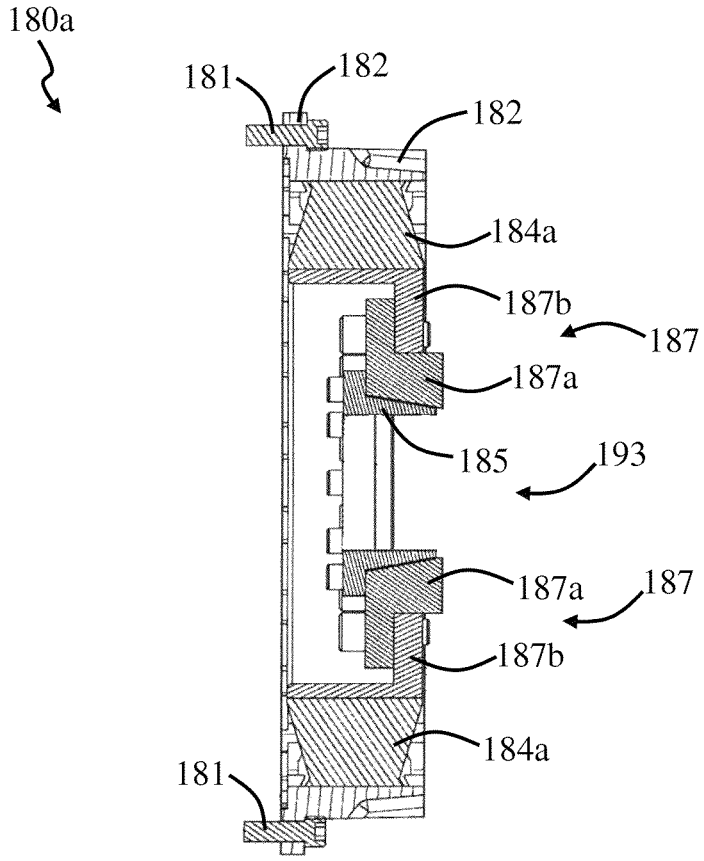

FIG. 7*g* is a cut-away side view of a clutch-to-prime mover coupling, wherein the clutch-to-prime mover coupling does not include a resilient ring.

Figure 8A:
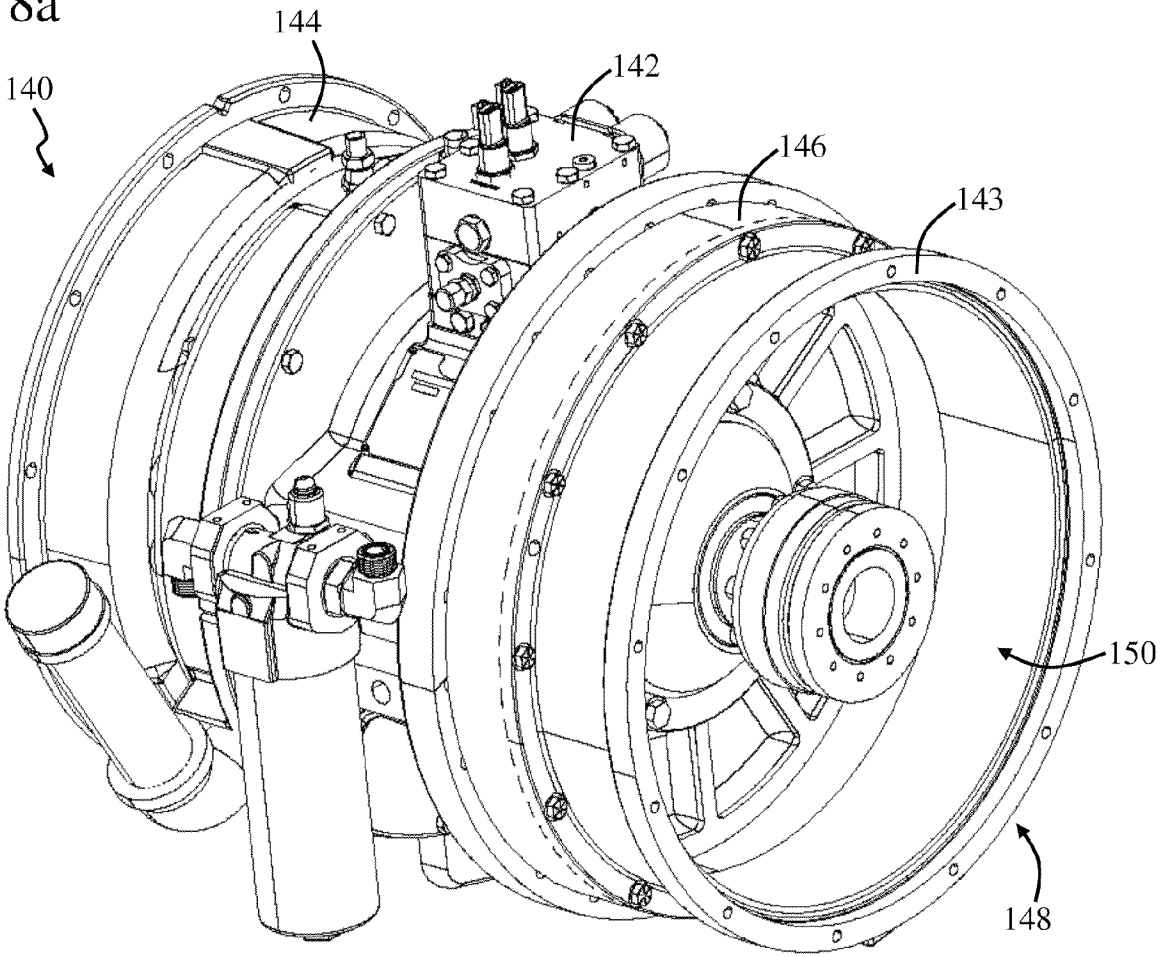

FIG. 8*a* is a perspective view of a compressor end of the clutch assembly of FIG. 5*a*, wherein the clutch assembly includes a clutch-to-compressor coupling coupled to the clutch.

Figure 8B:
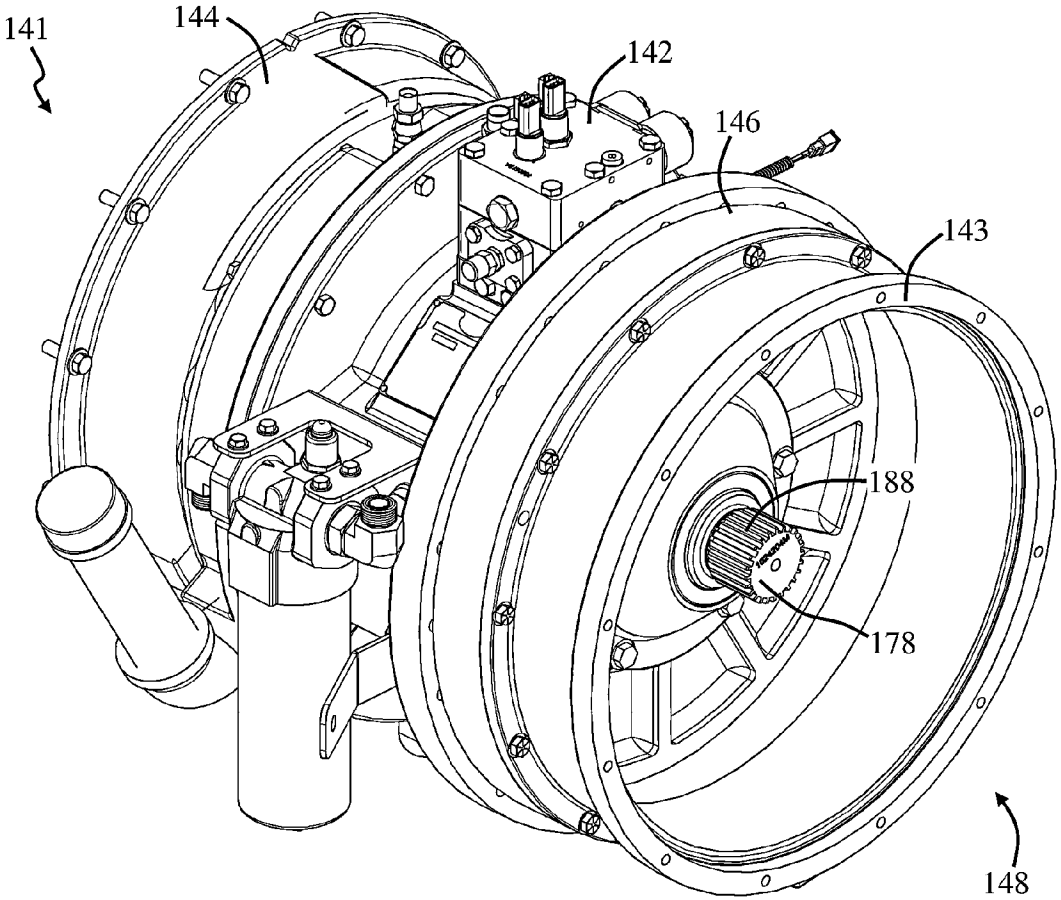

FIG. 8*b* is a perspective view of the compressor end of the clutch of FIG. 8*a*.

Figure 9A:
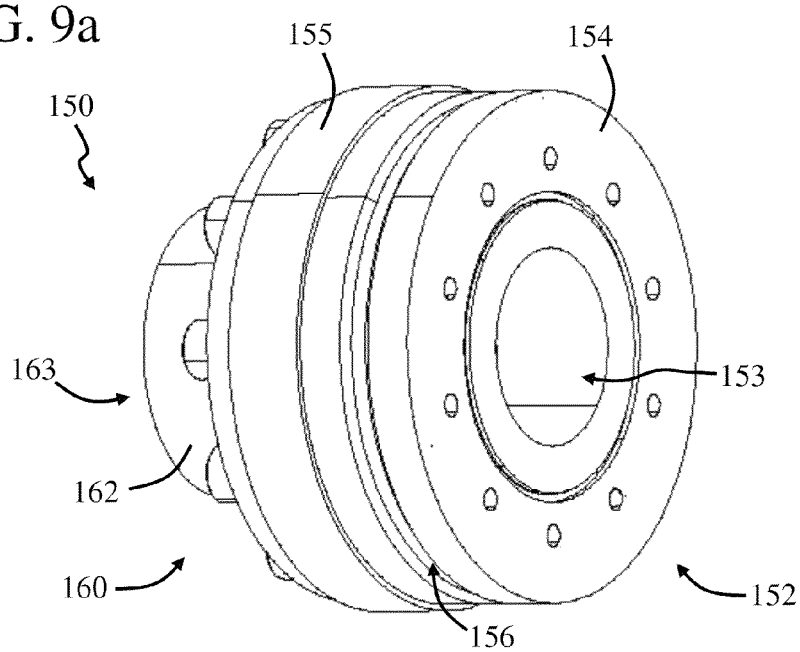
Figure 9B:
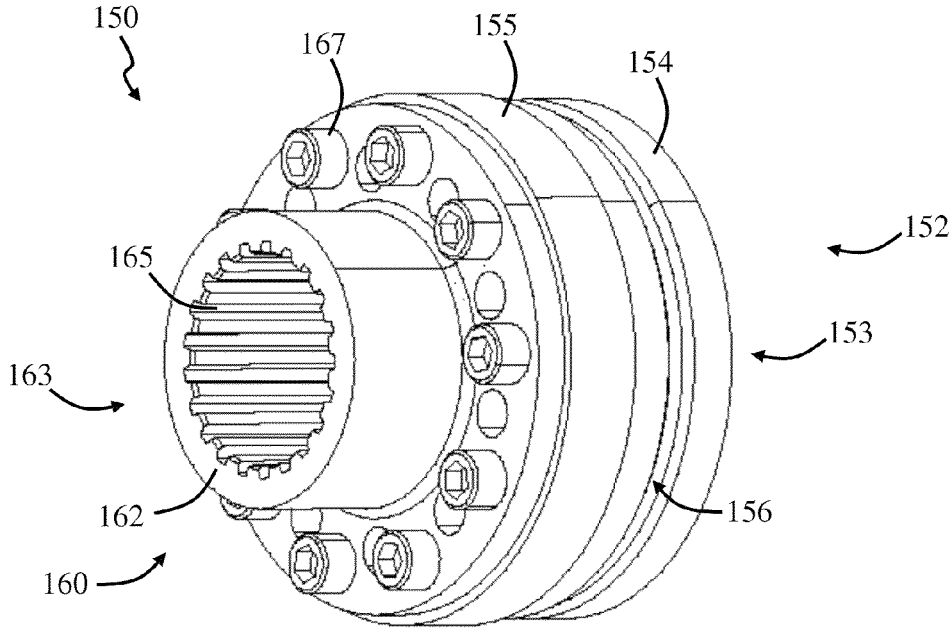

FIGS. 9*a* and 9*b* are perspective front and back views, respectively, of the clutch-to-compressor coupling of FIG. 8*a*.

Figure 9C:
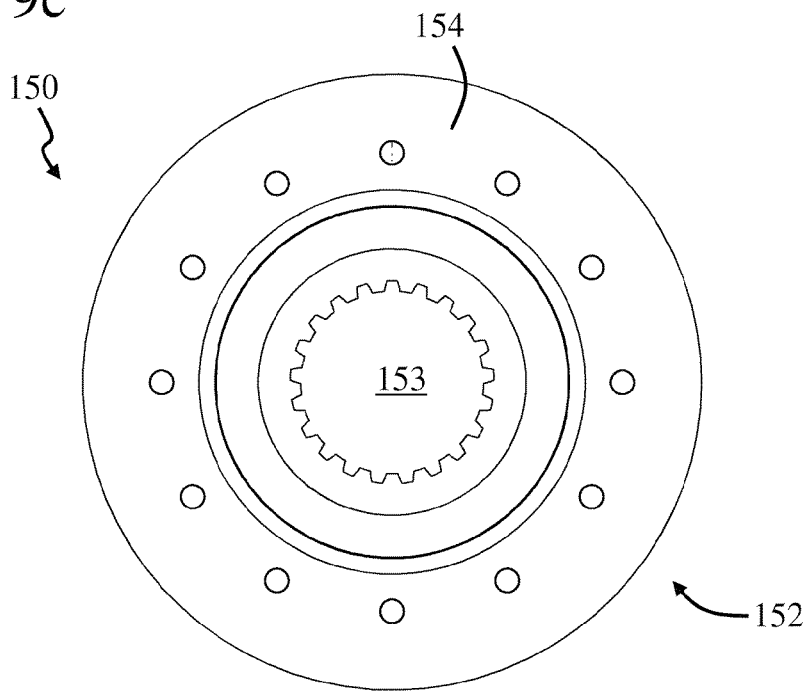
Figure 9D:
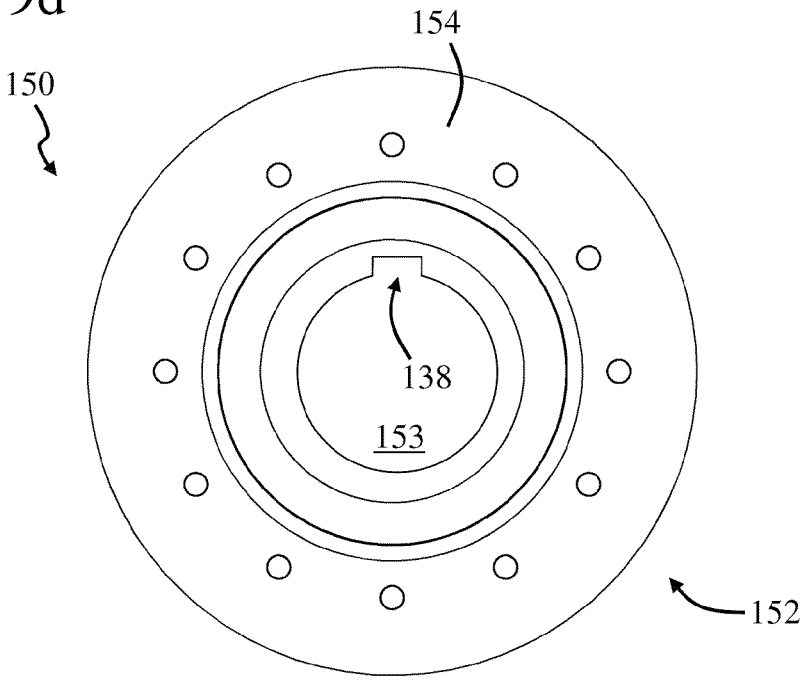

FIGS. 9*c* and 9*d* are front views of different embodiments of the clutch-to-compressor coupling of FIG. 8*a*.

Figure 9E:
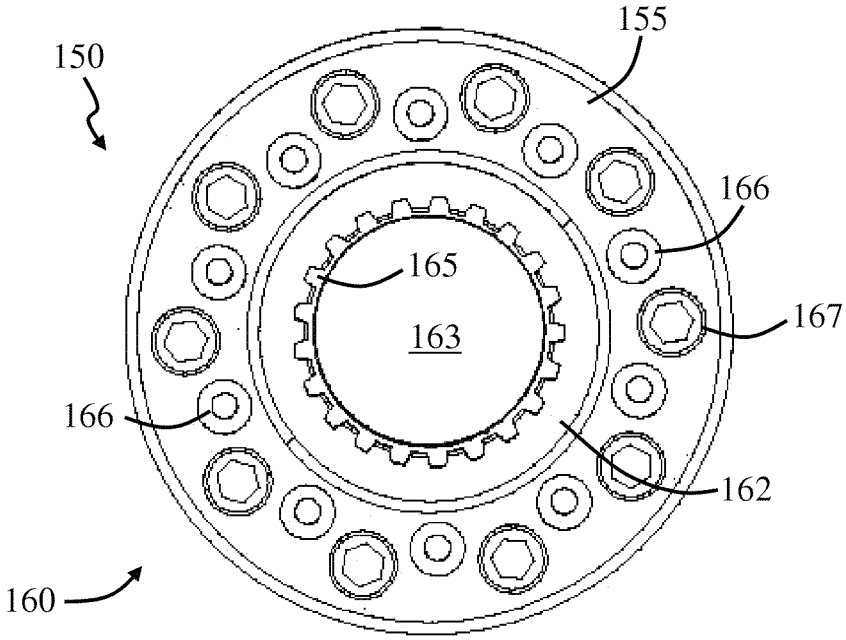

FIG. 9*e* is a back view of the clutch-to-compressor coupling of FIG. 8*a*.

Figure 9F:
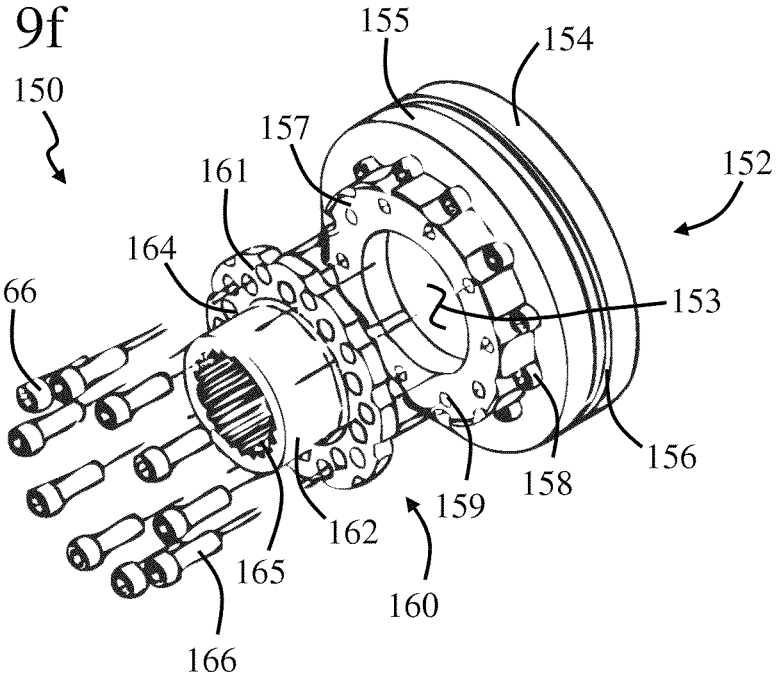

FIG. 9*f* is an exploded perspective view of the clutch-to-compressor coupling of FIG. 8*a*.

Figure 9G:
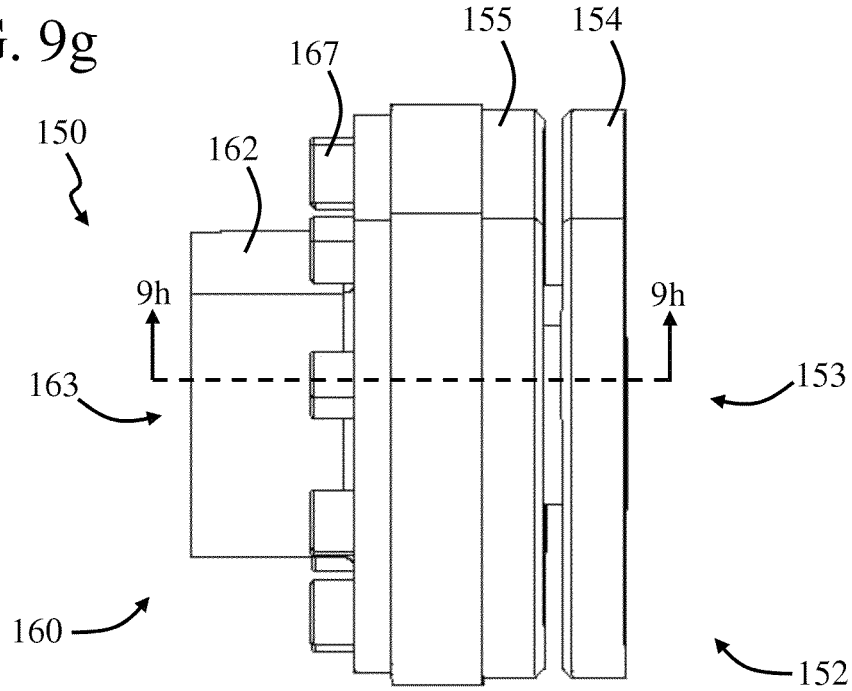

FIG. 9*g* is a side view of the clutch-to-compressor coupling of FIG. 8*a*.

Figure 9H:
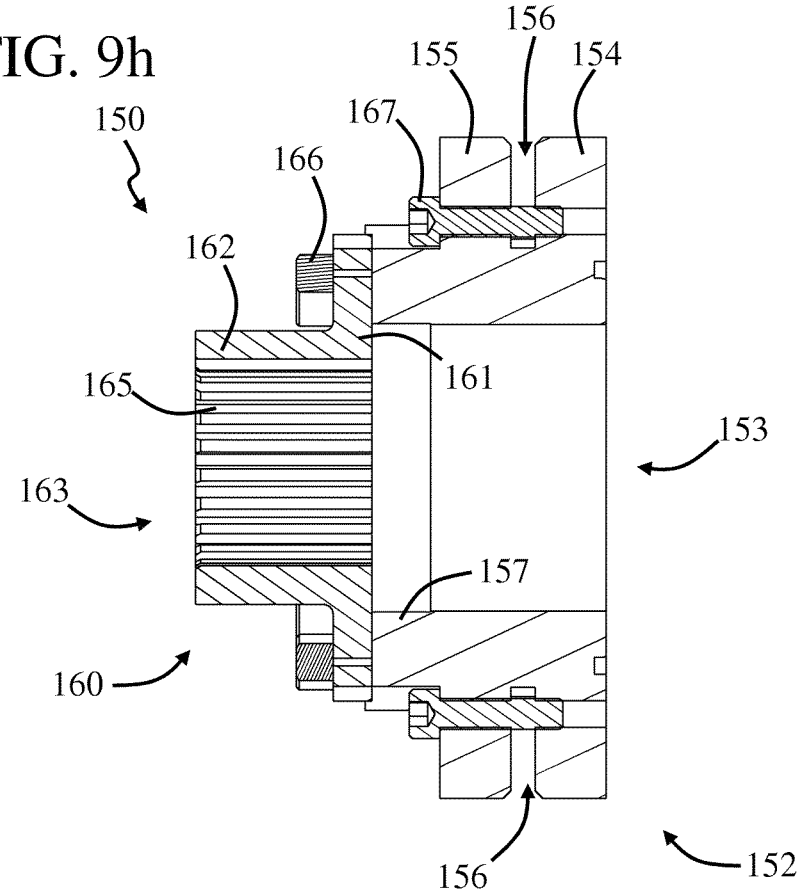

FIG. 9*h* is a cut-away side view of the clutch-to-compressor coupling of FIG. 8*a* taken along a cut-line 9*h*-9*h* of FIG. 9*g*.

Figure 9I:
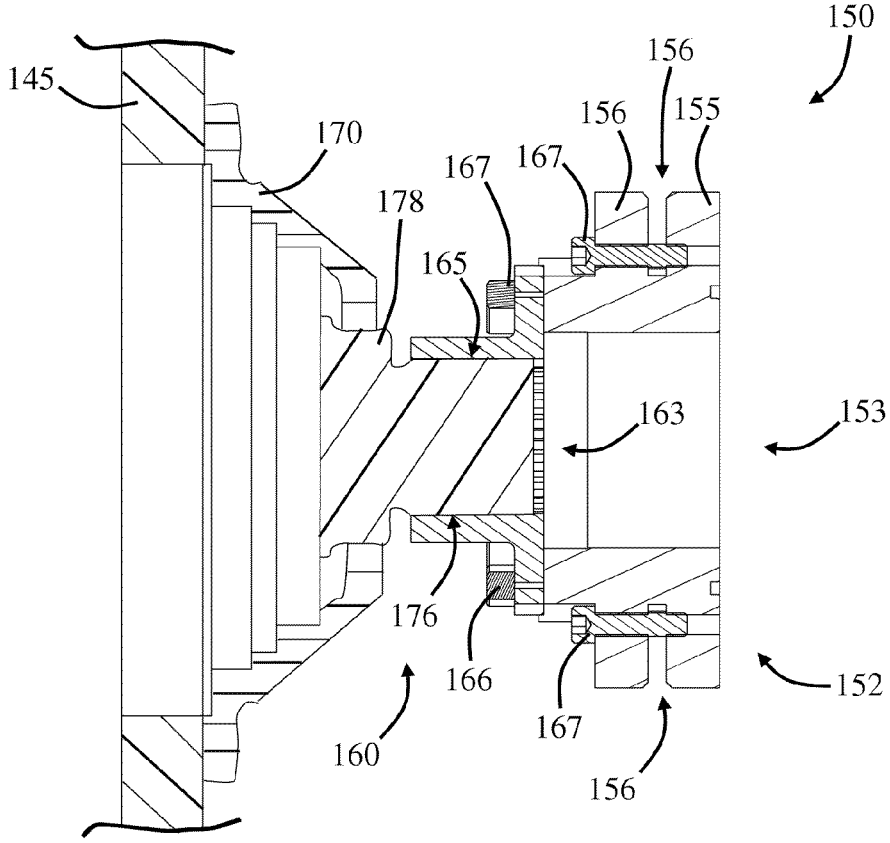
Figure 9J:
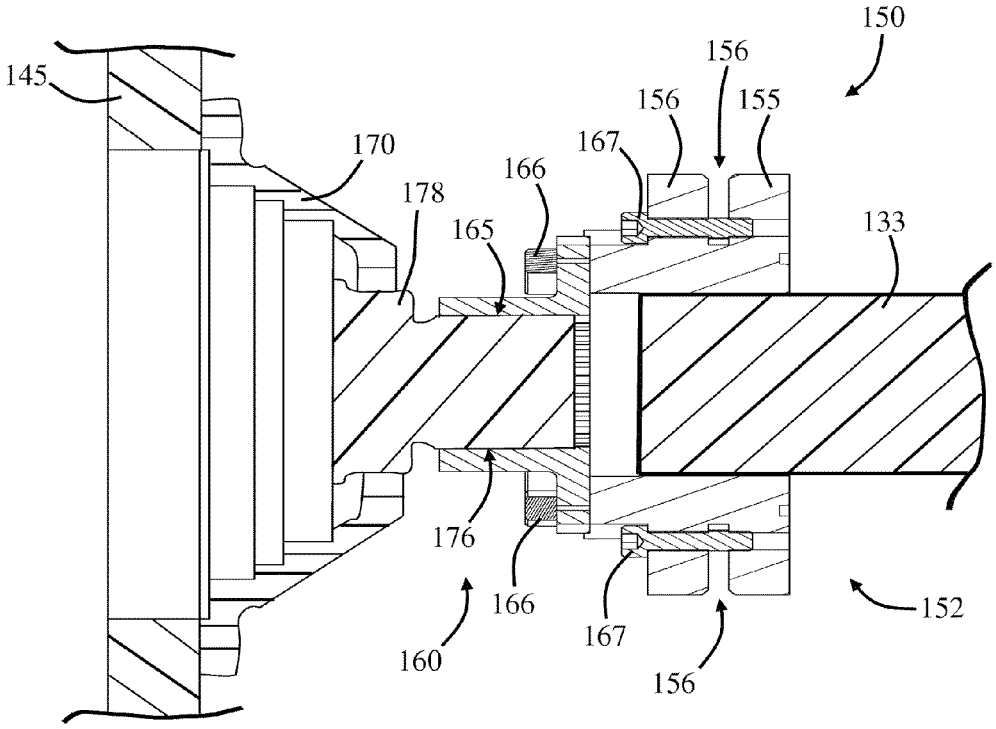

FIGS. 9*i* and 9*j* are cut-away side views of the clutch-to-compressor coupling of FIG. 8*a*, which correspond to the cut-away view of FIG. 9*h*.

Figure 10A:
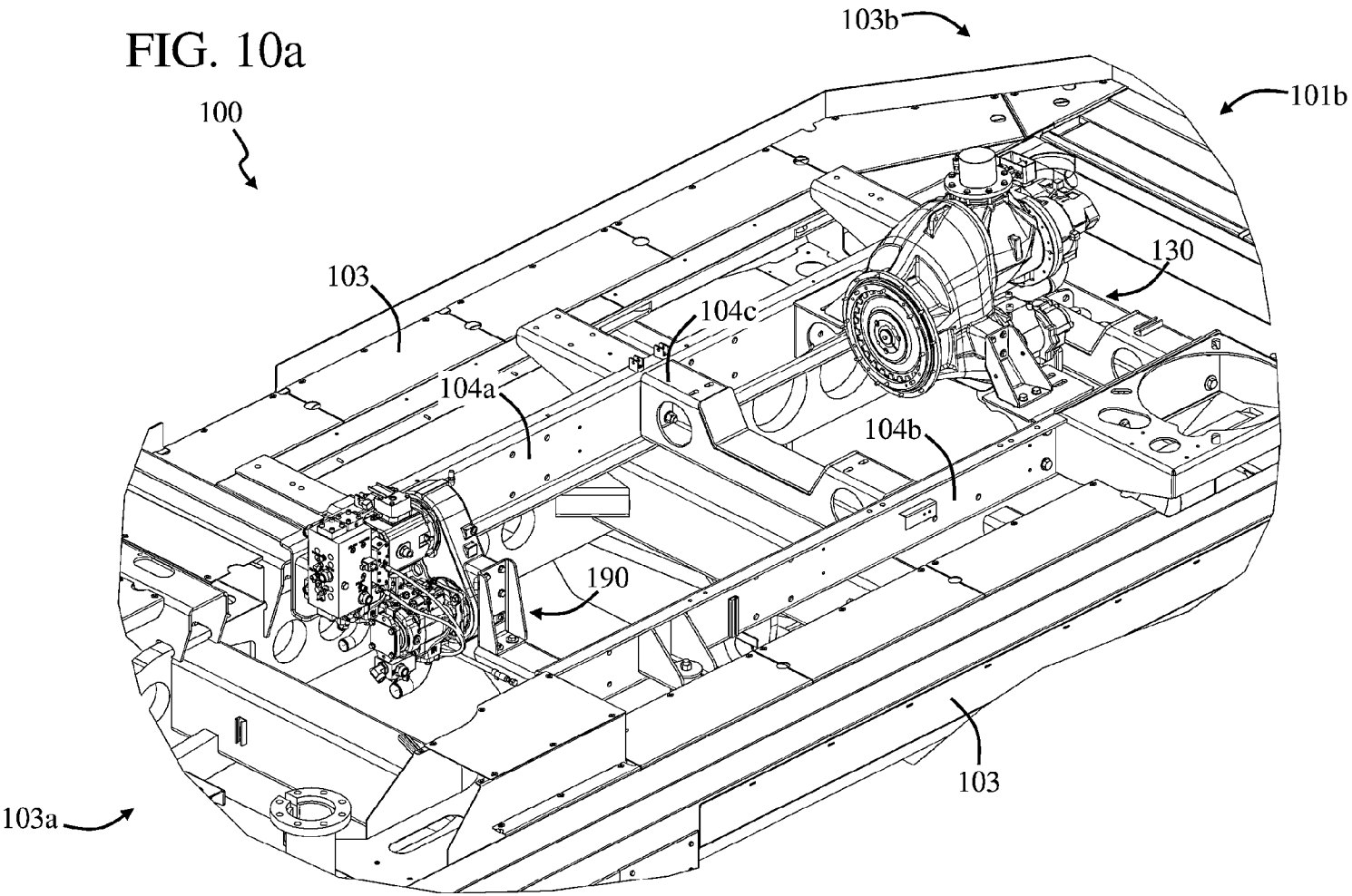
Figure 10B:
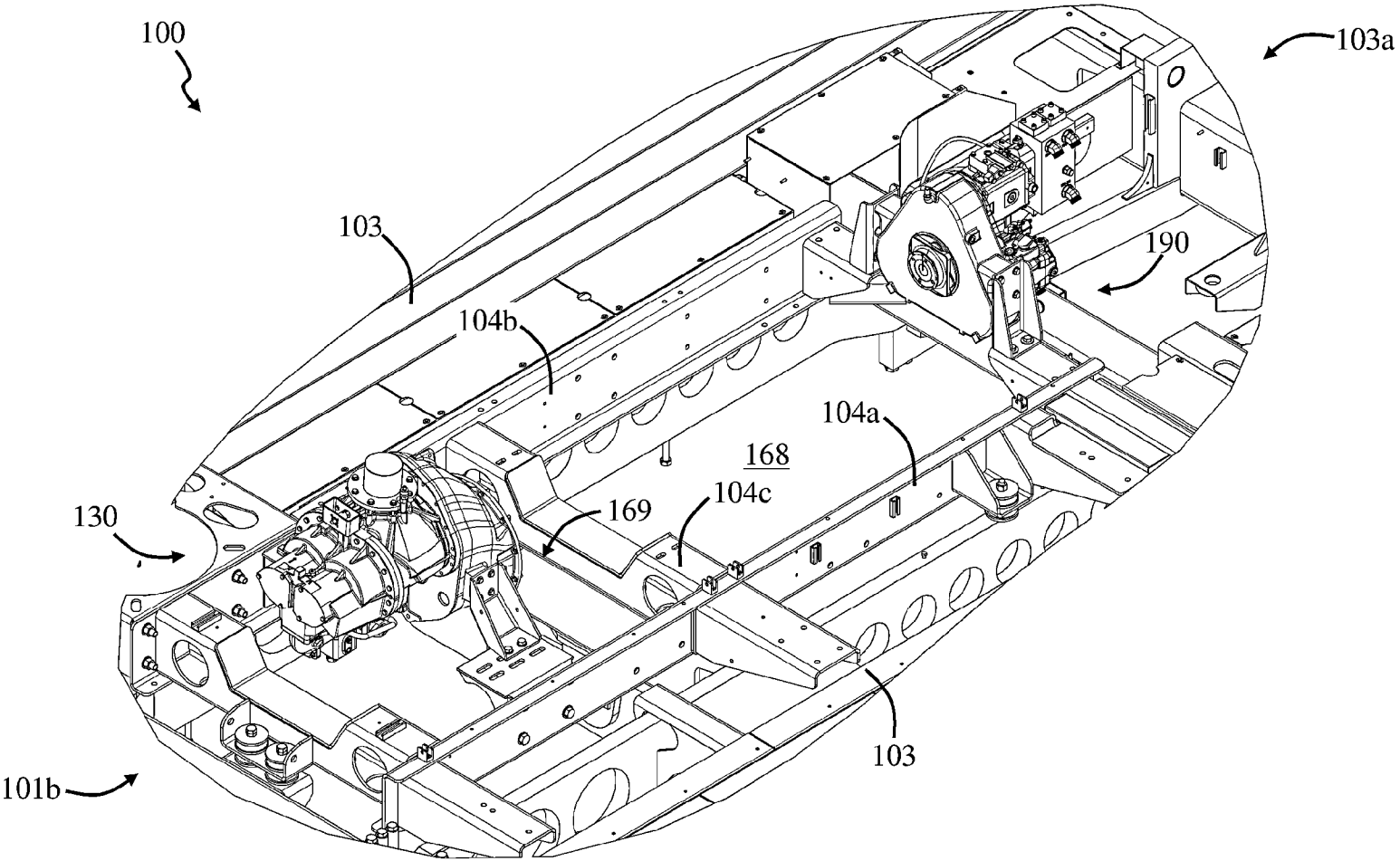

FIGS. 10*a* and 10*b* are perspective views of the platform of FIGS. 1*a* and 1*b* carrying the pump system and compressor of the power pack of FIG. 2*a*.

Figure 10C:
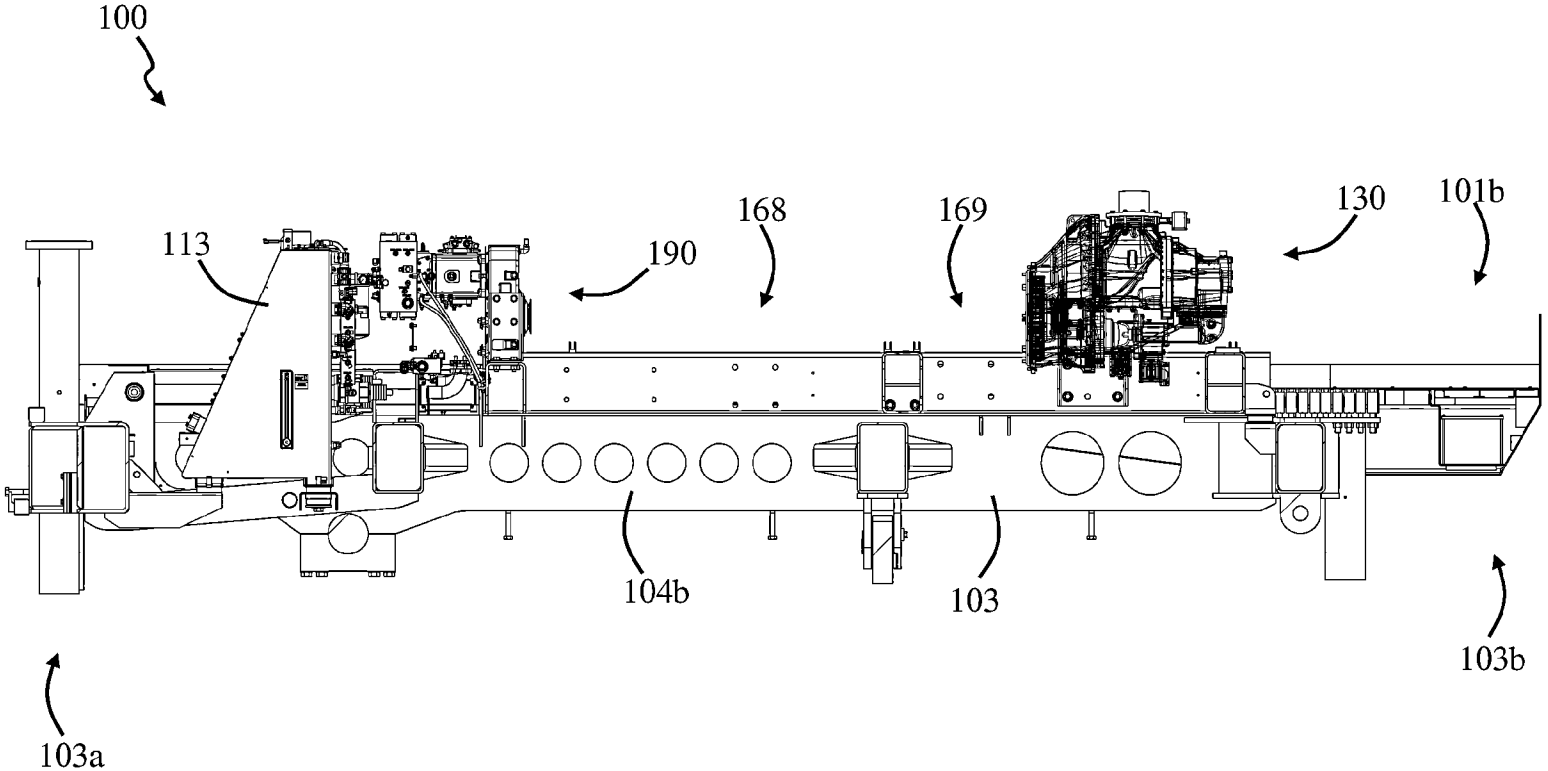
Figure 10D:
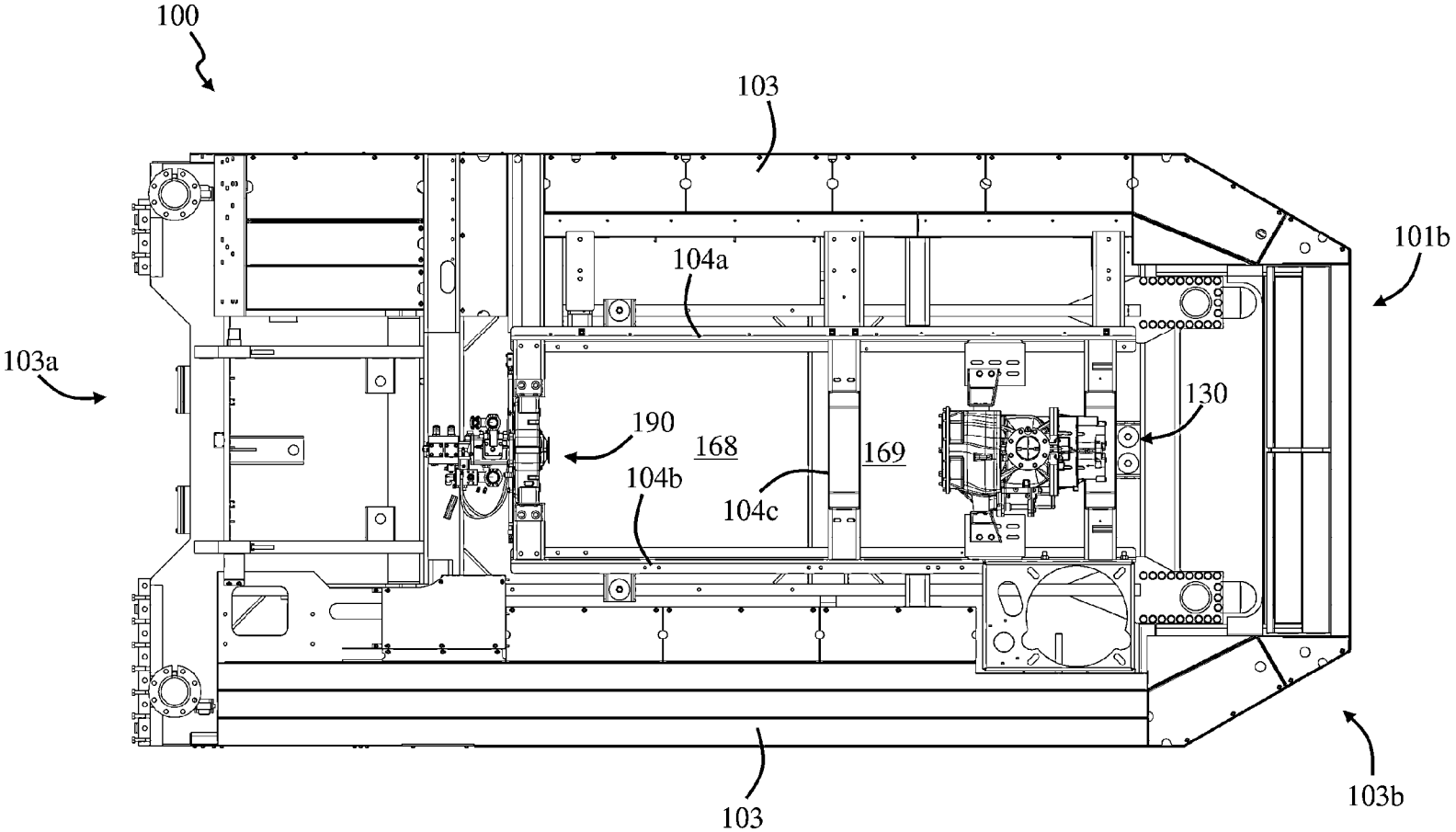

FIGS. 10*c* and 10*d* are side and top views, respectively, of the platform of FIGS. 1*a* and 1*b* carrying the pump system and compressor of the power pack of FIG. 2*a*.

Figure 11A:
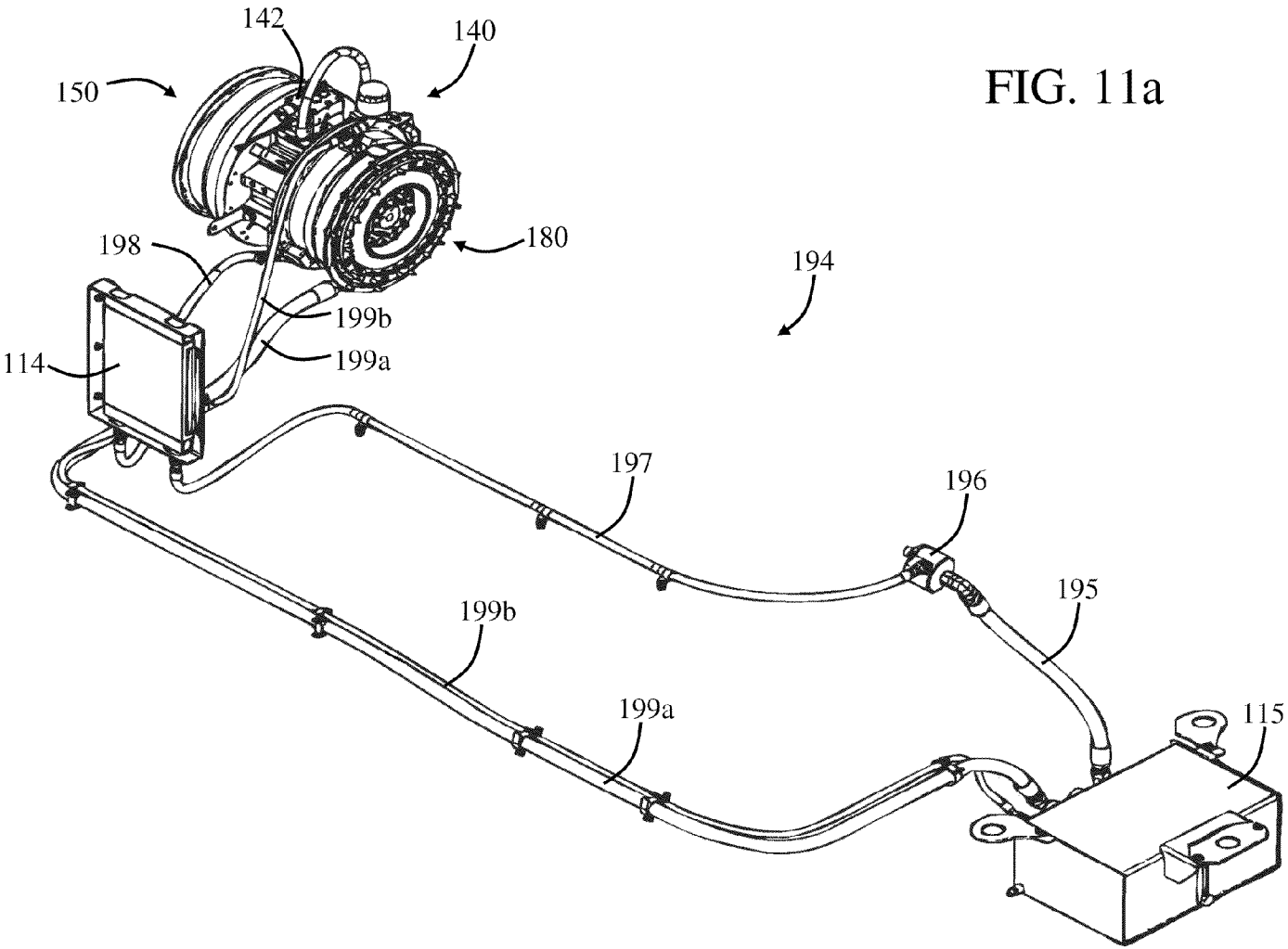
Figure 11B:
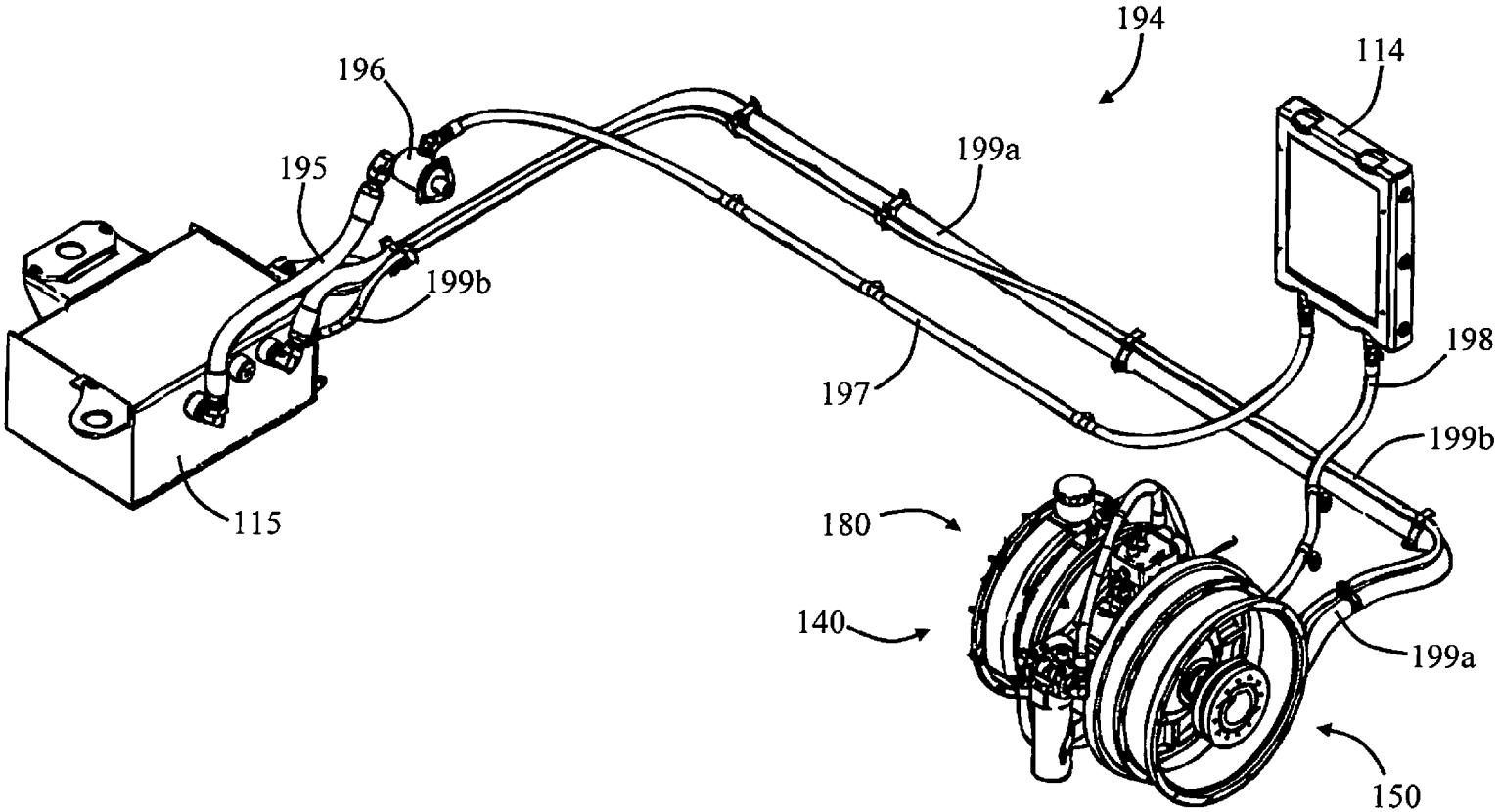

FIGS. 11*a* and 11*b* are perspective views of the clutch assembly of the power pack of FIG. 2*a* in fluid communication with a clutch assembly heat exchange system.

Figure 12A:
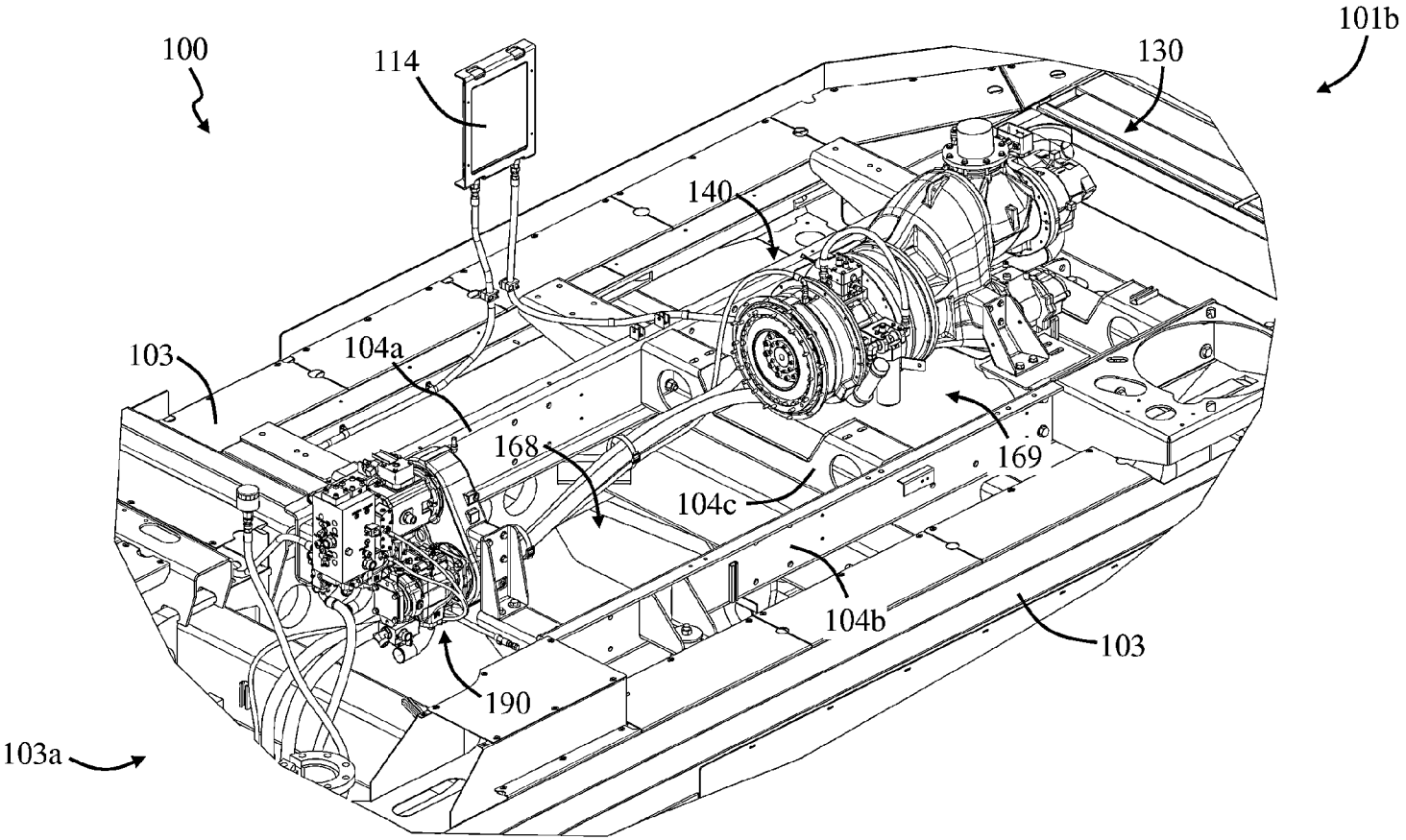
Figure 12B:
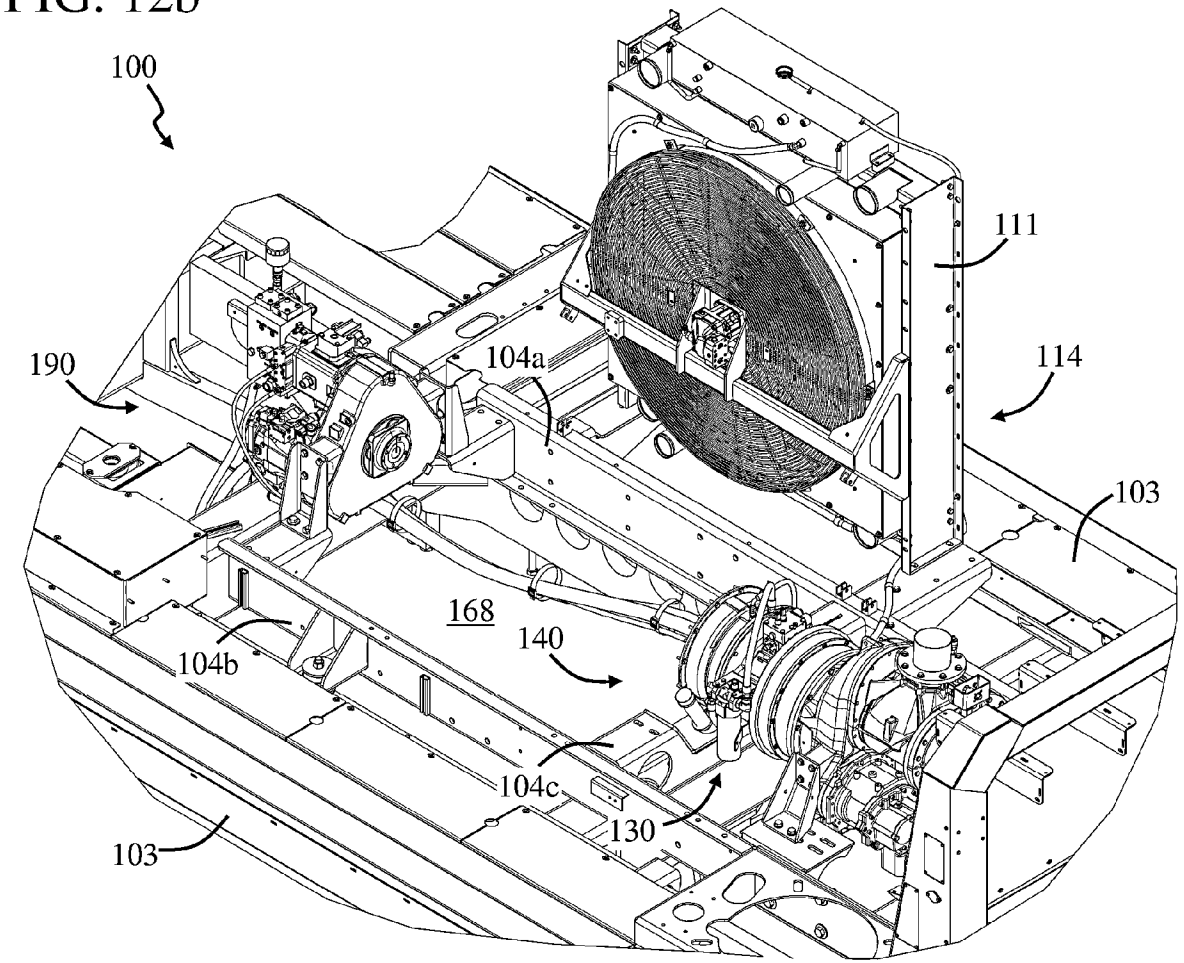
Figure 12C:
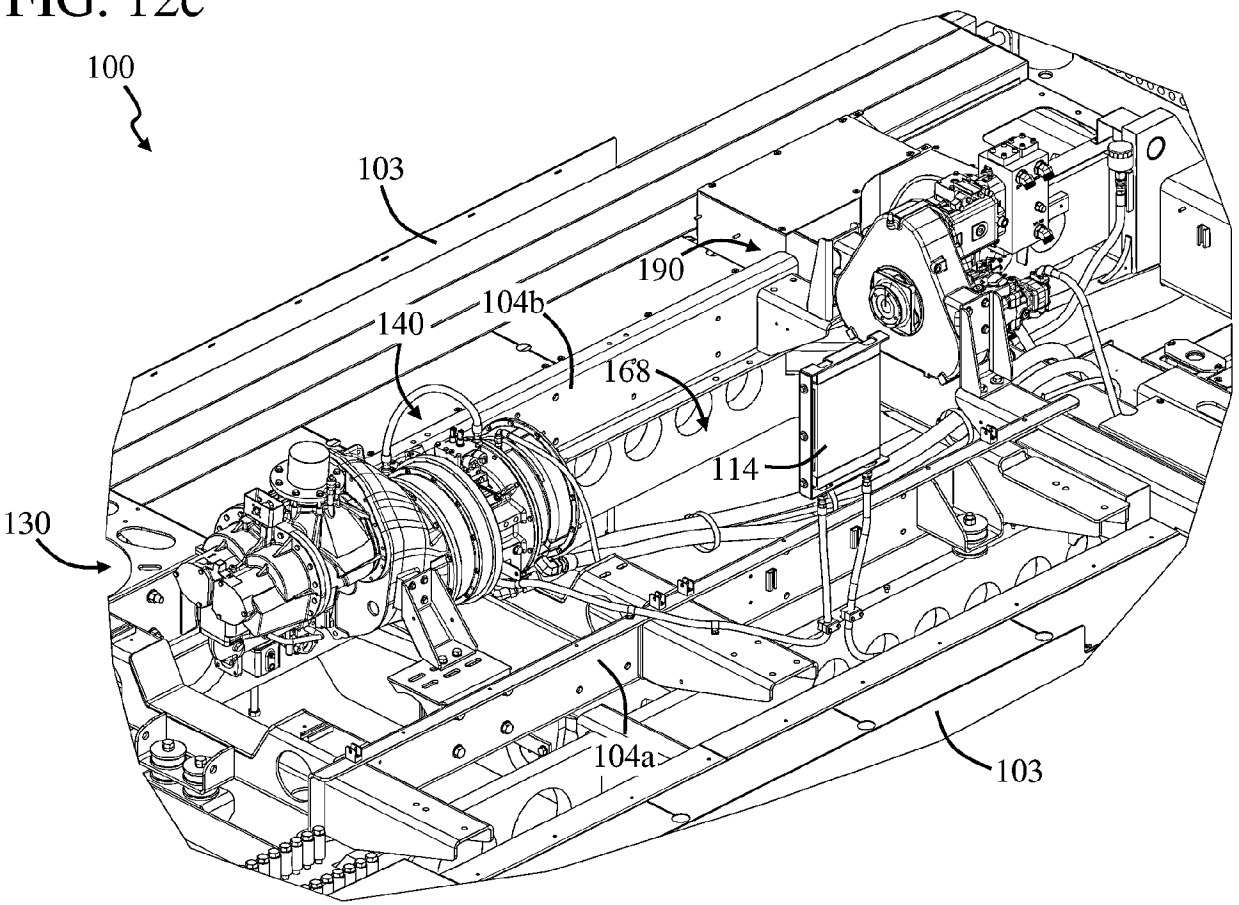

FIGS. 12*a*, 12*b* and 12*c* are perspective views of the clutch assembly heat exchange system of FIGS. 11*a* and 11*b* being carried by the platform of FIGS. 1*a* and 1*b* so it is in fluid communication with the clutch assembly of the power pack of FIG. 2*a*.

Figure 12D:
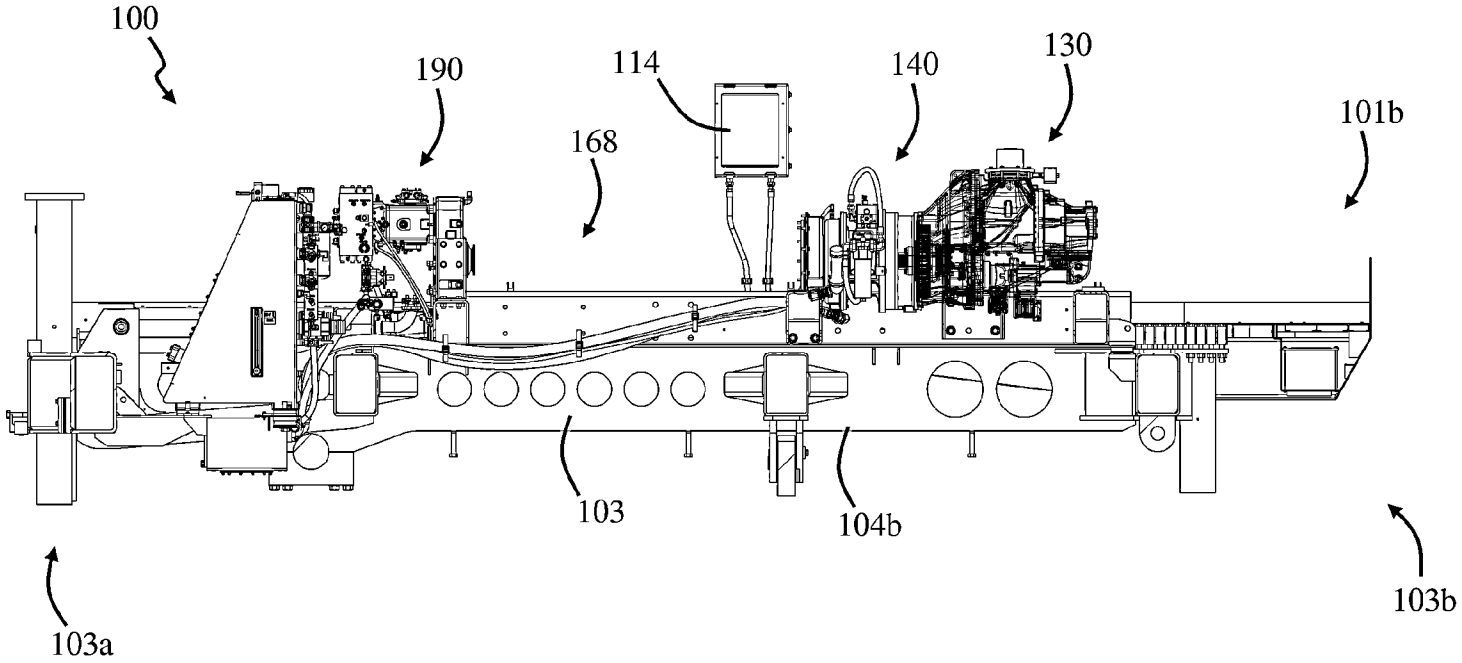
Figure 12E:
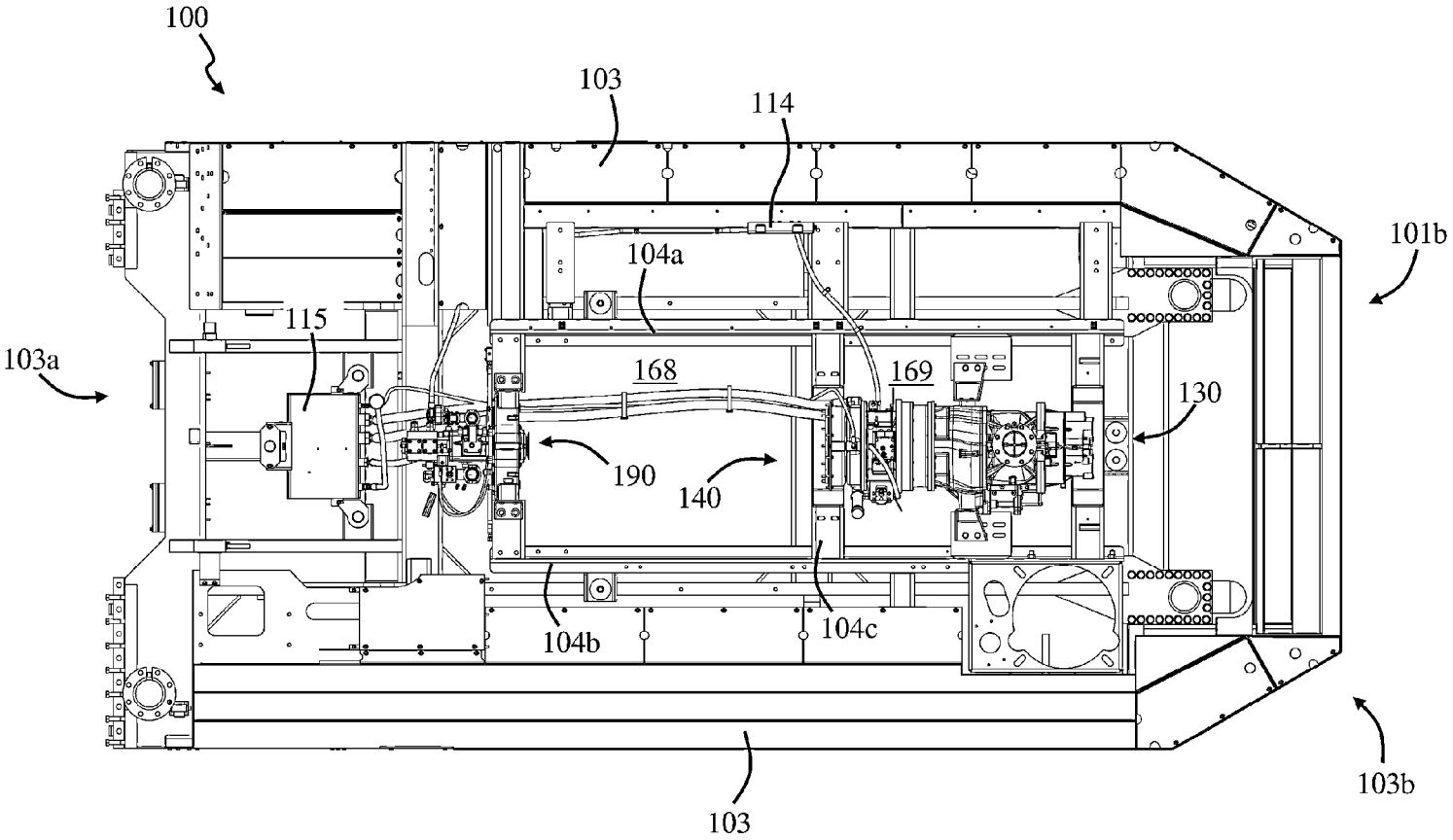

FIGS. 12*d* and 12*e* are side and top views, respectively, of the clutch assembly heat exchange system of FIGS. 11*a* and 11*b* being carried by the platform of FIGS. 1*a* and 1*b*.

DETAILED DESCRIPTION OF THE INVENTION

FIGS. 1*a* and 1*b* are side views of a drilling machine 100. It should be noted that drilling machine 100 can be a stationary or mobile vehicle, but here it is embodied as being a mobile vehicle for illustrative purposes. Some examples of different types of drilling machines are the PV-235, PV-270, PV-271, PV-275 and PV-351 drilling machines, which are manufactured by Atlas Copco Drilling Solutions of Garland, Tex. It should be noted, however, that drilling machines are provided by many other manufacturers.

In this embodiment, drilling machine 100 includes a platform 103 which carries a power pack 110 and operator's cab 105. Power pack 110 is discussed in more detail below with FIGS. 2*a* and 2*b*, and operator's cab 105 will be discussed in more detail presently.

In this embodiment, operator's cab 105 is positioned proximate to a vehicle front 101*a* of drilling machine 100, and power pack 110 is positioned proximate to a vehicle back 101*b* of drilling machine 100. A front 103*a* of platform 103 is positioned proximate to operator's cab 105, and a back 103*b* of platform 103 is positioned proximate to vehicle back 101*b*. A front 105*a* of operator's cab 105 is positioned proximate to front 101*a* of drilling machine 100, and a back 105*b* of operator's cab 105 is positioned proximate to front 103*a* of platform 103. In this way, operator's cab 105 is positioned between vehicle front 101*a* and platform front 103*a*, and power pack 110 is positioned between platform front 103*a* and vehicle back 101*b*.

FIG. 1*c* is a perspective view of operator's cab 105, wherein operator's cab 105 includes a chair assembly 200. FIGS. 1*d* and 1*e* are side views of opposed sides of chair assembly 200. In this embodiment, chair assembly 200 includes a chair stand 202 which carries a chair 201. In this embodiment, chair 201 is rotatably mounted to chair stand 202 so it is repeatably moveable between positions facing front 105*a* and back 105*b* of operator's cab 105. Chair 201 is shown facing back 105*b* of operator's cab 105 in FIG. 1*c*. It is desirable to have chair 201 face front 105*a* of operator's cab 105 when drilling machine 100 is being driven. It is desirable to have chair 201 face back 105*b* of operator's cab 105 when drilling machine 100 is being used to bore through a formation, as will be described in more detail below.

In this embodiment, chair assembly 200 includes a display 204 carried by a display arm 203, wherein display arm 203 is coupled to chair 201. Display 204 can be of many different types, such as a touch screen display. Display 204 is operatively coupled to a control system of drilling machine 100, and displays information about the operation of drilling machine 100. The information about the operation of drilling machine 100 can be of many different types. For example, display 204 displays information about the operation of power pack 110, as will be discussed in more detail below. It should be noted that the control system of drilling machine 100 can be of many different types of control systems, such as a computer system.

It should be noted that display 204 rotates in response to rotation of chair 201. Display 204 rotates towards and away from front 105*a* and back 105*b* of operator's cab 105 in response to chair 201 facing front 105*a* and back 105*b*, respectively, of operator's cab 105. It is useful for chair 201 to face display 204 so that an operator sitting on chair 201 is provided with information regarding the operation of drilling machine 100 when boring through the formation. FIGS. 1*f* and 1*g* are side views of chair 201 facing display 204.

FIGS. 1*h* and 1*i* are top views of chair assembly 200, wherein chair 201 faces display 204. In this embodiment, chair assembly 200 includes opposed control panels 210 and 211, which are operatively coupled to the control system of drilling machine 100. Control panels 210 and 211 are used to control the operation of drilling machine 100. In this embodiment, control panels 210 and 211 are operatively coupled to display 204. As will be discussed in more detail below, display 204 displays information in response to an input provided to control panel 210 and/or 211. In this way, information regarding the control of drilling machine 100 is displayed by display 204.

In this embodiment, control panels 210 and 211 are carried by chair stand 202. Control panels 210 and 211 are positioned on opposed sides of chair 201, and rotate in response to rotation of chair 201 about chair stand 202. Control panels 210 and 211 are positioned on opposed sides of chair 201 so that the operator sitting on chair 201 can control the operation of drilling machine 100. In this embodiment, control panel 210 is positioned towards display 204 when chair 201 faces back 105*b* of operator's cab 105, and control panel 211 is positioned towards display 204 when chair 201 faces front 105*a* of operator's cab 105. Further, control panel 211 is positioned away from display 204 when chair 201 faces back 105*b* of operator's cab 105, and control panel 210 is positioned away from display 204 when chair 201 faces front 105*a* of operator's cab 105.

In this embodiment, control panel 210 includes a joystick 205, which is operatively coupled to the control system of drilling machine 100. Further, control panel 210 includes a plurality of control inputs 208, which are operatively coupled to the control system of drilling machine 100. Control inputs 208 can be of many different types, such as buttons, switches and knobs.

In this embodiment, control panel 211 includes joysticks 206 and 207, which are operatively coupled to the control system of drilling machine 100. Further, control panel 211 includes a plurality of control inputs 209, which are operatively coupled to the control system of drilling machine 100. Control inputs 209 can be of many different types, such as buttons, switches and knobs. Joysticks 205, 206 and 207, as well as control inputs 208 and 209 are used to control the operation of drilling machine 100, as will be discussed in more detail below.

In this embodiment, drilling machine 100 includes a tower 102 with a tower base 102*a* rotatably coupled to platform 103, as shown in FIGS. 1*a* and 1*b*. Tower 102 generally carries a feed cable system (not shown) attached to a rotary head 107, wherein the feed cable system allows rotary head 107 to move between raised and lowered positions along tower 102. The feed cable system moves rotary head 107 to the raised and lowered positions by moving it towards tower crown 102*b* and tower base 102*a*, respectively. It should be noted that rotary head 107 can be moved between the raised and lowered positions in many other ways, such as by using a chain and sprocket or rack and pinion drive.

Rotary head 107 is attached to a drill string 108, wherein drill string 108 extends through tower 102 and platform 103. An opposed end of drill string 108 is coupled to a drill bit 109 (FIG. 1*b*), such as a tri-cone rotary drill bit. Drill string 108 generally includes one or more drill pipes connected together in a well-known manner.

Rotary head 107 is moved between the raised and lowered positions to raise and lower, respectively, drill string 108 and drill bit 109 through a formation 106 to form a borehole 106*a* (FIG. 1*b*). Further, rotary head 107 is used to rotate drill string 108 so that drill bit 109 rotates through formation 106 to form borehole 106*a*. It should be noted that the movement and rotation of rotary head 107 is controlled by control panel 210 and/or control panel 211. Further, information regarding the movement and rotation of rotary head 107 is displayed by display 204.

As will be discussed in more detail below, power pack 110 provides compressed air which flows to drill bit 109 through rotary head 107 and drill string 108. The compressed air is used to flush cuttings from borehole 106*a*. It should be noted that the operation of power pack 110 is controlled by control panel 210 and/or control panel 211. Further, information regarding the operation of power pack 110 is displayed by display 204.

FIG. 2*a* is a perspective view of power pack 110 carried by platform 103, and FIG. 2*b* is a perspective view of a portion of power pack 110. In this embodiment, power pack 110 includes a prime mover 120 which provides power for drilling machine 100. In this embodiment, prime mover 120 is embodied as a diesel engine. The diesel engine can be of many different types, such as the QSX and QSK series of diesel engines manufactured by Cummins of Columbus, Ind. and the Caterpillar C15 or C27 series of diesel engines manufactured by Caterpillar, Inc. of Peoria, Ill. It should be noted, however, that prime mover 120 can be embodied as many other different types of engines, such as a gasoline engine, CNG engine, or electric motor.

Prime mover 120 generates power when it is operating, and prime mover 120 does not generate power when it is not operating. Prime mover 120 is repeatably moveable between operating and non-operating conditions. Prime mover 120 is in on and off conditions when it is in operating and non-operating conditions, respectively. Prime mover 120 is moved between the operating and non-operating conditions in response to one or more inputs provided to control panel 210 and/or control panel 211. Further, information regarding the operation of prime mover 120 is displayed by display 204. Prime mover 120 consumes more fuel when it is operating than when it is not operating. Power pack 110 includes radiators 111 and 112 operatively coupled to prime mover 120, wherein radiators 111 and 112 cool power pack 110. The amount of fuel being consumed by prime mover 120 can be displayed by display 204.

In this embodiment, power pack 110 includes a pump system 190 operatively coupled to prime mover 120. It should be noted that the operation of pump system 190 is controlled by control panel 210 and/or control panel 211. Further, information regarding the operation of pump system 190 is displayed by display 204.

Pump system 190 can be operatively coupled to prime mover 120 in many different ways. In this embodiment, pump system 190 is operatively coupled to prime mover 120 through a pump system shaft assembly 122. Pump system shaft assembly 122 can have many different configurations, one of which will be discussed in more detail presently.

FIG. 3*a* is a perspective view of prime mover 120 and pump system shaft assembly 122, and FIGS. 3*b* and 3*c* are front and back perspective views, respectively, of pump system 190. In this embodiment, pump system shaft assembly 122 includes a pump system shaft 124 with prime mover couplers 123 and 125 coupled to opposed ends. Prime mover couplers 123 and 125 can be of many different types of couplers. In this embodiment, prime mover couplers 123 and 125 are embodied as universal joints. In this embodiment, pump system 190 includes a shaft assembly coupler 191 which is capable of being coupled to pump system coupler 125.

In one mode of operation, prime mover 120 generates power and prime mover coupler 123 rotates in response. It should be noted that the rotation speed of prime mover coupler 123 corresponds to the power provided by prime mover 120. The rotation speed of prime mover coupler 123 increases and decreases in response to the amount of power provided by prime mover 120 increasing and decreasing, respectively. Information regarding the rotation speed of prime mover coupler 123 and/or the power provided by prime mover 120 is displayed by display 204. Pump system coupler 125 and pump system shaft 124 rotate in response to rotation of prime mover coupler 123. Shaft assembly coupler 191 rotates in response to rotation of pump system coupler 125. Pump system 190 operates in response to rotation of shaft assembly coupler 191.

In another mode of operation, prime mover 120 does not generate power and prime mover coupler 123 does not rotate in response. Pump system coupler 125 and pump system shaft 124 do not rotate in response to prime mover coupler 123 not rotating. Shaft assembly coupler 191 does not rotate in response to pump system coupler 125 not rotating. Pump system 190 does not operate in response shaft assembly coupler 191 not rotating. In this way, pump system 190 is operatively coupled to prime mover 120 through a pump system shaft assembly.

In this embodiment, and as shown in FIG. 2*b*, power pack 110 includes a compressor 130 operatively coupled to prime mover 120 through a clutch assembly 140. It should be noted that the operation of compressor 130 is controlled by control panel 210 and/or control panel 211. Further, information regarding the operation of compressor 130 is displayed by display 204. For example, the amount of compressed air provided by compressor 130 can be displayed by display 204.

Compressor 130 includes a compressor output port (not shown), which is in fluid communication with rotary head 107 (FIG. 1*a*). Compressor 130 provides compressed air to rotary head 107 through compressor output port (not shown). More information regarding compressors can be found in U.S. Pat. Nos. 4,052,135, 4,088,427, 6,293,382, 6,478,560, 6,488,488 and 6,981,855. Compressor 130 can be provided by many different manufacturers, such as Ingersoll Rand Company of Piscataway, N.J.

In this embodiment, compressor 130 is operatively coupled to prime mover 120 through a compressor coupler. The compressor coupler can have many different configurations, one of which will be discussed in more detail presently.

FIG. 4*a* is a perspective view of prime mover 120 and compressor coupler 121, and FIGS. 4*b* and 4*c* are front perspective and top views, respectively, of compressor 130. In this embodiment, compressor coupler 121 includes a prime mover flange 127 and prime mover flywheel 128. Prime mover flywheel 128 rotates in response to the rotation of a crank shaft (not shown) of prime mover 120. The crank shaft of prime mover 120 rotates when prime mover 120 is operating, and the crank shaft of prime mover 120 does not rotate when prime mover 120 is not operating. It should be noted that the rotation speed of the crank shaft of prime mover 120 controlled by control panel 210 and/or control panel 211. Further, information regarding the rotation speed of the crank shaft of prime mover 120 is displayed by display 204.

It should also be noted that the rotation speed of prime mover flywheel 128 corresponds to the rotation speed of the crank shaft. For example, the rotation speed of prime mover flywheel 128 increases and decreases as the rotation speed of the crank shaft increases and decreases, respectively. The rotation speed of the crank shaft increase and decreases as the amount of power provided by prime mover 120 increases and decreases, respectively. Hence, the rotation speed of prime mover flywheel 128 increases and decreases in response to the amount of power provided by prime mover 120 increasing and decreasing, respectively. It should be noted that the amount of energy consumed by prime mover 120 increases and decreases as the amount of power it provides increases and decreases.

In this embodiment, prime mover flange 127 includes a plurality of flange openings 137 extending therethrough. Further, prime mover flywheel 128 includes a plurality of flywheel openings 129 extending therethrough. As will be discussed in more detail below, flange openings 137 are spaced apart from each other to receive flange fasteners, and flywheel openings 129 are spaced apart from each other to receive flywheel fasteners. In this embodiment, flywheel openings 129 and flange openings 137 are blind, tapped bolt holes which are positioned according to standards established by SAE International for engine housings and flywheels. In this embodiment, flywheel openings 129 and flange openings 137 are consistent with SAE No. #1 for engine housings and flywheels.

In some embodiments, the flange and flywheel fasteners fasten prime mover 120 and compressor 130 together. In these embodiments, prime mover 120 and compressor 130 are fastened together in a direct manner. Compressor 130 operates in response to prime mover 120 being operated when compressor 130 is fastened to prime mover 120 in a direct manner. Prime mover 120 consumes more fuel when compressor 130 is fastened to it in a direct manner.

In other embodiments, the flange and flywheel fasteners fasten prime mover 120 and a clutch assembly together, as will be discussed in more detail below. In these embodiments, compressor 130 is operatively coupled to prime mover 120 through the clutch assembly. In these embodiments, prime mover 120 and compressor 130 are not fastened together in a direct manner. For example, compressor 130 is operatively coupled to prime mover 120 through clutch assembly 140 in FIGS. 2*a* and 2*b*. In FIGS. 2*a* and 2*b*, prime mover 120 and compressor 130 are not fastened together in a direct manner.

Compressor 130 operates in response to prime mover 120 being operated when compressor 130 is operatively coupled to prime mover 120 through the clutch assembly and the clutch assembly is in an engaged condition. Prime mover 120 consumes more energy when compressor 130 is operatively coupled to prime mover 120 through the clutch assembly and the clutch assembly is in the engaged condition.

Compressor 130 does not operate in response to prime mover 120 being operated when compressor 130 is operatively coupled to prime mover 120 through the clutch assembly and the clutch assembly is in a disengaged condition. Prime mover 120 consumes less energy when compressor 130 is operatively coupled to prime mover 120 through the clutch assembly and the clutch assembly is in the disengaged condition.

In this way, the operation of compressor 130 is controllable in response to moving the clutch assembly between engaged and disengaged conditions. Further, the amount of energy consumed by prime mover 120 is controllable in response to moving the clutch assembly between engaged and disengaged conditions. It should be noted that the movement of the clutch assembly between the engaged and disengaged conditions is controlled by control panel 210 and/or control panel 211. Further, information regarding the condition of the clutch assembly is displayed by display 204. For example, display 204 provides an indication which corresponds to the clutch assembly being in the engaged and disengaged condition. As will be discussed in more detail below, the clutch assembly can have many different configurations, and can be coupled between prime mover 120 and compressor 130 in many different ways.

Compressor 130 includes a prime mover coupler 131 (FIG. 4*b*), which allows compressor 130 to be operatively coupled to prime mover 120. In particular, prime mover coupler 131 allows compressor 130 to be coupled to compressor coupler 121. In this embodiment, prime mover coupler 131 includes an outer compressor flange 132 which includes a plurality of flange fasteners 134 extending therefrom. Flange fasteners 134 are spaced apart from each other so they can be received by a corresponding flange opening 137 of prime mover flywheel 128 when prime mover 120 and compressor 130 are fastened together in a direct manner. In this embodiment, flange fasteners 134 are embodied as bolts which are typically used with engine housings.

Compressor 130 includes a compressor driveshaft 133. Compressor 130 provides compressed air in response to the rotation of compressor driveshaft 133, and compressor 130 does not provide compressed air in response to compressor driveshaft 133 not rotating. In this embodiment, compressor driveshaft 133 is cylindrical in shape so a friction fit can be formed between compressor driveshaft 133 and another component (not shown), such as the adapter mentioned above. In this way, compressor driveshaft 133 and the component are frictionally coupled together. In some embodiments, such as the embodiment indicated by an indication arrow 139, compressor driveshaft 133 carries a key 135. Key 135 is capable of being received by a keyway of another component, so they are mechanically coupled together. One example of a keyway is described with FIG. 9*d*. Key 135 engages the component through the keyway of the component so that compressor driveshaft 133 and the component are mechanically coupled together. In general, a mechanical coupling is less likely to experience slip than a frictional coupling.

FIG. 5*a* is a side view of one embodiment of clutch assembly 140, and FIGS. 5*b* and 5*c* are side views of a prime mover end 149 and compressor end 148, respectively, of clutch assembly 140. FIG. 5*d* is a cut-away side view of clutch assembly 140 taken along a cut-line 5*d*-5*d* of FIGS. 5*b* and 5*c*. Clutch assembly 140 is used to operatively couple prime mover 120 and compressor 130 together, as shown in FIGS. 2*a* and 2*b*.

In this embodiment, clutch assembly 140 includes a clutch 141, which includes a compressor end housing 143 and prime mover end housing 144 positioned proximate to compressor end 148 and prime mover end 149, respectively, of clutch assembly 140. Compressor end 148 of clutch assembly 140 is positioned towards compressor 130 when clutch assembly 140 is operatively coupled to compressor 130. Further, compressor end 148 of clutch assembly 140 is positioned away from prime mover 120 when clutch assembly 140 is operatively coupled to compressor 130. Prime mover end 149 of clutch assembly 140 is positioned towards prime mover 120 when clutch assembly 140 is operatively coupled to prime mover 120. Further, prime mover end 149 of clutch assembly 140 is positioned away from compressor 130 when clutch assembly 140 is operatively coupled to prime mover 120.

In this embodiment, compressor end housing 143 is coupled to a clutch housing 145 through a clutch spacer 146, as shown in FIG. 5*b*. Clutch spacer 146 allows compressor 130 to be spaced a desired distance from prime mover 120. Clutch housing 145 carries a clutch controller 142, which controls the operation of clutch 141. In particular, clutch controller 142 moves clutch 141 between engaged and disengaged conditions in a well-known manner. It should be noted that the operation of clutch controller 142 is controlled by control panel 210 and/or control panel 211. In this way, the operation of clutch assembly 140 is controlled in response to one or more inputs provided to control panel 210 and/or control panel 211. Further, information regarding the operation of clutch controller 142 is displayed by display 204.

Clutch 141 can be of many different types. In this embodiment, clutch 141 is a hydraulic clutch. Hydraulic clutches are typically used in high torque applications because they are capable of dissipating more heat than dry clutches. There are many different types of hydraulic clutches that can be used as clutch 141. One type of hydraulic clutch that can be used as clutch 141 is a hydraulic power take-off clutch manufactured by Twin Disc, Inc. of Racine, Wis. Examples of hydraulic power take-off clutch manufactured by Twin Disc include the HP300 and HP600 series of clutches.

In some embodiments, clutch 141 is a dry clutch. However, there are several problems with including a dry clutch with clutch assembly 140. One problem is that dry clutches are typically designed to be in the engaged condition about 90% of the time during a drilling operation, and experience a significant amount of wear when in the disengaged condition for an extended period of time during the drilling operation. It is time consuming and costly to remove a clutch from drilling machine 100 and replace it with another one. Hence, it is desirable to include in clutch assembly 140 a clutch that is less likely to wear out.

Hydraulic clutches are capable of operating in the engaged and disengaged conditions without experiencing as much wear as a dry clutch. In some situations, clutch 141 is in the engaged condition about 50% of the time during the drilling operation. Hence, the hydraulic clutch is less likely to wear out than a dry clutch.

In this embodiment, clutch assembly 140 includes a clutch-to-compressor coupling 150, which is coupled to clutch 141 through a splined clutch output shaft 178. Clutch-to-compressor coupling 150 is positioned proximate to compressor end 148 of clutch assembly 140, and is housed by compressor end housing 143. Clutch-to-compressor coupling 150 is capable of being coupled to compressor 130. In particular, clutch-to-compressor coupling 150 is capable of being coupled to compressor driveshaft 133. Clutch-to-compressor coupling 150 is capable of being operatively coupled to compressor 130 so that compressor 130 provides compressed air through compressor output port (not shown) in response to rotation of clutch-to-compressor coupling 150. Clutch-to-compressor coupling 150 is discussed in more detail below.

In this embodiment, clutch assembly 140 includes a clutch-to-prime mover coupling 180, which is coupled to clutch 141 through a splined clutch input shaft 179. Clutch-to-prime mover coupling 180 is positioned proximate to prime mover end 149 of clutch assembly 140, and is housed by prime mover end housing 144. Clutch-to-prime mover coupling 180 is capable of being coupled to prime mover 120. Clutch-to-prime mover coupling 180 is capable of being operatively coupled to prime mover 120 so that clutch-to-prime mover coupling 180 rotates in response to the operation of prime mover 120. In one example, clutch-to-prime mover coupling 180 is operatively coupled to prime mover 120 by extending flywheel fasteners 181 through corresponding flywheel openings 129 (FIG. 4*a*), and by extending flange fasteners 147 through corresponding flange openings 137 (FIG. 4*a*).

It should be noted that clutch-to-prime mover coupling 180 is moveable from a coupled condition to a decoupled condition. In the coupled condition, splined clutch input shaft 179 rotates in response to rotation of clutch-to-prime mover coupling 180. For example, in the coupled condition, the rotation rate of splined clutch input shaft 179 and clutch-to-prime mover coupling 180 are driven to equal each other. In the decoupled condition, splined clutch input shaft 179 rotates less in response to rotation of clutch-to-prime mover coupling 180. For example, in the decoupled condition, the rotation rate of splined clutch input shaft 179 is driven to be less than the rotation rate of clutch-to-prime mover coupling 180. In one specific example, splined clutch input shaft 179 does not rotate in response to rotation of clutch-to-prime mover coupling 180 when the clutch-to-prime mover coupling 180 is in the decoupled condition. There are many different ways in which the rotation rate of splined clutch input shaft 179 is less than the rotation rate of clutch-to-prime mover coupling 180, one of which will be discussed below with FIGS. 7*a*, 7*b*, 7*c*, 7*d*, 7*e* and 7*f*.

Clutch assembly 140 is repeatably moveable between engaged and disengaged conditions. Clutch assembly 140 is in the engaged and disengaged conditions when clutch 141 is in the engaged and disengaged conditions, respectively. In the engaged condition, splined clutch output shaft 178 rotates in response to rotation of splined clutch input shaft 179. For example, in the engaged condition, the rotation rate of splined clutch input shaft 179 and splined clutch output shaft 178 are driven to equal each other. It should be noted that clutch assembly 140 is moveable between the engaged and disengaged conditions when prime mover 120 is operating and not operating. As mentioned above, prime mover 120 generates power when it is operating, and prime mover 120 does not generate power when it is not operating. Hence, clutch assembly 140 is moveable between the engaged and disengaged conditions when prime mover 120 is generating power and not generating power.

It is useful to be able to move clutch assembly 140 between the engaged and disengaged conditions when prime mover 120 is operating so that it is not necessary to move prime mover 120 from the operating condition to the non-operating condition. Moving prime mover 120 from the operating condition to the non-operating condition to move clutch assembly 140 between the engaged and disengaged conditions is inconvenient and time consuming.

It should also be noted that the movement of clutch assembly 140 between the engaged and disengaged conditions is controlled by control panel 210 and/or control panel 211. Further, information regarding the condition of the clutch assembly 140 is displayed by display 204. For example, display 204 provides an indication which corresponds to the clutch assembly 140 in the engaged and disengaged condition.

In general, the movement of clutch assembly 140 between the engaged and disengaged conditions is controlled by the control system of drilling machine 100, which is in communication with clutch controller 142. The control system of drilling machine 100 can have inputs positioned at many different locations. For example, inputs can be positioned in cab 105, as discussed above, or the inputs can be positioned external to cab 105, such as proximate to platform 103. In some embodiments, the inputs of the control system of drilling machine 100 are responsive to a wireless control signal. The wireless control signal can be provided from a location in cab 105 and external to cab 150. In this way, the control system of drilling machine can be remotely controlled.

In some embodiments, the inputs of the control system of drilling machine 100 are responsive to a signal provided by prime mover 120. For example, the inputs of the control system of drilling machine 100 are responsive to a stall signal provided by prime mover 120. Prime mover 120 provides the stall signal in response to stalling. In this way, clutch controller 142 is responsive to a signal provided by prime mover 120. In some embodiments, the inputs of the control system of drilling machine 100 are responsive to a signal provided by compressor 130. For example, the inputs of the control system of drilling machine 100 are responsive to a seize signal provided by compressor 130. Compressor 130 provides the seize signal in response to seizing. In this way, clutch controller 142 is responsive to a signal provided by compressor 130.

In the disengaged condition, splined clutch output shaft 178 rotates less in response to rotation of splined clutch input shaft 179. For example, in the disengaged condition, the rotation rate of splined clutch output shaft 178 is driven to be less than the rotation rate of splined clutch input shaft 179. In one specific example, splined clutch output shaft 178 does not rotate in response to rotation of splined clutch input shaft 179 when clutch 141 is in the disengaged condition.

In operation, compressor 130 provides compressed air through compressor output port (not shown) in response to rotation of compressor driveshaft 133. Compressor driveshaft 133 rotates in response to rotation of clutch-to-compressor coupling 150 because, as mentioned above, compressor driveshaft 133 is coupled to clutch-to-compressor coupling 150. Clutch-to-compressor coupling 150 rotates in response to rotation of splined clutch output shaft 178 because clutch-to-compressor coupling 150 is coupled to splined clutch output shaft 178.

In operation, splined clutch output shaft 178 rotates in response to rotation of splined clutch input shaft 179 when clutch 141 is in the engaged condition. Further, splined clutch output shaft 178 rotates less in response to rotation of clutch input shaft 179 when clutch 141 is in the disengaged condition.

In operation, splined clutch input shaft 179 rotates in response to rotation of clutch-to-prime mover coupling 180 when clutch-to-prime mover coupling 180 is in the coupled condition. Splined clutch input shaft 179 rotates less in response to rotation of clutch-to-prime mover coupling 180 when clutch-to-prime mover coupling 180 is in the decoupled condition.

In operation, clutch-to-prime mover coupling 180 is coupled to prime mover flywheel 128 through flywheel fasteners 181 so that clutch-to-prime mover coupling 180 rotates in response to rotation of prime mover flywheel 128. As mentioned above, prime mover flywheel 128 rotates in response to the operation of prime mover 120. Clutch-to-prime mover coupling 180 rotates less in response to prime mover flywheel 128 rotating less. Prime mover flywheel 128 rotates less in response to prime mover 120 being moved from operating to non-operating conditions. In this way, compressor 130 is operatively coupled to prime mover 120 through clutch assembly 140. Clutch-to-prime mover coupling 180, and the movement of clutch-to-prime mover coupling 180 between coupled and decoupled conditions, will be discussed in more detail presently.

FIG. 6*a* is a perspective view of prime mover end 149 of clutch assembly 140 with clutch-to-prime mover coupling 180 coupled to clutch 141, and FIG. 6*b* is a perspective view of prime mover end 149. As shown in FIG. 6*b*, clutch 141 includes splined clutch input shaft 179, which includes clutch input shaft splines 189. Splined clutch input shaft 179 is capable of being coupled with splines of clutch-to-prime mover coupling 180, as mentioned above, and as will be discussed in more detail presently.

FIGS. 7*a* and 7*b* are perspective front and back views of clutch-to-prime mover coupling 180, and FIGS. 7*c* and 7*d* are front and back views of clutch-to-prime mover coupling 180. Further, FIG. 7*e* is a side view of clutch-to-prime mover coupling 180, and FIG. 7*f* is a cut-away side view of clutch-to-prime mover coupling 180 taken along a cut-line 7*f*-7*f* of FIG. 7*e*.

In this embodiment, clutch-to-prime mover coupling 180 includes an outer flange 182, which includes a plurality of outer flange openings 183 extending around its outer periphery. Outer flange openings 183 are sized and shaped to receive fasteners 181 so that clutch-to-prime mover coupling 180 are capable of being coupled to respective flywheel openings 129 of prime mover flywheel 128 (FIG. 4*a*). In this way, clutch-to-prime mover coupling 180 is coupled to prime mover 120.

In this embodiment, clutch-to-prime mover coupling 180 includes a resilient ring 184, which is coupled to an inner periphery of outer flange 182, as shown in FIG. 7*f*. Resilient ring 184 is coupled to the inner periphery of outer flange 182 so that resilient ring 184 rotates in response to rotation of outer flange 182. Resilient ring 184 includes a resilient material, such as rubber, which allows clutch-to-prime mover coupling 180 to operate as a torsional coupling. Clutch-to-prime mover coupling 180 operates as a torsional coupling which attenuates vibrations that flow between prime mover 120 and compressor 130, as will be discussed in more detail below. It should be noted that clutch-to-prime mover coupling 180 can include other components, besides resilient ring 184, so it operates as a torsional coupling. For example, in some embodiments clutch-to-prime mover coupling 180 includes springs which attenuate vibrations. A torsional coupling which includes a spring to attenuate vibrations is called a spring-loaded torsional coupling. One example of a spring loaded torsional coupling is disclosed in U.S. Pat. No. 6,231,449, the contents of which are incorporated by reference as though fully set forth herein.

In this embodiment, clutch-to-prime mover coupling 180 includes an inner hub 187, which includes inner and outer L-shaped ring portions 187*a* and 187*b*. Outer and inner peripheries of outer L-shaped ring portion 187*b* are engaged with resilient ring 184 and inner L-shaped ring portions 187*a*, respectively. The outer periphery of outer L-shaped ring portion 187*b* is coupled to resilient ring 184 so that inner hub 187 rotates in response to rotation of resilient ring 184 and outer flange 182. In this way, clutch-to-prime mover coupling 180 is in the coupled condition. In this way, inner hub 187 is coupled to outer flange 182 through resilient ring 184. The inner periphery of outer L-shaped ring portion 187*b* is coupled to inner L-shaped ring portion 187*a* so that inner L-shaped ring portion 187*a* rotates in response to rotation of outer L-shaped ring portion 187*b*.

As will be discussed in more detail below, resilient ring 184 can decouple inner hub 187 from outer flange 182 so that inner hub 187 rotates less in response to rotation of outer flange 182. In one particular situation, resilient ring 184 decouples inner hub 187 from outer flange 182 so that inner hub 187 does not rotate in response to rotation of outer flange 182. In one particular situation, the rotation rate of inner hub 187 is driven to zero in response to resilient ring 184 decoupling inner hub 187 from outer flange 182.

Further, as will be discussed in more detail below, resilient ring 184 attenuates vibrations between prime mover 120 and clutch assembly 140. It is desirable to attenuate the vibrations between prime mover 120 and clutch assembly 140 and compressor 130 because these vibrations can undesirably affect the operation of clutch assembly 140 and compressor 130.

In this embodiment, clutch-to-prime mover coupling 180 includes a splined locking collar 185, wherein an outer periphery of splined locking collar 185 is coupled to inner hub 187. The outer periphery of splined locking collar 185 is coupled to inner L-shaped ring portion 187*a* so that splined locking collar 185 rotates in response to rotation of inner hub 187, resilient ring 184 and outer flange 182 when clutch-to-prime mover coupling 180 is in the coupled condition. In this way, splined locking collar 185 is coupled to outer flange 182 through resilient ring 184. As will be discussed in more detail below, resilient ring 184 can decouple splined locking collar 185 from outer flange 182 so that splined locking collar 185 rotates less in response to rotation of outer flange 182. Clutch-to-prime mover coupling 180 is in the decoupled condition when splined locking collar 185 rotates less in response to rotation of outer flange 182.

In this embodiment, splined locking collar 185 includes a central opening 193 and locking collar splines 186, which extend through the central opening 193. Central opening 193 of splined locking collar 185 is sized and shaped to receive splined clutch input shaft 179 so that clutch input shaft splines 189 engage locking collar splines 186. Clutch-to-prime mover coupling 180 is coupled to splined clutch input shaft 179 so that splined clutch input shaft 179 rotates in response to rotation of clutch-to-prime mover coupling 180. In particular, splined clutch input shaft 179 rotates in response to rotation of splined locking collar 185, inner hub 187, resilient ring 184 and outer flange 182 when clutch-to-prime mover coupling 180 is in the coupled condition. In this way, splined clutch input shaft 179 is coupled to outer flange 182 through resilient ring 184. As will be discussed in more detail below, resilient ring 184 can decouple splined clutch input shaft 179 from outer flange 182 so that splined clutch input shaft 179 rotates less in response to rotation of outer flange 182. Clutch-to-prime mover coupling 180 is in the decoupled condition when splined clutch input shaft 179 rotates less in response to rotation of outer flange 182.

In a first mode of operation, resilient ring 184 couples outer flange 182 and inner hub 187 together so that clutch-to-prime mover coupling 180 is in the coupled condition. In this mode of operation, the rotation rate of clutch-to-prime mover coupling 180 is driven to equal the rotation rate of prime mover flywheel 128 (FIG. 4*a*). Clutch-to-prime mover coupling 180 rotates in response to rotation of prime mover flywheel 128 because, as mentioned above, outer flange 182 is coupled to prime mover flywheel 128 through flywheel fasteners 181.

Further, splined clutch input shaft 179 rotates in response to rotation of clutch-to-prime mover coupling 180. Splined clutch input shaft 179 rotates in response to rotation of clutch-to-prime mover coupling 180 because splined locking collar 185 is coupled to splined clutch input shaft 179 (FIG. 6*b*), and splined locking collar 185 is coupled to outer flange 182 through resilient ring 184 when clutch-to-prime mover coupling 180 is in the coupled condition. Hence, in the first mode of operation, torque is transferred between prime mover flywheel 128 and splined clutch input shaft 179. It should be noted that the amount of torque transferred between prime mover flywheel 128 and splined clutch input shaft 179 can be displayed by display 204.

In the first mode of operation, splined clutch output shaft 178 rotates in response to rotation of splined clutch input shaft 179 when clutch assembly 140 is in the engaged condition. Further, compressor driveshaft 133 rotates in response to rotation of splined clutch output shaft 178 because, as mentioned above, compressor driveshaft 133 is coupled to splined clutch output shaft 178 through clutch-to-compressor coupling 150. Compressor 130 provides compressed air to rotary head 107 through compressor output port (not shown) in response to rotation of compressor driveshaft 133.

In the first mode of operation, splined clutch output shaft 178 rotates less in response to rotation of splined clutch input shaft 179 when clutch assembly 140 is in the disengaged condition. Splined clutch output shaft 178 rotate less in response to rotation of splined clutch input shaft 179 when clutch assembly 140 is in the disengaged condition even though splined clutch input shaft 179 is coupled to prime mover flywheel 128 through clutch-to-prime mover coupling 180. Further, compressor driveshaft 133 rotates less in response to rotation of splined clutch output shaft 178 because, as mentioned above, compressor driveshaft 133 is coupled to splined clutch output shaft 178 through clutch-to-compressor coupling 150. Compressor 130 provides less compressed air to rotary head 107 through compressor output port (not shown) in response to less rotation of compressor driveshaft 133.

In one particular situation, splined clutch output shaft 178 does not rotate in response to rotation of splined clutch input shaft 179 when clutch assembly 140 is in the disengaged condition. Splined clutch output shaft 178 does not rotate in response to rotation of splined clutch input shaft 179 when clutch assembly 140 is in the disengaged condition even though splined clutch input shaft 179 is coupled to prime mover flywheel 128 through clutch-to-prime mover coupling 180.

Further, compressor driveshaft 133 does not rotate in response to rotation of splined clutch output shaft 178 even though compressor driveshaft 133 is coupled to splined clutch output shaft 178 through clutch-to-compressor coupling 150. Compressor 130 does not provide compressed air to rotary head 107 through compressor output port (not shown) when compressor driveshaft 133 does not rotate.

In a second mode of operation, outer flange 182 and inner hub 187 are decoupled from each other. In this mode of operation, outer flange 182 and inner hub 187 are decoupled from each other in response to resilient ring 184 decoupling inner hub 187 from outer flange 182. It should be noted that display 204 can display a decouple indication in response to outer flange 182 and inner hub 187 being decoupled from each other. The decouple indication is displayed by display 204 in response to resilient ring 184 decoupling inner hub 187 from outer flange 182. For example, display 204 can display the decouple indication in response to an indication that inner hub 187 is rotating less than outer flange 182.

Outer flange 182 rotates in response to rotation of prime mover flywheel 128 (FIG. 4*a*). Outer flange 182 rotates in response to rotation of prime mover flywheel 128 because, as mentioned above, outer flange 182 is coupled to prime mover flywheel 128 through flywheel fasteners 181.

However, splined clutch input shaft 179 rotates less in response to rotation of outer flange 182. Splined clutch input shaft 179 rotates less in response to rotation of outer flange 182 because resilient ring 184 decouples outer flange 182 and inner hub 187 from each other so that splined locking collar 185 is decoupled from outer flange 182. Hence, in the second mode of operation, less torque is transferred between prime mover flywheel 128 and splined clutch input shaft 179 when clutch-to-prime mover coupling 180 is in the decoupled condition.

In one particular situation, splined clutch input shaft 179 does not rotate in response to rotation of outer flange 182. Splined clutch input shaft 179 does not rotate in response to rotation of outer flange 182 because resilient ring 184 decouples outer flange 182 and inner hub 187 from each other so that splined locking collar 185 is decoupled from outer flange 182. Hence, in this situation, torque is not transferred between prime mover flywheel 128 and splined clutch input shaft 179 when clutch-to-prime mover coupling 180 is in the decoupled condition.

Resilient ring 184 can decouple inner hub 187 from outer flange 182 in many different ways. For example, in some situations, the rotation of prime mover flywheel 128 decreases and resilient ring 184 is decoupled from outer flange 182 in response. In some of these situations, the rotation of prime mover flywheel 128 decreases at a predetermined rate and resilient ring 184 is decoupled from outer flange 182 in response. The predetermined rate depends on many different factors, such as the strength of the material of resilient ring 184. In general, the value of the predetermined rate increases and decreases in response to the strength of the material of resilient ring 184 increasing and decreasing, respectively. The predetermined rate depends on the dimensions of resilient ring 184. In general, the value of the predetermined rate increases and decreases in response to the dimensions of resilient ring 184 increasing and decreasing, respectively.

In another situation, the rotation of prime mover flywheel 128 decreases and resilient ring 184 is decoupled from inner hub 187 in response. In some of these situations, the rotation of prime mover flywheel 128 decreases at the predetermined rate and resilient ring 184 is decoupled from inner hub 187 in response. The predetermined rate is discussed in more detail above.

In some situations, the rotation of prime mover flywheel 128 decreases and resilient ring 184 stretches in response. In some of these situations, the rotation of prime mover flywheel 128 decreases at the predetermined rate and resilient ring 184 stretches in response. The predetermined rate is discussed in more detail above. In these situations, resilient ring 184 stretches so that the ability of torque to be transmitted between outer flange 182 and inner hub 187 is restricted. In some of these situations, resilient ring 184 tears in response to being stretched, wherein the tear restricts the ability of torque to be transmitted between outer flange 182 and inner hub 187. In some of these situations, the rotation of prime mover flywheel 128 decreases at the predetermined rate and resilient ring 184 tears in response.

It is desirable to move clutch-to-prime mover coupling 180 to the decoupled condition for many different reasons. For example, in some situations, clutch assembly 140 is in the engaged condition and clutch-to-prime mover coupling 180 is in the coupled condition. In these situations, the speed of rotation of compressor driveshaft 133 is driven to equal the rotation speed of prime mover flywheel 128 and the crankshaft of prime mover 120.

If compressor 130 seizes, the rotation of compressor driveshaft 133 is undesirably driven to be unequal to the rotation speed of prime mover flywheel 128 and the crankshaft of prime mover 120. Resilient ring 184 experiences a torquing force in response to the rotation of compressor driveshaft 133 being driven to be unequal to the rotation speed of prime mover flywheel 128 and the crankshaft of prime mover 120. Resilient ring 184 is stretched and tears in response to the torquing force so that clutch-to-prime mover coupling 180 moves to the decoupled condition. In this way, prime mover 120 and compressor 130 are decoupled from each other. It should be noted that, in some embodiments, compressor 130 provides a seize signal to the control system of drilling machine 100 in response to seizing.

It is desirable to decouple prime mover 120 and compressor 130 from each other for many different reasons. For example, prime mover 120 can be damaged in response to compressor 130 seizing if compressor 130 is not decoupled from prime mover 120. Prime mover 120 can be damaged in response to compressor 130 seizing because prime mover flywheel 128 and the crankshaft of prime mover 120 will undesirably experience the torquing force mentioned above. It is undesirable to damage prime mover 120 in response to the seizing of compressor 130 because it is expensive and time consuming to remove prime mover 120 from drilling machine 100 and replace it with another one. It is less expensive and time consuming to remove a clutch-to-prime mover coupling in the decoupled condition and replace it with another one that is in the coupled condition.

If prime mover 120 stalls, the rotation of prime mover flywheel 128 and the crankshaft of prime mover 120 is undesirably driven to be unequal to the rotation speed of compressor driveshaft 133. Resilient ring 184 experiences a torquing force in response to the rotation of prime mover flywheel 128 and the crankshaft of prime mover 120 being driven to be unequal to the rotation speed of compressor driveshaft 133. Resilient ring 184 is stretched and tears in response to the torquing force so that clutch-to-prime mover coupling 180 moves to the decoupled condition. In this way, prime mover 120 and compressor 130 are decoupled from each other. It should be noted that, in some embodiments, prime mover 120 provides a stall signal to the control system of drilling machine 100 in response to stalling.

It is desirable to decouple prime mover 120 and compressor 130 from each other for many different reasons. For example, compressor 130 can be damaged in response to prime mover 120 stalling if prime mover 120 is not decoupled from compressor 130. Compressor 130 can be damaged in response to prime mover 120 stalling because compressor driveshaft 133 will undesirably experience the torquing force mentioned above. It is undesirable to damage compressor 130 in response to the stalling of prime mover 120 because it is expensive and time consuming to remove compressor 130 from drilling machine 100 and replace it with another one. It is less expensive and time consuming to remove a clutch-to-prime mover coupling in the decoupled condition and replace it with another one that is in the coupled condition.

As mentioned above, resilient ring 184 attenuates vibrations between prime mover 120 and clutch assembly 140. In particular, resilient ring 184 attenuates vibrations between prime mover 120 and clutch 141. The vibrations are typically generated in response to the operation of prime mover 120. For example, vibrations are generated in response to the rotation of the crankshaft of prime mover 120 and prime mover flywheel 128.

It should be noted that resilient ring 184 attenuates vibrations between prime mover 120 and compressor 130 because, as mentioned above, compressor 130 is coupled to prime mover 120 through clutch assembly 140. Resilient ring 184 attenuates vibrations between prime mover 120 and clutch assembly 140 and compressor 130 in many different ways, several of which will be discussed in more detail presently.

In this embodiment, resilient ring 184 attenuates vibrations between prime mover flywheel 128 and splined clutch input shaft 179. Resilient ring 184 attenuates vibrations between prime mover flywheel 128 and splined clutch input shaft 179 because resilient ring 184 is coupled between prime mover flywheel 128 and splined clutch input shaft 179.

In this embodiment, resilient ring 184 attenuates vibrations between prime mover flywheel 128 and splined locking collar 185. Resilient ring 184 attenuates vibrations between prime mover flywheel 128 and splined locking collar 185 because resilient ring 184 is coupled between prime mover flywheel 128 and splined locking collar 185.

In this embodiment, resilient ring 184 attenuates vibrations between prime mover flywheel 128 and inner hub 187. Resilient ring 184 attenuates vibrations between prime mover flywheel 128 and inner hub 187 because resilient ring 184 is coupled between prime mover flywheel 128 and inner hub 187. As mentioned above, inner hub 187 includes inner L-shaped ring portion 187*a* and outer L-shaped ring portion 187*b*. Hence, resilient ring 184 attenuates vibrations between prime mover flywheel 128 and inner hub 187 includes inner L-shaped ring portion 187*a* and outer L-shaped ring portion 187*b*.

In this embodiment, resilient ring 184 attenuates vibrations between outer flange 182 and splined clutch input shaft 179. Resilient ring 184 attenuates vibrations between outer flange 182 and splined clutch input shaft 179 because resilient ring 184 is coupled between outer flange 182 and splined clutch input shaft 179.

In this embodiment, resilient ring 184 attenuates vibrations between outer flange 182 and splined locking collar 185. Resilient ring 184 attenuates vibrations between outer flange 182 and splined locking collar 185 because resilient ring 184 is coupled between outer flange 182 and splined locking collar 185.

In this embodiment, resilient ring 184 attenuates vibrations between outer flange 182 and inner hub 187. Resilient ring 184 attenuates vibrations between outer flange 182 and inner hub 187 because resilient ring 184 is coupled between outer flange 182 and inner hub 187. As mentioned above, inner hub 187 includes inner L-shaped ring portion 187*a* and outer L-shaped ring portion 187*b*. Hence, resilient ring 184 attenuates vibrations between outer flange 182 and inner hub 187 includes inner L-shaped ring portion 187*a* and outer L-shaped ring portion 187*b*.

Hence, there are many different ways in which resilient ring 184 attenuates vibrations between prime mover 120 and clutch assembly 140 and compressor 130. It is desirable to attenuate the vibrations between prime mover 120 and clutch assembly 140 and compressor 130 because these vibrations can undesirably affect the operation of clutch assembly 140 and compressor 130. In some situations, compressor 130 will seize up in response to vibrations from prime mover 120. Compressor 130 is seized when compressor driveshaft 133 is undesirably restricted from rotating. It is expensive and time consuming to remove compressor 130 and replace it with another one.

FIG. 7*g* is an embodiment of a clutch-to-prime mover coupling, which is denoted as clutch-to-prime mover coupling 180*a*. In this embodiment, clutch-to-prime mover coupling 180*a* includes outer flange 182, which includes a plurality of outer flange openings 183 extending around its outer periphery. Outer flange openings 183 are sized and shaped to receive fasteners 181 so that clutch-to-prime mover coupling 180*a* is capable of being coupled to respective flywheel openings 129 of prime mover flywheel 128 (FIG. 4*a*). In this way, clutch-to-prime mover coupling 180*a* is coupled to prime mover 120.

In this embodiment, clutch-to-prime mover coupling 180*a* does not include a resilient ring, such as resilient ring 184. Instead, clutch-to-prime mover coupling 180*a* includes a rigid ring portion 184*a*, which is coupled to an inner periphery of outer flange 182. Rigid ring portion 184*a* is coupled to the inner periphery of outer flange 182 so that rigid ring portion 184*a* rotates in response to rotation of outer flange 182. Rigid ring portion 184*a* includes a rigid material, such as metal. The rigid material of rigid ring portion 184*a* is more rigid than the resilient material of resilient ring 184.

Clutch-to-prime mover coupling 180*a* does not move from the coupled condition to the decoupled condition, as described above with clutch-to-prime mover coupling 180, because clutch-to-prime mover coupling 180*a* includes rigid ring portion 184*a* instead of resilient ring 184. Further, clutch-to-prime mover coupling 180*a* does not attenuate vibrations that flow between prime mover 120 and compressor 130 because clutch-to-prime mover coupling 180*a* includes rigid ring portion 184*a* instead of resilient ring 184. In this way, clutch-to-prime mover coupling 180*a* is a rigid coupling.

In this embodiment, clutch-to-prime mover coupling 180*a* includes inner hub 187, which includes inner and outer L-shaped ring portions 187*a* and 187*b*. Outer and inner peripheries of outer L-shaped ring portion 187*b* are engaged with resilient ring 184 and inner L-shaped ring portions 187*a*, respectively. The outer periphery of outer L-shaped ring portion 187*b* is coupled to rigid ring portion 184*a* so that inner hub 187 rotates in response to rotation of rigid ring portion 184*a* and outer flange 182. In this way, inner hub 187 is coupled to outer flange 182 through rigid ring portion 184*a*. The inner periphery of outer L-shaped ring portion 187*b* is coupled to inner L-shaped ring portion 187*a* so that inner L-shaped ring portion 187*a* rotates in response to rotation of outer L-shaped ring portion 187*b*.

In this embodiment, clutch-to-prime mover coupling 180*a* includes splined locking collar 185, wherein an outer periphery of splined locking collar 185 is coupled to inner hub 187. The outer periphery of splined locking collar 185 is coupled to inner L-shaped ring portion 187*a* so that splined locking collar 185 rotates in response to rotation of inner hub 187, rigid ring portion 184*a* and outer flange 182. In this way, splined locking collar 185 is coupled to outer flange 182 through rigid ring portion 184*a*.

In this embodiment, splined locking collar 185 includes central opening 193 and locking collar splines 186, which extend through the central opening 193. Central opening 193 of splined locking collar 185 is sized and shaped to receive splined clutch input shaft 179 so that clutch input shaft splines 189 engage locking collar splines 186. Clutch-to-prime mover coupling 180*a* is coupled to splined clutch input shaft 179 so that splined clutch input shaft 179 rotates in response to rotation of clutch-to-prime mover coupling 180*a*. In particular, splined clutch input shaft 179 rotates in response to rotation of splined locking collar 185, inner hub 187, rigid ring portion 184*a* and outer flange 182 when clutch-to-prime mover coupling 180*a* is engaged with prime mover 120. In this way, splined clutch input shaft 179 is coupled to outer flange 182 through rigid ring portion 184*a*.

FIG. 8*a* is a perspective view of compressor end 148 of clutch assembly 140 with clutch-to-compressor coupling 150 coupled to clutch 141, and FIG. 8*b* is a perspective view of compressor end 148. As shown in FIG. 8*b*, clutch 141 includes splined clutch output shaft 178, which includes clutch output shaft splines 188. Splined clutch output shaft 178 is capable of being coupled with splines of clutch-to-compressor coupling 150, as will be discussed in more detail presently.

FIGS. 9*a* and 9*b* are perspective front and back views of clutch-to-compressor coupling 150, and FIGS. 9*c* and 9*d* are front views of different embodiments of clutch-to-compressor coupling 150, and FIG. 9*e* is a back view of clutch-to-compressor coupling 150. FIG. 9*f* is an exploded perspective view of clutch-to-compressor coupling 150. Further, FIG. 9*g* is a side view of clutch-to-compressor coupling 150, and FIG. 9*f* is a cut-away side view of clutch-to-compressor coupling 150 taken along a cut-line 9*h*-9*h* of FIG. 9*g*. FIGS. 9*i* and 9*j* are cut-away side views of clutch-to-compressor coupling 150, which correspond to the view of FIG. 9*f*. In FIG. 9*i*, clutch-to-compressor coupling 150 is coupled to splined clutch output shaft 178, and, in FIG. 9*j*, clutch-to-compressor coupling 150 is coupled to splined clutch output shaft 178 and compressor driveshaft 133.

In this embodiment, clutch-to-compressor coupling 150 includes a clutch-to-compressor collar 152, which includes collar flanges 154 and 155 spaced from each other by a collar groove 156. Collar flanges 154 and 155 and collar groove 156 extend annularly around a central opening 153. As will be discussed in more detail below, collar flanges 154 and 155 and collar groove 156 operate as a compression flange which allow clutch-to-compressor collar 152 to be compressed against compressor driveshaft 133 (FIG. 4*b*) when compressor driveshaft 133 extends through central opening 153. In this way, a friction fit is formed between compressor driveshaft 133 and clutch-to-compressor coupling 150 so that compressor driveshaft 133 and clutch-to-compressor coupling 150 are frictionally coupled together.

In the embodiment of clutch-to-compressor coupling 150 shown in FIG. 9*d*, clutch-to-compressor collar 152 includes a keyway 138 which faces central opening 153. Keyway 138 is sized and shaped to receive key 135 in the embodiment indicated by indication arrow 139 in FIG. 4*b*.

In the embodiment of clutch-to-compressor coupling 150 shown in FIGS. 9*c* and 9*d* collar flanges 154 and 155 and collar groove 156 operate as a compression flange which allow clutch-to-compressor collar 152 to be compressed against compressor driveshaft 133 (FIG. 4*b*) and key 135 when compressor driveshaft 133 extends through central opening 153 and key 135 extends through keyway 138. Key 135 engages clutch-to-compressor collar 152 through keyway 138 so that compressor driveshaft 133 and clutch-to-compressor collar 152 are mechanically coupled together. In general, the mechanical coupling between key 135 and clutch-to-compressor collar 152 is less likely to undesirably experience slip than a frictional coupling between compressor driveshaft 133 and clutch-to-compressor collar 152.

In this embodiment, clutch-to-compressor coupling 150 includes an annular protrusion 157, which extends annularly around central opening 153, and away from collar flange 155. Central opening 153 extends through annular protrusion 157 and collar flanges 154 and 155. Clutch-to-compressor coupling 150 includes a plurality of flange openings 158, which extend through collar flanges 154 and 155 and collar groove 156, as shown in FIGS. 9*f* and 9*h*. Flange openings 158 are sized and shaped to receive a corresponding compression fastener 167 which compresses clutch-to-compressor collar 152 to compressor driveshaft 133 when compressor driveshaft 133 extends through central opening 153, as discussed in more detail above.

In this embodiment, clutch-to-compressor coupling 150 includes a plurality of protrusion openings 159, which extend through annular protrusion 157 and collar groove 156, as shown in FIGS. 9*f* and 9*h*. Protrusion openings 159 are sized and shaped to receive a corresponding flange fastener 166 which fastens clutch-to-compressor collar 152 to a splined locking collar, as will be discussed in more detail presently.

In this embodiment, clutch-to-compressor coupling 150 includes a splined locking collar 160. In this embodiment, splined locking collar 160 includes a collar flange 161 having a plurality of flange openings 164 extending therethrough. Flange openings 164 are sized and shaped to receive a corresponding flange fastener 166, which extends through corresponding protrusion openings 159. In this way, splined locking collar 160 is fastened to clutch-to-compressor collar 152.

In this embodiment, clutch-to-compressor coupling 150 includes an annular protrusion 162 which extends annularly around a central opening 163. Central opening 163 extends through annular protrusion 162 and splined locking collar 160. Annular protrusion 162 includes a splined surface 165 which extends through central opening 163.

As shown in FIG. 9*i*, central opening 163 is sized and shaped to receive splined clutch output shaft 178 so that splined surface 165 engages clutch output shaft splines 188. In this way, splined locking collar 160 is coupled to splined clutch output shaft 178.

As shown in FIG. 9*j*, central opening 153 is sized and shaped to receive compressor driveshaft 133 so that clutch-to-compressor collar 152 and compressor driveshaft 133 are coupled together, as discussed in more detail above. In this way, compressor 130 is operatively coupled to clutch assembly 140.

FIGS. 10*a* and 10*b* are perspective views of platform 103 carrying pump system 190 and compressor 130. FIGS. 10*c* and 10*d* are side and top views, respectively, of platform 103 carrying pump system 190 and compressor 130, as shown in FIGS. 10*a* and 10*b*.

In this embodiment, platform 103 includes opposed longitudinal platform beams 104*a* and 104*b*, which extend longitudinally along drilling machine 100. Longitudinal platform beams 104*a* and 104*b* extend longitudinally along drilling machine 100 because they extend lengthwise between vehicle front 101*a* and vehicle back 101*b*. Further, platform 103 includes a compartment 168 which extends between opposed longitudinal platform beams 104*a* and 104*b*. As discussed in more detail below, compartment 168 is sized and shaped to receive prime mover 120 and clutch assembly 140.

In this embodiment, platform 103 includes a cross beam 104*c* which extends between opposed longitudinal platform beams 104*a* and 104*b*. Further, platform 103 includes a clutch compartment 169 which extends between opposed longitudinal platform beams 104*a* and 104*b*. As discussed in more detail below, compartment 168 includes a clutch compartment 169 which is sized and shaped to receive clutch assembly 140.

FIGS. 11*a* and 11*b* are perspective views of clutch assembly 140 in fluid communication with a clutch assembly heat exchange system 194. It should be noted that the operation of clutch assembly heat exchange system 194 is controlled by control panel 210 and/or control panel 211. For example, the flow of fluid through clutch assembly heat exchange system 194 can be controlled in response to one or more inputs provided to control panel 210 and/or control panel 211. Further, information regarding the operation of clutch assembly heat exchange system 194 is displayed by display 204. For example, the temperature of the fluid flowing through clutch assembly heat exchange system 194 can be displayed by display 204.

In this embodiment, clutch assembly heat exchange system 194 includes a heat exchanger 114 and sump 115. In this embodiment, clutch assembly 140 is in fluid communication with heat exchanger 114 through a hydraulic source line 198. Hydraulic source line 198 is coupled to an input port of clutch assembly 140 and an output port of heat exchanger 114.

In this embodiment, an input port of heat exchanger 114 is in fluid communication with an output port of a hydraulic pump 196 through a hydraulic source line 197. Input port of hydraulic pump 196 is in fluid communication with an output port of sump 115 through a hydraulic source line 195. An output port of clutch assembly 140 is in fluid communication with an input port of sump 115 through a hydraulic return line 199*a*.

In this embodiment, clutch assembly heat exchange system 194 includes a breather line 199*b* in fluid communication with clutch assembly 140 and sump 115. Breather line 199*b* is parallel to hydraulic return line 199*a*, and allows air trapped in clutch assembly 140 to be removed therefrom.

It should be noted that clutch assembly heat exchange system 194 includes one hydraulic return line 199*a* in this embodiment. However, clutch assembly heat exchange system 194 generally includes one or more hydraulic return line. The number of hydraulic return line of clutch assembly heat exchange system 194 is typically chosen so that a desired amount of heat can be flowed from clutch assembly 140. In general, the amount of heat flowed from clutch assembly 140 increases and decreases as the number of hydraulic return lines of clutch assembly heat exchange system 194 increases and decreases, respectively.

In operation, sump 115 provides a supply of hydraulic fluid to hydraulic pump 196, and hydraulic pump 196 flows the hydraulic fluid to heat exchanger 114. Heat exchanger 114 receives the hydraulic fluid from hydraulic pump 196 and reduces its temperature. The hydraulic fluid flows from heat exchanger 114 to clutch assembly 140, wherein the hydraulic fluid facilitates the ability of clutch assembly 140 to move between the engaged and disengaged conditions in response to a signal provided to clutch controller 142. In this way, clutch assembly 140 operates as a hydraulic clutch. The hydraulic fluid flows from clutch assembly 140 to sump 115 through hydraulic return line 199*a*. In this embodiment, sump 115 and heat exchanger 114 are carried by platform 103. Sump 115 and heat exchanger 114 can be carried by platform 103 in many different ways so they are in fluid communication with clutch assembly 140, one of which will be discussed in more detail presently.

FIGS. 12*a*, 12*b* and 12*c* are perspective views of clutch assembly heat exchange system 194 being carried by platform 103 so it is in fluid communication with clutch assembly 140, as described in more detail above. FIGS. 12*d* and 12*e* are side and top views, respectively, of clutch assembly heat exchange system 194 being carried by platform 103.

In this embodiment, clutch assembly 140 is operatively coupled to compressor 130 in a manner that is described in more detail above. In particular, clutch assembly 140 is operatively coupled to compressor 130 by coupling clutch-to-compressor coupling 150 to splined clutch output shaft 178, as shown in FIG. 9*i*, and by coupling clutch-to-compressor coupling 150 to compressor driveshaft 133, as shown in FIG. 9*j*. The coupling of clutch-to-compressor coupling 150 and splined clutch output shaft 178 is discussed in more detail above with FIG. 9*i*, and the coupling of clutch-to-compressor coupling 150 and compressor driveshaft 133 is described in more detail above with FIG. 9*j*.

In this embodiment, and as shown in FIGS. 2*a* and 2*b*, compressor 130 is operatively coupled to prime mover 120 in a manner that is described in more detail above. In particular, compressor 130 is operatively coupled to prime mover 120 by coupling clutch-to-prime mover coupling 180 to compressor coupler 121 (FIG. 4*a*). The coupling of clutch-to-prime mover coupling 180 and compressor coupler 121 is discussed in more detail above with FIGS. 6*a* and 6*b*, as well as FIGS. 7*a*-7*f*.

Clutch assembly 140 is operatively coupled to compressor 130 so that clutch assembly 140 extends through compressor compartment 169 towards cross beam 104*c*. Clutch assembly 140 is operatively coupled to compressor 130 so that clutch assembly 140 extends towards compartment 168 and pump system 190.

In this embodiment, and as shown in FIGS. 2*a* and 2*b*, pump system 190 is operatively coupled to prime mover 120 in a manner that is described in more detail above. In particular, pump system 190 is operatively coupled to prime mover 120 by coupling one end of pump system shaft assembly 122 to shaft assembly coupler 191 and an opposed end to a flywheel of prime mover 120. The coupling of pump system shaft assembly 122 to prime mover 120 and pump system 190 is discussed in more detail above with FIGS. 3*a*, 3*b* and 3*c*.

In this embodiment, heat exchanger 114 is positioned proximate to radiator 111, as indicated in FIG. 12*b*. Heat exchanger 114 is positioned proximate to radiator 111 so that radiator 111 cools heat exchanger 114. Further, sump 115 is positioned proximate to pump system 190, as indicated in FIG. 12*e*. In particular, sump 115 is positioned between pump system 190 and platform front 103*a*. Sump 115 is positioned between pump system 190 and platform front 103*a* so that it is less likely to interfere with the operation of power pack 110.

Clutch assembly 140 provides many different advantages. One advantage provided by clutch assembly 140 is that the amount of fuel or energy consumed by power pack 110 is reduced. The amount of fuel or energy consumed by power pack 110 is reduced by clutch assembly 140 because clutch assembly 140 allows compressor 130 to be disengaged from prime mover 120 when compressor 130 is not being used. Compressor 130 is in stand-by mode when it is not being used, wherein the flow of air through compressor output port (not shown) is significantly reduced.

In some drilling situations, compressor 130 consumes about fifty percent of its maximum rated power when it is in stand-by mode, and compressor 130 is in stand-by mode about fifty percent of the time. The maximum rated power of compressor 130 can have many different values. In some drilling situations, compressor 130 has a maximum rated power in a range between about 200 horsepower (HP) to about 600 HP. Hence, in these situations, compressor 130 undesirably consumes between about 100 HP to about 300 HP. However, the power undesirably consumed by compressor 130 when in stand-by mode is driven to zero in response to moving clutch assembly 140 to the disengaged condition, as described in more detail above. In one particular situation, compressor 130 consumes about five percent of its maximum rated power to about fifteen percent of its maximum rated power when it is in stand-by mode and clutch assembly 140 is in the disengaged condition. It should be noted that the amount of power consumed by compressor 130 is driven to zero in response to clutch assembly 140 being moved to the disengaged condition. In this way, the amount of fuel consumed by power pack 110 is reduced.

Another advantage of clutch assembly 140 is that prime mover 120 can idle at a lower power setting when clutch assembly 140 is in the disengaged condition. Prime mover 120 can idle at a lower power setting when clutch assembly 140 is in the disengaged condition because prime mover 120 does not provide power to compressor 130 when clutch assembly 140 is in the disengaged condition.

The idle power setting typically depends on the amount of power needed to rotate the crankshaft of prime mover 120 without stalling, and corresponds to the revolutions per minute (RPM) that the crankshaft rotates. It has been found that clutch assembly 140 allows the crank shaft of prime mover 120 to rotate when idling between about 50 RPM to about 400 RPM less than drilling machines that do not include clutch assembly 140. For example, a drilling machine that does not include clutch assembly 140 typically idles at about 1200 RPM. However, a drilling machine that includes clutch assembly 140 is capable of idling at about 900 RPM.

It is desirable to have prime mover 120 idle at a lower power setting for many different reasons. For example, prime mover 120 uses less energy when it idles at a lower power setting. Further, prime mover 120 emits less noise when it idles at a lower power setting, and prime mover 120 experiences less wear when it idles at a lower power setting.

Another advantage of clutch assembly 140 is that compressor 130 is used less when clutch assembly 140 is in the disengaged condition. Hence, the lifetime of compressor 130 increases because it experiences less wear. It is useful to increase the lifetime of compressor 130 so that it has to be removed from drilling machine 100 and replaced with another compressor less often. This feature reduces the downtime of drilling machine 100, as well as the service costs.

Another advantage of clutch assembly 140 is that clutch assembly 140 can be in the disengaged condition when prime mover 120 is being started. It is useful to move clutch assembly 140 to the disengaged condition when prime mover 120 is being started to reduce the load that is driven by prime mover 120. Reducing the load that is driven by prime mover 120 when it is being started increases the likelihood that prime mover 120 will start. Further, prime mover 120 consumes less fuel when the load that it drives is reduced.

Another advantage of clutch assembly 140 is that it can be moved between the engaged and disengaged conditions when prime mover 120 is operating and not operating. Hence, it is not necessary to move prime mover 120 from the operating condition to the non-operating condition to move clutch assembly 140 between the engaged and disengaged conditions. Moving prime mover 120 from the operating condition to the non-operating condition to move clutch assembly 140 between the engaged and disengaged conditions is inconvenient and time consuming.

The embodiments of the invention described herein are exemplary and numerous modifications, variations and rearrangements can be readily envisioned to achieve substantially equivalent results, all of which are intended to be embraced within the spirit and scope of the invention.

The invention claimed is:

1. A drilling machine, comprising:

a drilling bit;

a prime mover;

a pump system operatively coupled to the prime mover;

a compressor;

a hydraulic wet mechanical clutch coupled to the prime mover and compressor, wherein the hydraulic wet mechanical clutch is coupled to the prime mover with a clutch-to-prime mover coupling, and the hydraulic wet mechanical clutch comprises a compressor end housing coupled to the clutch through a clutch spacer, wherein the clutch spacer allows the compressor to be spaced from the prime mover; wherein the compressor is allowed to provide air and is restricted from providing air in response to the hydraulic wet mechanical clutch being in engaged and disengaged conditions, respectively, and the hydraulic wet mechanical clutch is moveable between the engaged and disengaged conditions during operation of the prime mover; and a fluid heat exchange system comprising a sump and a heat exchanger, which flows heat from the hydraulic wet mechanical clutch, wherein the heat exchanger is positioned proximate a radiator of the drilling machine and the radiator cools the heat exchanger by convection from air drawn by the radiator, wherein the fluid heat exchange system flows hydraulic fluid from the hydraulic wet clutch to the sump, then to the heat exchanger to reduce the hydraulic fluid temperature and then back to the hydraulic wet mechanical clutch, and wherein the sump is positioned proximate the pump system.

2. The drilling machine of claim 1, wherein the clutch-to-prime mover coupling includes a torsional coupling coupled between the prime mover and clutch.

3. The drilling machine of claim 2, wherein the torsional coupling includes a resilient ring.

4. The drilling machine of claim 1, wherein the clutch-to-prime mover coupling includes a rigid coupling coupled between the prime mover and the clutch.

5. The drilling machine of claim 1, further including a control system operatively coupled to the prime mover and clutch, wherein the control system moves the clutch to the disengaged condition in response to an indication that the prime mover is being driven to a non-operating condition.

6. The drilling machine of claim 1, further including a control system operatively coupled to the clutch, wherein the compressor provides air in response to the control system moving the clutch to the engaged condition.

7. The drilling machine of claim 1, further including a control system operatively coupled to the prime mover and clutch, wherein the control system moves the clutch between the engaged and disengaged conditions during operation of the prime mover.

8. The drilling machine of claim 1, wherein the drilling bit is operatively coupled to the compressor, wherein the compressor provides air and does not provide air to the drilling bit in response to the clutch being in the engaged and disengaged conditions, respectively.

9. The drilling machine of claim 1, wherein the clutch is a hydraulic power take-off clutch.

10. The drilling machine of claim 1, further including a control panel operatively coupled to the clutch, wherein the clutch moves between the engaged and disengaged conditions in response to an input provided to the control panel.

11. A drilling machine, comprising:

a drilling bit;

a prime mover;

a pump system operatively coupled to the prime mover;

a hydraulic wet mechanical clutch, wherein the hydraulic wet mechanical clutch is coupled to the prime mover with a clutch-to-prime mover coupling;

a compressor coupled to the prime mover through the hydraulic wet mechanical clutch, wherein the hydraulic wet mechanical clutch comprises a compressor end housing coupled to the clutch through a clutch spacer, wherein the clutch spacer allows the compressor to be spaced from the prime mover; and a fluid heat exchange system comprising a sump and a heat exchanger, which flows heat from the hydraulic wet mechanical clutch to the sump and then to the heat exchanger, wherein the heat exchanger is positioned proximate a radiator of the drilling machine, wherein the radiator cools the heat exchanger by convection from air drawn by the radiator, wherein the fluid heat exchange system flows hydraulic fluid from the hydraulic wet clutch to the sump, then to the heat exchanger to reduce the hydraulic fluid temperature and then back to the hydraulic wet mechanical clutch, and wherein the sump is positioned proximate the pump system.

12. The drilling machine of claim 11, wherein the clutch-to-prime mover coupling includes a torsional coupling with a resilient ring, wherein the resilient ring attenuates vibrations between the prime mover and clutch.

13. The drilling machine of claim 11, further including an operator's cab having a control system with a first input, wherein the clutch is operated in response to adjusting the first input.

14. The drilling machine of claim 11, further including an operator's cab having a control system with first and second inputs, wherein the clutch and prime mover are operated in response to adjusting the first and second inputs, respectively.

15. The drilling machine of claim 11, further including an operator's cab having a control system with first, second and third inputs, wherein the clutch, prime mover and compressor are operated in response to adjusting the first, second and third inputs, respectively.

16. A drilling machine, comprising:

a drilling bit;

a prime mover;

a pump system operatively coupled to the prime mover;

a hydraulic wet mechanical clutch;

a torsional coupling positioned at an input end of the hydraulic wet mechanical clutch;

a compressor positioned at the output end of the hydraulic wet mechanical clutch a control system operatively coupled to the clutch, wherein the clutch moves from an engaged to a disengaged condition in response to the control system receiving one of a stall signal from the prime mover or a seize signal from the compressor, wherein the hydraulic wet mechanical clutch comprises a compressor end housing coupled to the clutch through a clutch spacer, wherein the clutch spacer allows the compressor to be spaced from the prime mover; and a fluid heat exchange system comprising a sump and a heat exchanger, which flows heat from the hydraulic wet mechanical clutch, wherein the heat exchanger is positioned proximate a radiator of the drilling machine and the radiator cools the heat exchanger by convection from air drawn by the radiator, and wherein the sump is positioned proximate the pump system.

17. The drilling machine of claim 16, wherein the compressor is operatively coupled to the prime mover in response to the clutch being in the engaged condition and the torsional coupling being in a coupling condition.

18. The drilling machine of claim 16, wherein the compressor is inoperatively coupled to the prime mover in response to the clutch being in the disengaged condition.

19. The drilling machine of claim 16, wherein the compressor is inoperatively coupled to the prime mover in response to the torsional coupling being in an uncoupled condition.

20. The drilling machine of claim 16, wherein the compressor is inoperatively coupled from the prime mover in response to the clutch being in the engaged condition and the torsional coupling being in an uncoupled condition.

21. The drilling machine of claim 16, wherein the compressor moves from an operative condition to an inoperative condition in response to the clutch moving from the engaged condition to the disengaged condition.

22. The drilling machine of claim 16, wherein the compressor moves from an inoperative condition to an operative condition in response to the clutch moving from the disengaged condition to the engaged condition.

23. The drilling machine of claim 16, wherein the compressor moves from an operative condition to an inoperative condition in response to the torsional coupling moving from a coupling condition to an uncoupling condition.

24. The drilling machine of claim 16, wherein the torsional coupling moves to a decoupled condition in response to an indication from the compressor.

25. The drilling machine of claim 16, wherein the torsional coupling moves to a decoupled condition in response to an indication from the prime mover.

26. The drilling machine of claim 16, wherein the clutch moves between the engaged and disengaged conditions during operation of the prime mover.

27. A drilling machine, comprising:

a drilling bit;

a prime mover;

a compressor;

a clutch assembly which includes a hydraulic wet mechanical clutch, wherein the hydraulic wet mechanical clutch is coupled to a prime mover flywheel, wherein the hydraulic wet mechanical clutch comprises a compressor end housing coupled to the clutch through a clutch spacer, wherein the clutch spacer allows the compressor to be spaced from the prime mover;

wherein the compressor is allowed to provide air and is restricted from providing air in response to the hydraulic wet mechanical clutch being in engaged and disengaged conditions, respectively;

a control system operatively coupled to the hydraulic wet mechanical clutch, wherein the clutch moves from the engaged to the disengaged condition in response to the control system receiving a stall signal from the prime mover; and a fluid heat exchange system comprising a sump and a heat exchanger, which flows heat from the hydraulic wet mechanical clutch, wherein the heat exchanger is positioned proximate a radiator of the drilling machine and the radiator cools the heat exchanger by convection from air drawn by the radiator, and wherein the sump is positioned proximate the pump system.

28. The drilling machine of claim 27, wherein the clutch assembly includes an outer compressor flange coupled to a prime mover flange of the prime mover.

29. The drilling machine of claim 27, wherein the clutch is coupled to the prime mover flywheel through a plurality of fasteners.

30. The drilling machine of claim 29, wherein the plurality of fasteners extend through corresponding flywheel openings of the flywheel.

31. The drilling machine of claim 29, wherein the clutch assembly includes an outer compressor flange coupled to a prime mover flange of the prime mover.

32. The drilling machine of claim 27, wherein the clutch is coupled to a prime mover flywheel through a clutch-to-prime mover coupling.

33. The drilling machine of claim 32, further including a plurality of fasteners which extend through the clutch-to-prime mover coupling 180 and engage the prime mover flywheel 128.

34. The drilling machine of claim 32, wherein the clutch assembly includes an outer compressor flange coupled to a prime mover flange of the prime mover.

35. A drilling machine, comprising:

a drilling bit;

prime mover, which includes a flywheel;

a pump system operatively coupled to the prime mover;

a clutch assembly which includes a hydraulic wet mechanical clutch;

a clutch-to-prime mover coupling which couples the hydraulic wet mechanical clutch to the prime mover, wherein the clutch-to-prime mover coupling includes:

an outer flange connected to the flywheel;

a locking collar connected to an input shaft of the clutch assembly; and a resilient ring positioned between the outer flange and locking collar, wherein the hydraulic wet mechanical clutch is moveable between engaged and disengaged conditions during operation of the prime mover;

a compressor operatively coupled to the prime mover through the clutch assembly;

a clutch-to-compressor coupling which couples an output shaft of the clutch assembly to the compressor, wherein the clutch-to-compressor coupling includes first and second collar flanges spaced apart from each other by a collar groove, wherein the first and second collar flanges extend annularly around a central opening of the clutch-to-compressor coupling, and wherein the hydraulic wet mechanical clutch comprises a compressor end housing coupled to the clutch through a clutch spacer, wherein the clutch spacer allows the compressor to be spaced from the prime mover; and a fluid heat exchange system comprising a sump and a heat exchanger, which flows heat from the hydraulic wet mechanical clutch, wherein the heat exchanger is positioned proximate a radiator of the drilling machine and the radiator cools the heat exchanger by convection from air drawn by the radiator, and wherein the sump is positioned proximate the pump system.

36. The drilling machine of claim 35, wherein the input shaft and locking collar each includes splines engaged with each other.

37. The drilling machine of claim 35, wherein the outer flange is coupled to the prime mover flywheel with a plurality of fasteners.

38. The drilling machine of claim 35, wherein the clutch-to-prime mover coupling includes an inner hub positioned between the resilient ring and locking collar.

39. The drilling machine of claim 35, wherein the resilient ring attenuates vibrations between the outer flange and locking collar.

40. The drilling machine of claim 35, wherein the clutch-to-compressor coupling includes a splined locking collar coupled to the first collar flange, and the output shaft of the clutch assembly.

41. The drilling machine of claim 35, wherein the clutch-to-compressor coupling includes a keyed locking collar coupled to the first collar flange, and the output shaft of the clutch assembly.

* * * * *